US012350558B1

(12) United States Patent
Greaney et al.

(10) Patent No.: US 12,350,558 B1
(45) Date of Patent: Jul. 8, 2025

(54) GOLF CLUBS WITH ELECTRONIC DISPLAYS

(71) Applicant: Taylor Made Golf Company, Inc., Carlsbad, CA (US)

(72) Inventors: Mark Vincent Greaney, Vista, CA (US); Brian M. Rahman, Carlsbad, CA (US); Matthew David Johnson, Encinitas, CA (US); Todd P. Beach, Encinitas, CA (US)

(73) Assignee: Taylor Made Golf Company, Inc., Carlsbad, CA (US)

( * ) Notice: Subject to any disclaimer, the term of this patent is extended or adjusted under 35 U.S.C. 154(b) by 338 days.

(21) Appl. No.: 18/105,194

(22) Filed: Feb. 2, 2023

Related U.S. Application Data

(60) Provisional application No. 63/305,777, filed on Feb. 2, 2022.

(51) Int. Cl.
*A63B 53/04* (2015.01)
*A63B 69/36* (2006.01)

(52) U.S. Cl.
CPC ..... *A63B 53/0441* (2020.08); *A63B 53/0437* (2020.08); *A63B 69/362* (2020.08); *A63B 53/0466* (2013.01)

(58) Field of Classification Search
CPC . A63B 53/04; A63B 53/0466; A63B 53/0441; A63B 53/0437
See application file for complete search history.

(56) References Cited

U.S. PATENT DOCUMENTS 5,692,964 A * 12/1997 Smith ..... A63B 69/3614 273/DIG. 30
5,807,190 A * 9/1998 Krumme ..... A63B 53/0466 473/329
6,929,564 B2 8/2005 Olsavsky et al.
(Continued)

FOREIGN PATENT DOCUMENTS

CN 1984698 A 6/2007
GB 2517712 3/2015
(Continued)

OTHER PUBLICATIONS

Adams Golf, "Adams DIXX Putters," https://adamsgolf.wordpress.com/2009/03/14/adams-dixx-putters/, posted Mar. 14, 2009, 3 pages.
(Continued)

*Primary Examiner* — Chase E Leichliter
(74) *Attorney, Agent, or Firm* — Klarquist Sparkman, LLP

(57) ABSTRACT

A golf club head comprises a body defining an interior cavity, a sole defining a bottom portion of the golf club head, a crown defining a top portion of the golf club head, a face defining a forward portion of the golf club head, a rearward portion of the golf club head opposite the face, and a hosel, the golf club head having a topline along a face-to-crown transition at the forward portion of the golf club head. The golf club head can comprise an electronic display positioned along the face-to-crown transition or wrapped from the face on to the crown. The electronic display can be sized and shaped to display an image that changes a position of the topline along the positive y-axis from a perspective of a user of the golf club head when the golf club head is in a normal address position.

22 Claims, 25 Drawing Sheets

(56) References Cited

U.S. PATENT DOCUMENTS

| | | | | |
|---|---|---|---|---|
| 7,278,926 | B2 | 10/2007 | Frame | |
| 7,396,295 | B1 | 7/2008 | Frame et al. | |
| 7,438,648 | B2 | 10/2008 | Wahl et al. | |
| 7,465,240 | B2 | 12/2008 | Frame | |
| 7,594,865 | B2 | 9/2009 | Ines | |
| 7,648,425 | B2 | 1/2010 | Wahl et al. | |
| 8,066,581 | B2 | 11/2011 | Ines et al. | |
| 8,142,303 | B2 * | 3/2012 | Endres | A63B 69/3614 473/223 |
| 8,328,654 | B2 | 12/2012 | Demkowski et al. | |
| 9,220,960 | B2 | 12/2015 | Schartiger et al. | |
| 9,375,619 | B2 | 6/2016 | Beach et al. | |
| 9,468,817 | B2 | 10/2016 | Beach et al. | |
| 9,522,313 | B2 | 12/2016 | Betts et al. | |
| 9,827,479 | B2 | 11/2017 | Demkowski et al. | |
| 10,052,530 | B2 | 8/2018 | Greaney et al. | |
| 10,391,369 | B2 | 8/2019 | Greaney et al. | |
| 10,874,928 | B2 | 12/2020 | Demkowski et al. | |
| 11,179,608 | B2 | 11/2021 | Greaney et al. | |
| 11,731,009 | B1 * | 8/2023 | Judge | A63B 69/3685 473/282 |
| 2005/0181884 | A1 * | 8/2005 | Beach | A63B 53/0466 473/131 |
| 2009/0131196 | A1 * | 5/2009 | Werner | A63B 53/0466 473/409 |
| 2010/0093458 | A1 * | 4/2010 | Davenport | A63B 53/0466 473/223 |
| 2010/0248852 | A1 * | 9/2010 | Lee | A63B 60/62 473/223 |
| 2011/0235146 | A1 | 9/2011 | Feil et al. | |
| 2013/0278994 | A1 | 10/2013 | Feil | |
| 2014/0139576 | A1 | 5/2014 | Costa et al. | |
| 2014/0361211 | A1 | 12/2014 | Marques et al. | |
| 2016/0184631 | A1 * | 6/2016 | Chou | A63B 53/0466 473/350 |
| 2016/0317896 | A1 * | 11/2016 | Albelo | G01S 19/19 |
| 2016/0375321 | A1 * | 12/2016 | Greaney | A63B 71/0619 473/219 |
| 2018/0311560 | A1 * | 11/2018 | Motokawa | A63B 60/46 |
| 2019/0038948 | A1 * | 2/2019 | Chou | G01B 5/0023 |
| 2022/0023735 | A1 * | 1/2022 | Lambeth | A63B 53/0466 |
| 2022/0150673 | A1 | 5/2022 | Lord et al. | |

FOREIGN PATENT DOCUMENTS

| | | | |
|---|---|---|---|
| JP | 2008506421 | A | 3/2008 |
| KR | 1020050031862 | A | 4/2005 |
| KR | 631035 | B1 | 10/2006 |
| KR | 2006125447 | A | 12/2006 |
| WO | WO2005/118086 | A1 | 12/2005 |

OTHER PUBLICATIONS

Alan Electronics GmbH, "DiXX Digital Instruction Putter," DiXX—Infinics, product brochure?, printed Jul. 1, 2022, 6 pages.

Alan Electronics—Dixx Putter, "Technische Daten," printed Jul. 1, 2022, 1 page.

Azumo, "Azumo discusses the advantages of Memory-in-Pixie (MIP) displays with Reflective LCDs within medical, industrial and consumer electronics industries, Memory-in-Pixel Is Attracting Attention," https://www.azumotech.com/resource-center/memory-in-pixel-is-attracting-attention/, posted May 22, 2020, 5 pages.

Data Modul, "Memory-in-Pixel Technology," Memory-in-Pixel Technology | Data Modul (data-modul.com), printed Jun. 28, 2022, 3 pages.

"Help and Instructions—DiXX Digital Instruction Putter," https://web.archive.org/web/20100304164848/http://www.digitalputter.com.au:80/help.asp, printed Jul. 1, 2022, 3 pages.

"DiXX Lite—Digital Instruction Putter: Now Available in Australia," https://web.archive.org/web/20091030141817/http://www.digitalputter.com.au/, printed Jul. 1, 2022, 2 pages.

Einführung, DiXX Digitaler Ausbildungs-Putter, printed Jul. 1, 2022, 28 pages.

E Ink, "Benefits, Bi-Stable," https://www.eink.com/benefits.html, printed Jul. 1, 2022, 6 pages.

E Ink, "Electronic Ink," https://www.eink.com/electronic-ink.html, printed Jul. 25, 2022, 7 pages.

Etulipa, Technology, "Electro Wetting Display technology (EWD)," https://etulipa.com/electro-wetting-display-technology/, printed Jul. 25, 2022, 3 pages.

Johnson, E. Michael, "How Dustin Johnson is getting dialed in with his putter," How Dustin Johnson is getting dialed in with his putter | Golf News and Tour Information | Golf Digest, posted Jan. 9, 2018, 4 pages.

New Vision Display, "What LCD Modes Mean: Reflective, Transmissive, Transflective," LCD Modes: New Vision Display, https://www.newvisiondisplay.com/LCD-modes, posted Mar. 14, 2017, 8 pages.

Segment LCD, "Custom Segment LCD (7, 14, and 16 Segment Displays)," https://focuslcds.com/segment-LCD/, printed Jul. 22, 2022, 6 pages.

The Sand Trap.com, "Adams Golf Launches DiXX digital Instruction Putter," Adams Golf Launches DiXX Digital Instruction Putter (Bag Drop, Hot Topics)—The Sand Trap, printed Jun. 30, 2022, 7 pages.

Tursky, Andrew, "DJ's new putter has a "T-line," and the reason explains why you need to get fit—GolfWRX," https://www.golfwrx.com/484248/djs-new-putter-has-a-t-line-and-the-reason-explains-exactly-why-you-need-to-get-fit/, posted Jan. 8, 2018, 10 pages.

Ynvisible, Segment Displays, Ultra-Low-Power Segmented E-Paper Displays Tailored to Your Needs, https://www.ynvisible.com/segment-displays, printed Jul. 25, 2022, 8 pages.

YouTube, "2008 PGA Show :: Dixx Blue Computerized Putter," Hooked On Golf Blog channel, published Jan. 21, 2008, 3 pages.

YouTube, "DiXX Lite Digital Instruction Putter," simonfa8 channel, published May 19, 2008, 3 pages.

* cited by examiner

GOLF CLUBS WITH ELECTRONIC DISPLAYS

CROSS-REFERENCE TO RELATED APPLICATION

This application claims the benefit of U.S. Provisional Application No. 63/305,777, filed Feb. 2, 2022, which is incorporated by reference herein in its entirety.

FIELD

This application is related to golf club heads with electronic displays.

BACKGROUND

A well-aimed golf shot requires a golfer to precisely align a golf club head with a golf ball. When getting ready to make a shot, the golfer may align the golf club head with the golf ball by visualizing a line between the golf club head and the golf ball or by lining up the golf ball with an alignment indicator on the golf club head. Example alignment indicators can comprise a decal, an indent, or another feature of the golf club head. Such alignment indicators, which can be painted, adhered to, or otherwise fixed to conventional golf club heads, cannot be easily adjusted.

However, due to variations in physical characteristics, golfing styles, and personal preferences, different golfers can prefer different sizes, shapes, or orientations of alignment indicators. The same golfer may even have different preferences for an alignment indicator depending on the circumstances of a particular golf shot. Many existing alignment indicators cannot be easily adjusted, and thus the golfer may have to select from several different clubs to find a golf club head with a preferred alignment indicator.

Furthermore, many existing alignment indicators on golf club heads provide only a limited amount of information to the golfer. Since many existing alignment indicators are static, such alignment indicators cannot instruct the golfer to manipulate the golf club head at address or during the swing to achieve a more accurate golf shot. Accordingly, a need exists for improvements to golf club heads.

SUMMARY

The present disclosure relates to apparatuses, systems, and methods pertaining to a golf club head for a golf club, wherein the golf club head is configured to provide a visual cue or an image that changes the position of a topline from the perspective of the user when the golf club head is in a normal address position.

In some examples, a golf club head can comprise a body. The body can define an interior cavity, a sole defining a bottom portion of the golf club head, a crown defining a top portion of the golf club head, a face defining a forward portion of the golf club head, a rearward portion of the golf club head opposite the face, and a hosel. The golf club head can have a topline along a face-to-crown transition at the forward portion of the golf club head. The face can include a center face location that defines a head origin of a coordinate system in which an x-axis is tangential to the face at the center face location and is parallel to a ground plane when the golf club head is in a normal address position, a y-axis that extends perpendicular to the x-axis and is also parallel to the ground plane, and a z-axis that extends perpendicular to the ground plane, wherein a positive x-axis extends toward a heel portion from the head origin, a positive y-axis extends toward the rearward portion from the head origin, and a positive z-axis extends toward the top portion from the head origin. The crown can comprise an electronic paper display positioned along the face-to-crown transition of the golf club head or wrapped from the face on to the crown, the electronic paper display being sized and shaped to display an image that changes a position of the topline along the positive y-axis from a perspective of a user of the golf club head when the golf club head is in a normal address position.

In some examples, a golf club head can comprise a body defining an interior cavity, a sole defining a bottom portion of the golf club head, a crown defining a top portion of the golf club head, a face defining a forward portion of the golf club head, a rearward portion of the golf club head opposite the face, and a hosel. The face can comprise a plurality of layers. The plurality of layers can comprise a base layer, a piezoelectric layer coupled to the base layer, an electronic paper display coupled to the piezoelectric layer. The piezoelectric layer can be configured to generate a signal in response to a golf ball impacting the face. The electronic paper display can be configured to display an impact location of the golf ball on the face in response to the signal from the piezoelectric layer.

In some examples, a golf club head can comprise a body defining an interior cavity, a sole defining a bottom portion of the golf club head, a crown defining a top portion of the golf club head, a face defining a forward portion of the golf club head, a rearward portion of the golf club head opposite the face, and a hosel. The golf club head can have a topline along a face-to-crown transition at the forward portion of the golf club head. The face can include a center face location that defines a head origin of a coordinate system in which an x-axis is tangential to the face at the center face location and is parallel to a ground plane when the golf club head is in a normal address position, a y-axis that extends perpendicular to the x-axis and is also parallel to the ground plane, and a z-axis that extends perpendicular to the ground plane. A positive x-axis can extend toward a heel portion from the head origin, a positive y-axis can extend toward the rearward portion from the head origin, and a positive z-axis can extend toward the top portion from the head origin. The crown can comprise a first electronic paper display. The first electronic paper display can comprise a front edge portion extending along a front portion of the crown. The face can comprise a second electronic paper display, the second electronic display comprising a top edge portion extending along an upper edge of the face. The first electronic paper display and the second electronic paper display can be configured to display images that change a position of the topline along the positive y-axis from a perspective of a user of the golf club head when the golf club head is in a normal address position.

Certain aspects of the disclosure concern a method of showing an impact location of a golf ball on a golf club head. In some examples, the method can comprise detecting an impact between a face of the golf club head and the golf ball, determining an impact location of the golf ball on the face of the golf club head, and displaying the impact location on an electronic display coupled on the face of the golf club head.

The foregoing and other objects, features, and advantages of the disclosed technology will become more apparent from the following detailed description, which proceeds with reference to the accompanying figures.

DETAILED DESCRIPTION

General Considerations

Figure 1:
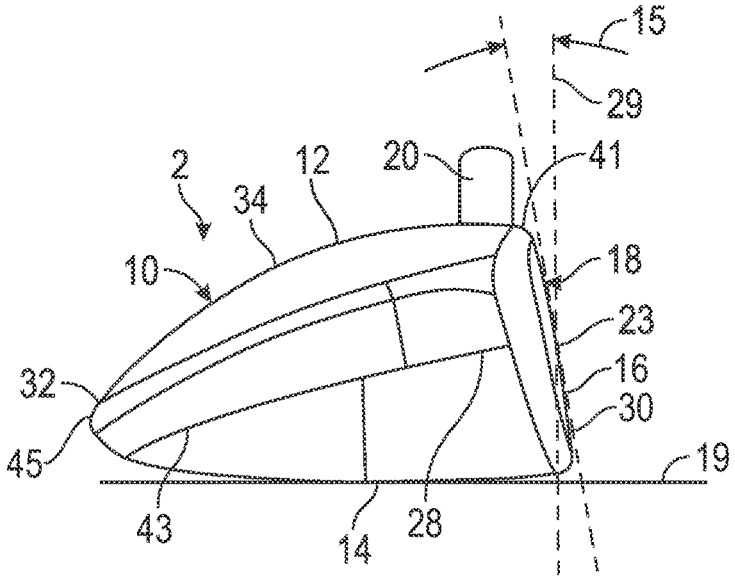
FIG. 1 is a side elevation view of an exemplary golf club head, according to one example.

For purposes of this description, certain aspects, advantages, and novel features of the embodiments of this disclosure are described herein. The disclosed methods, apparatus, and systems are not limiting in any way. Instead, the present disclosure is directed toward all novel features and aspects of the various disclosed embodiments, alone and in various combinations and sub-combinations with one another. The methods, apparatus, and systems are not limited to any specific aspect or feature or combination thereof, nor do the disclosed embodiments require that any one or more specific advantages be present or problems be solved. The scope of this disclosure includes any features disclosed herein combined with any other features disclosed herein, unless physically impossible.

Although the operations of some of the disclosed embodiments are described in a particular, sequential order for convenient presentation, it should be understood that this manner of description encompasses rearrangement, unless a particular ordering is required by specific language set forth herein. For example, operations described sequentially may in some cases be rearranged or performed concurrently. Moreover, for the sake of simplicity, the attached figures may not show the various ways in which the disclosed components can be used in conjunction with other components.

As used in this disclosure and in the claims, the singular forms "a," "an," and "the" include the plural forms unless the context clearly dictates otherwise. Additionally, the term "includes" means "comprises." Further, the terms "coupled" and "associated" generally mean electrically, electromagnetically, and/or physically (e.g., mechanically or chemically) coupled or linked and does not exclude the presence of intermediate elements between the coupled or associated items absent specific contrary language.

In some examples, values, procedures, or apparatus may be referred to as "lowest," "best," "minimum," or the like. Such descriptions are intended to indicate that a selection among many alternatives can be made, and such selections need not be better, smaller, or otherwise preferable to other selections.

In the description, certain terms may be used such as "up," "down," "upper," "lower," "horizontal," "vertical," "left," "right," and the like. These terms are used, where applicable, to provide some clarity of description when dealing with relative relationships. But, these terms are not intended to imply absolute relationships, positions, and/or orientations. For example, with respect to an object, an "upper" surface can become a "lower" surface simply by turning the object over. Nevertheless, it is still the same object.

Unless otherwise indicated, all numbers expressing dimensions, forces, masses, frequencies, material quantities, angles, pressures, molecular weights, percentages, temperatures, times, and so forth, as used in the specification or claims are to be understood as being modified by the term "about." Accordingly, unless otherwise indicated, implicitly or explicitly, the numerical parameters set forth are approximations that can depend on the desired properties sought and/or limits of detection under test conditions/methods familiar to those of ordinary skill in the art. When directly and explicitly distinguishing embodiments from discussed prior art, the embodiment numbers are not approximates unless the word "about" is recited. Furthermore, not all alternatives recited herein are equivalents.

Although there are alternatives for various components, parameters, operating conditions, etc., set forth herein, that does not mean that those alternatives are necessarily equivalent and/or perform equally well. Nor does it mean that the alternatives are listed in a preferred order unless stated otherwise.

Example 1: Representative Golf Club Head Components

Any of the club heads disclosed herein (such as club heads 2, 102, 202, etc.) can be coupled to a golf club shaft of any type to form a wood-type golf club. The features disclosed herein can be implemented in any type of wood-type golf club, such as a driver, a fairway wood, a hybrid club, a rescue club, or a utility club.

Although the descriptions and drawings presented herein are mainly associated with wood-type golf clubs, any of the features disclosed herein can analogously be implemented in any other type of golf club, such as an iron, a wedge, or a putter.

Figure 2:
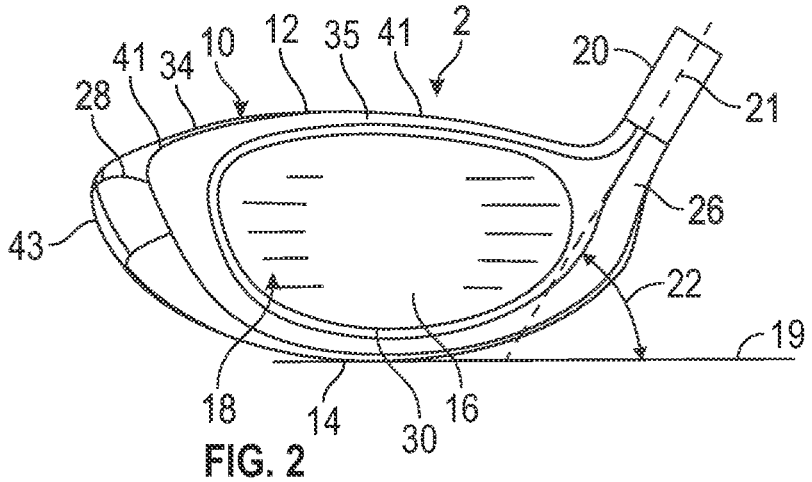
FIG. 2 is a front elevation view of the golf club head of FIG. 1, according to one example.
Figure 3:
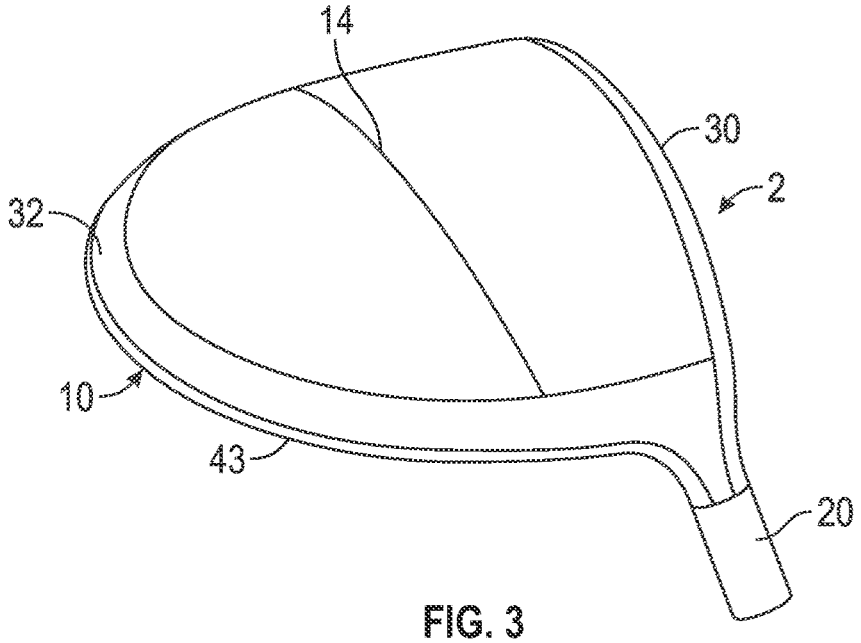
FIG. 3 is a bottom perspective view of the golf club head of FIG. 1, according to one example.

As illustrated in FIGS. 1-3, a wood-type golf club head, such as golf club head 2, can include a hollow body 10. The body 10 can include a crown 12 (which is also referred to herein as a "crown portion"), a sole 14 (which is also referred to herein as a "sole portion"), and a face 16 (which is also referred to herein as a "face portion") defining a striking surface 18, while defining an interior cavity. The crown 12 can define a top portion of the golf club head 2. The sole 14 can be a portion of the golf club head 2 configured to rest on a ground plane 19 when the golf club head 2 is at a normal address position. As used herein, the terms "normal address position" and "at address" refer to a position of the golf club head 2 where the sole 14 of the golf club head 2 is touching the ground plane 19 with a 60-degree USGA lie angle 22 and at a 0-degree face angle (a "square face"). The face angle is an angle formed by an axis normal to the striking surface 18 of the golf club head 2 and a line of flight of a golf ball (i.e., when the face 16 is perpendicular to the line of flight of the golf ball).

The body 10 may further include openings in the crown 12 and/or sole 14 that are overlaid or covered by inserts (which are also referred to herein as "panels" or "plates") formed of lighter-weight material, such as composite materials. For example, the crown 12 of the body 10 can comprise a composite crown insert that covers a large portion of the area of the crown 12 and has a lower density than the metal the body 10 is made of, thereby saving weight in the crown 12. Similarly, the sole 14 can include one or more openings in the body 10 that are covered by sole inserts. The sole insert can be made of composite material, metallic material, or other material. In embodiments where the body 10 includes openings in the crown 12 or sole 14, such openings can provide access to the inner cavity of the club head 2 during manufacturing, especially where the striking surface 18 is formed as an integral part of the body 10 during casting (and there is not a face opening in the body 10 to provide access during manufacturing). More information regarding openings in the body 10 and related inserts can be found in U.S. Patent Publication No. 2018/0185719, published Jul. 5, 2018, and in U.S. Pat. No. 10,874,922, issued Dec. 29, 2020, both of which are incorporated by reference herein in their entireties.

In some embodiments, the club head 2 can comprise one or more adjustable weights, such as one or more weights movable along weight tracks formed in the sole and/or perimeter of the club head 2. Other exemplary weights can be adjusted by rotating the weights within threaded weight ports. Various ribs, struts, mass pads, and other structures can be included inside the body 10 to provide reinforcement, adjust mass distribution and MOI properties, adjust acoustic properties, and/or for other reasons.

The striking surface 18 and a vertical axis 29 perpendicular to the ground plane 19 can define an angle therebetween called a loft 15 (which is also referred to herein as a "loft angle"). A "driver" type club head can have a loft 15 of 15 degrees or less, and, in some examples, of 12 degrees or less. A "fairway wood" type club head can have a loft 15 of 13 degrees or greater, and, in some examples, 15 degrees or greater.

The body 10 can further include a hosel 20, which can define a hosel bore 24 adapted to receive a golf club shaft. A hosel axis 21 can comprise a central longitudinal axis extending along the length of the hosel 20. The lie angle 22 can be an angle formed between the hosel axis 21 and the ground plane 19.

The body 10 may further include a heel portion 26, a toe portion 28, a front portion 30, a rear portion 32, and a top portion 34. The body 10 may further include a face-to-crown transition zone 41 (which is also referred to herein as a "face-to-crown transition region," a "crown/face juncture," or a "face-to-crown transition") at the front portion 30 of the club head 2. The face-to-crown transition zone 41 can extend in the heel-toe direction and can include a curved portion of the club head 2 where the face 16 transitions to the crown 12. The face-to-crown transition zone 41 may include a topline 35 where the face 16 meets the crown 12. In certain examples, the topline 35 can extend along the apex or forwardmost edge of the curved face-to-crown transition zone 41. In some examples, the topline 35 can be visually distinct from the top portion (e.g., the crown 12) and/or the front portion (e.g., the face 16) to provide an alignment indicator for a golfer (who is also referred to herein as a "user"). For example, a portion of the topline 35 (e.g., a line painted on the topline 35, or a display element as disclosed later) extending in the heel-toe direction can be a different color than the crown 12 and the face 16 to provide the golfer with a visual indication of the orientation of the club head 2.

The body 10 may include a skirt 43 (which is also referred to herein as a "skirt portion") disposed around a periphery of the club head 2 between the crown 12 and the sole 14. The body 10 may further include a crown-to-skirt transition zone 45 (which is also referred to herein as a "crown-to-skirt region" or a "crown-to-skirt transition") where the crown 12 transitions to the skirt 43.

Wood-type club heads, such as the club head 2, have a volume, typically measured in cubic-centimeters ($cm^3$), equal to the volumetric displacement of the club head 2, assuming any apertures are sealed by a substantially planar surface. (See United States Golf Association "Procedure for Measuring the Club Head Size of Wood Clubs," Revision 1.0. Nov. 21, 2003). In the case of a driver, the golf club head 2 can have a volume between approximately 250 $cm^3$ and approximately 600 $cm^3$, such as between approximately 300 $cm^3$ and approximately 500 $cm^3$, and can have a total mass between approximately 145 g and approximately 260 g. In the case of a fairway wood, the golf club head 2 can have a volume between approximately 120 $cm^3$ and approximately 300 $cm^3$, and can have a total mass between approximately 115 g and approximately 260 g. In the case of a utility or hybrid club, the golf club head 2 can have a volume between approximately 60 $cm^3$ and approximately 140 $cm^3$, and can have a total mass between approximately 105 g and approximately 280 g.

The sole 14 is defined as a lower portion of the club head 2 extending upwards from a lowest point of the club head 2 when the club head 2 is ideally positioned, i.e., at a proper address position relative to a golf ball on a level surface (such as the ground plane 19). In some implementations, the sole 14 at the heel portion 26 and/or toe portion 28 extends at least approximately 50% of the distance from the lowest point of the club head 2 to the highest elevation of the crown 12, and at least 55%, 60%, 65%, or 70% in additional embodiments. In one embodiment the distance is at least approximately 15 mm, and at least 20 mm, 25 mm, 30 mm, or 35 mm in further embodiments. In another embodiment the sole 14 at the rear portion 32 extends no more than 45% of the distance from the lowest portion of the club head 2 to the highest elevation of the crown 12, and in further embodiments no more than 40%, 35%, 30%, 25%, 20%, or 15%.

Materials which may be used to construct the golf club head 2 can include composite materials (e.g., carbon fiber reinforced polymeric materials, including unidirectional prepreg portions, weave portions, and/or chopped fiber portions), titanium or titanium alloys, steels or alloys of steel, magnesium alloys, copper alloys, nickel alloys, and/or any other metals or metal alloys suitable for golf club head construction. Other materials, such as paint, polymeric materials, ceramic materials, etc., can also be included in the golf club head 2. In some embodiments, the golf club head 2 can be made of a metallic material such as titanium or titanium alloys (including but not limited to 9-1-1 titanium, 6-4 titanium, 3-2.5, 6-4, SP700, 15-3-3-3, 10-2-3, or other alpha/near alpha, alpha-beta, and beta/near beta titanium alloys), or aluminum and aluminum alloys (including but not limited to 3000 series alloys, 5000 series alloys, 6000 series alloys, such as 6061-T6, and 7000 series alloys, such as 7075), Ti Grade 9 (Ti-3Al-2.5V) having a chemical composition of ≤3.5-2.5% Al; ≤3.0-2.0% V; ≤0.02% N; ≤0.013% H; ≤0.12% Fe.

Figure 4:
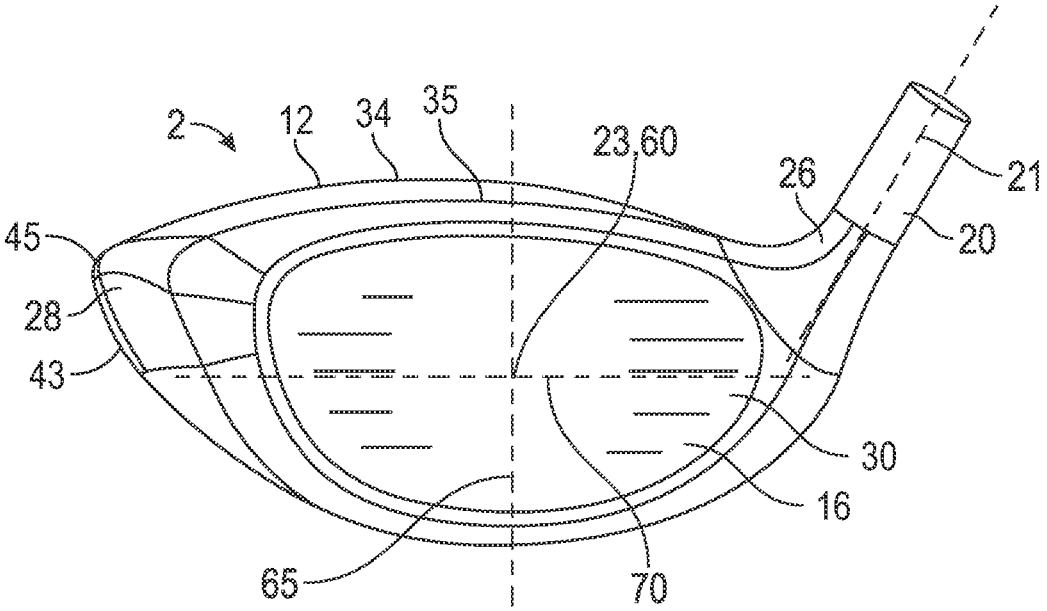
FIG. 4 is a front elevation view of the golf club head of FIG. 1 showing a golf club head origin coordinate system, according to one example.
Figure 5:
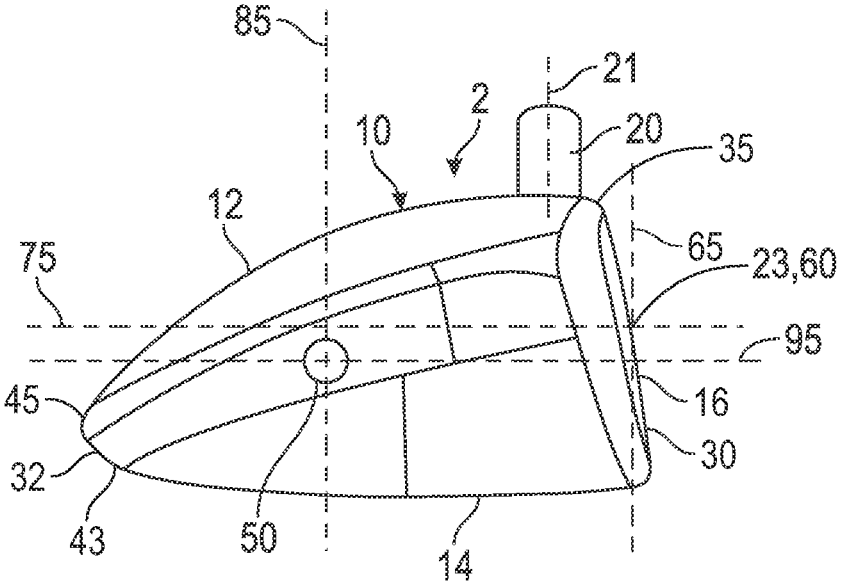
FIG. 5 is a side elevation view of the golf club head of FIG. 1 showing a center of gravity coordinate system, according to one example.
Figure 6:
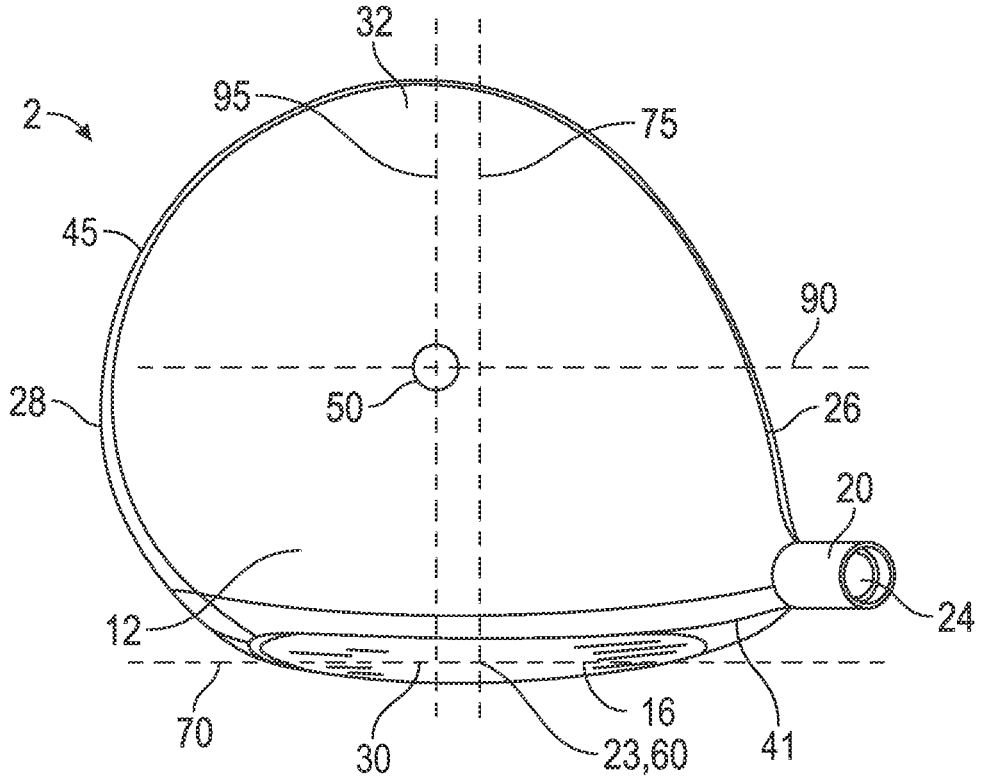
FIG. 6 is a top plan view of the golf club head of FIG. 1, according to one example.

FIGS. 4-6 illustrate a head origin 60, a head origin x-axis 70, a head origin y-axis 75, and a head origin z-axis 65, a center of gravity 50 of the club head, a CG x-axis 90, a CG y-axis 95, and a CG z-axis 85. The head origin axes 70, 75, 65 pass through the head origin 60, and the CG axes 90, 95, 85 pass through the CG 50. The head origin 60 is defined as the geometric center of the face 16 as measured per USGA protocol, see U.S.G.A. "Procedure for Measuring the Flexibility of a Golf Clubhead," Revision 2.0, Mar. 25, 2005, for the methodology to measure the center of the striking face of a golf club. The geometric center of the face 16, where the head origin 60 is located, is also referred to herein as a "center face location." The head origin axes 65, 70, 75 and CG axes 85, 90, 95 are horizontal or vertical (e.g., parallel or perpendicular to the ground plane 19) while the club head 2 is in the normal address position, as illustrated. The head origin x-axis 70 is tangential to the face 16 at the center face location and is parallel to the ground plane 19 when the club head 2 is at the normal address position. The positive head origin x-axis 70 (which is also referred to herein as the "positive x-axis") can extend from the head origin 60 towards the heel portion 26 and the negative head origin x-axis 70 (which is also referred to herein as the "negative x-axis") can extend from the head origin 60 towards the toe portion 28. The head origin y-axis 75 extends perpendicular to the head origin x-axis 70 and parallel to the ground plane 19. The positive head origin y-axis 75 (which is also referred to herein as the "positive y-axis") can extend from the head origin 60 towards the rear portion 32 and the negative head origin y-axis 75 (which is also referred to herein as the "negative y-axis") can extend from the head origin 60 towards the front portion 30. The head origin z-axis 65 extends perpendicular to the ground plane 19. The positive head origin z-axis 65 (which is also referred to herein as the "positive z-axis") can extend from the head origin 60 towards the top portion 34 and the negative head origin z-axis 65 (which is also referred to herein as the "negative z-axis") can extend from the head origin 60 towards the sole 14.

The head origin x-axis 70, head origin y-axis 75, and head origin z-axis 65 are sometimes referred to in shorthand as simply the x-axis, the y-axis, and the z-axis, and together they are referred to as the club head origin coordinate system. Similarly, the CG x-axis 90, CG y-axis 95, and CG z-axis 85 are referred to as the club head CG coordinate system, while the CG x-axis coordinate is referred to as CGx, the CG y-axis coordinate is referred to as CGy, and the CG-z axis coordinate is referred to as CGz. The head origin 60 can also be at the same point as an ideal impact location 23, as is illustrated, or the two points can be spaced apart. Thus, if the club head CG 50 is located 5 mm toward the heel from the head origin 60, and 5 mm below the head origin 60, and 25 mm behind the head origin 60, the head origin x-axis (CGx) coordinate would be 5 mm, the head origin y-axis (CGy) coordinate would be 25 mm, and the head origin z-axis (CGz) coordinate would be −5 mm. Similarly, if the club head CG 50 is located 5 mm toward the toe from the head origin 60, and 2 mm above the head origin 60, and 25 mm behind the head origin 60, the head origin x-axis (CGx) coordinate would be −5 mm, the head origin y-axis (CGy) coordinate would be 25 mm, and the head origin z-axis (CGz) coordinate would be 2 mm. As used herein, "Zup"

means the CG z-axis location determined according to the above ground coordinate system. Zup generally refers to the height of the CG 50 above the ground plane.

Example 2: Golf Club Heads with Electronic Paper Displays

The technology disclosed herein relates to e-ink displays and other similar controllable display technologies that are integrated with golf clubs, golf club components, golf balls, golf bags, golf club head covers, and/or other golf-related equipment. An integrated layer of a golf club component can change cosmetically/visually when manipulated electrically, magnetically, or physically. Conventional methods of adjusting the appearance of the club head include permanent changes, such as painting, printing, decals, indentations or other physical features that are not easily changeable or adjustable. By contrast, with e-ink display technology (which is also referred to herein as "electronic paper technology" and/or "e-ink layer"), the visual effect can be readily adjusted by applying different electrical feeds.

One of the most powerful ways of affecting the result of a golf shot is through a change in visual cues. For example, by decoupling the appearance of a club from its physical measurements the golfer can be influenced to manipulate the club head at address or during the swing to achieve a desired effect. Also, incorporating e-ink technology into the face of a golf club we can essentially create erasable impact face tape, that may also identify the impact location and feed representative impact location data to an internal or external data storage and/or analysis component. This can enable the golfer to have real time feedback on impact location, and save such impact location data for historical analysis and/or club fitting purposes.

An e-ink integrated layer can be added on top of the existing structure of a golf club and can provide the ability to change the appearance of the club at address. For example, the e-ink layer can be positioned as the top layer of the crown, although the e-ink layer may include a protective external layer; and in some embodiments the e-ink layer may be incorporated into a composite crown lay-up so that it is flush, proud, or recessed from the adjacent composite material, or as a top layer of a putter.

The e-ink layer can cover the entire crown surface or just a portion. For instance, some embodiments can have a variable topline where the e-ink display can provide various topline angles relative to the static face angle. In some embodiments, an e-ink display can provide alignment aids parallel to the target line that can be toggled on or off for practice and play. In some embodiments, the e-ink display can display relevant information on the crown, such as information about the golf course, hole strategic advice, swing thoughts, wind conditions, or other useful information. The e-ink integrated layer can also be incorporated in the face of a club head, such as in a driver or other wood, or even a putter face. Either through the physical impact from a golf ball, or a piezoelectric generated voltage, the impact location can be revealed using an e-ink layer on or around the face. In some embodiments, the user can then erase the face by pushing a button or similar to generate a voltage that would revert the face back to its original state.

In some embodiments, the e-ink display may form a portion of an outermost layer of a golf club head while in other embodiments the e-ink display may be an integrated layer that is visible to a user but does not form an outermost layer of a golf club. For example, an e-ink display may be protected by a polyurethane cover or other polymer cover that forms the outermost layer of the golf club head. Such as when an e-ink display is visible from a face on view or from an address view. A see-through cover that includes score-lines may be placed overtop the e-ink display to protect the e-ink display from impact forces and the cover may provide advantageous spin characteristics to the golf ball to achieve desired performance in the various conditions that golf is played (e.g., wet and dry conditions) or the cover may provide spin variation across the face depending on impact location.

In various embodiments, the e-ink layer can be incorporated into virtually any surface as a banner displaying information or graphics. For instance, logos or information could be displayed on portions of the sole, crown, faces, iron backs, iron badges, shafts, head covers, bags, etc. The possibilities for personalization are infinite.

E-ink displays can advantageously utilize low power consumption, low voltages, sleep modes, and other energy saving features that can allow the display to operate over long periods of time (days, weeks, etc.) using an on-board battery without needing to be recharged.

As used herein, "e-ink" is used synonymously with "electric ink," "electrophoretic ink," and "electronic paper display" (EPD), all such technologies and terminologies are expressly included as alternative implementations of the disclosed technology. Such technologies can utilize electroluminescence, a process where electroluminescent materials emit light in response to an applied electrical current or electric field. Depending on the type of electroluminescent material, it can emit different colors. E-ink displays can produce any combinations of colors, such as black-and-white, grey-scale, two-tone, three color combinations, four color combinations, or even up to seven or more different colors at the same time on the same display.

A user may customize or control the one more e-ink displays on the golf club head using a smart phone, personal digital assistant, and/or a user may adjust the display by using onboard buttons or switches. The display may include pre-programed images that can be manipulated or changed by using an onboard switch or button. For example, a button push may cycle from a neutral tendency alignment aid/top-line/visual cue on a crown or top portion of a club head to a left tendency alignment aid/top-line/visual cue.

A golf club head may contain two or more e-ink displays. A first display on a crown portion and a second display on a face portion and the two may work together to form a manipulable top-line. This could allow adjustment of the topline and it could show impact location after a strike. It could also be used to make the face appear larger than it is by controlling the blend between the face and crown portions. A larger face inspires greater confidence in the golfer. Alternatively, a single display may wrap from a face portion of the golf club head onto the crown or upper portion of the golf club head, and this could be controlled to adjust the top-line/visual cues/alignment aid.

A product utilizing e-ink technology can also include any of various other electrical components, such as a battery, microcontroller, CPU, memory, wires, input/output devices, wireless transmitters and receivers, user interface displays/buttons/etc., and can be connected via wires or wirelessly to separate electrical devices or computing devices, such as a mobile phone, cellular communications tower, wi-fi network, the internet, and/or local electrical devices, such as in a golf bag or club head cover.

An e-ink layer can be integrated to a golf club in many different ways, such as by bonding/welding/fastening to a surface of the club head or integrated into the manufacture of a club head components, such as the crown plate or shaft. In some embodiments, the e-ink display may be permanently attached to the club head (non-removable) and in other embodiments the e-ink display may be user removable, or whatever the e-ink display attaches to may be removable for repair, charging, upgrades, and or replacement of the display.

Figure 7:
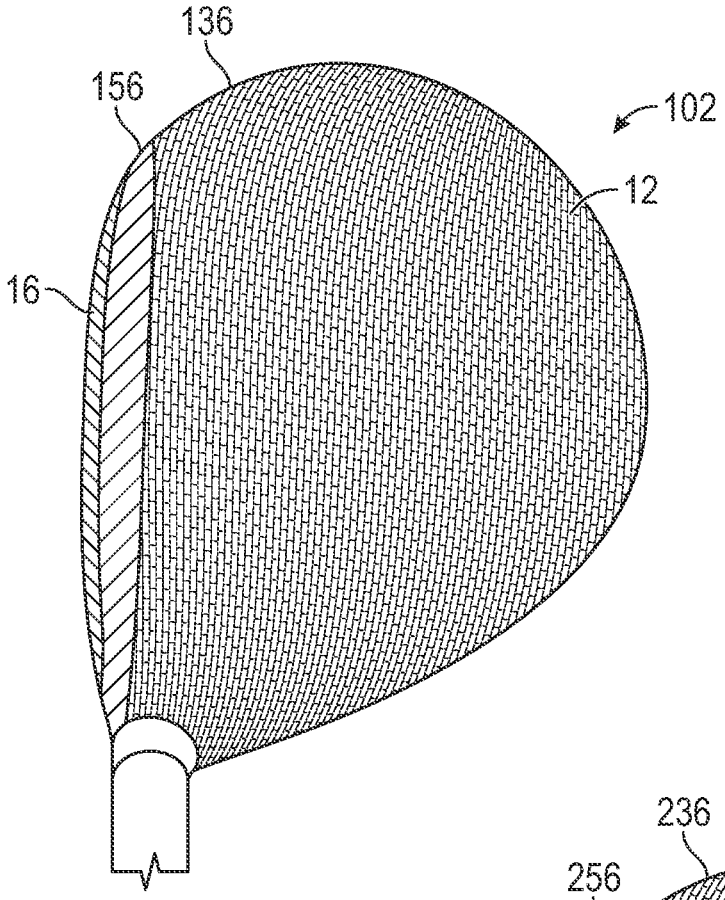
FIG. 7 shows an exemplary golf club head having an adjustable topline generated by a crown display, according to one example.

FIG. 7 shows an exemplary golf club head 102 having an adjustable topline 156 generated by an e-ink display 136 on the crown or crown-face junction. The angle of the generated topline 156 relative to the plane of the face 16 can be adjusted to cause a golfer to close or open the face 16 on a swing for a desired effect.

Figure 8:
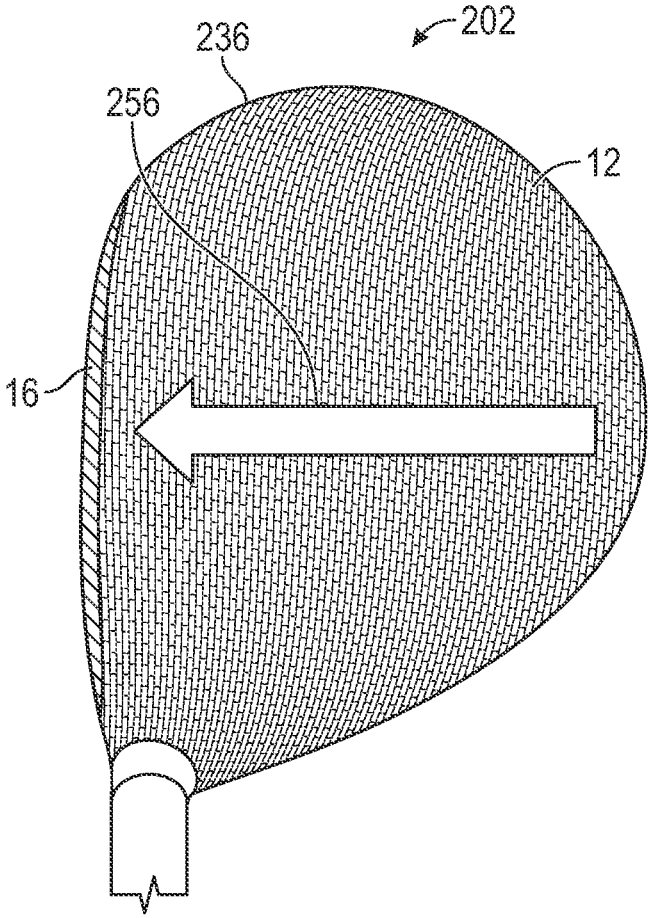
FIG. 8 shows an exemplary golf club head having an adjustable alignment aid generated by a crown display, according to one example.

FIG. 8 shows an exemplary golf club head 202 having an adjustable alignment aid 256 on the crown 12 that is generated by an e-ink display 236 on the crown 12. In this example, the alignment aid 256 is an arrow displayed by the e-ink display 236. The direction/orientation of the displayed arrow relative to the face 16 can be adjusted as needed to generate the desired effect. For instance in one embodiment the longitudinal axis of the displayed arrow is user adjustable by at least 2° relative to a default alignment corresponding to being parallel to the origin y-axis, and in further embodiments at least 4°, 6°, 8°, or 10°. Further, any of the disclosed adjustability ranges and features described with respect to a single embodiment apply equally to any of the disclosed alignment aides, crown alignment features, simulated toplines, topline alignment features, visual cues, or topline 835.

Figure 9:
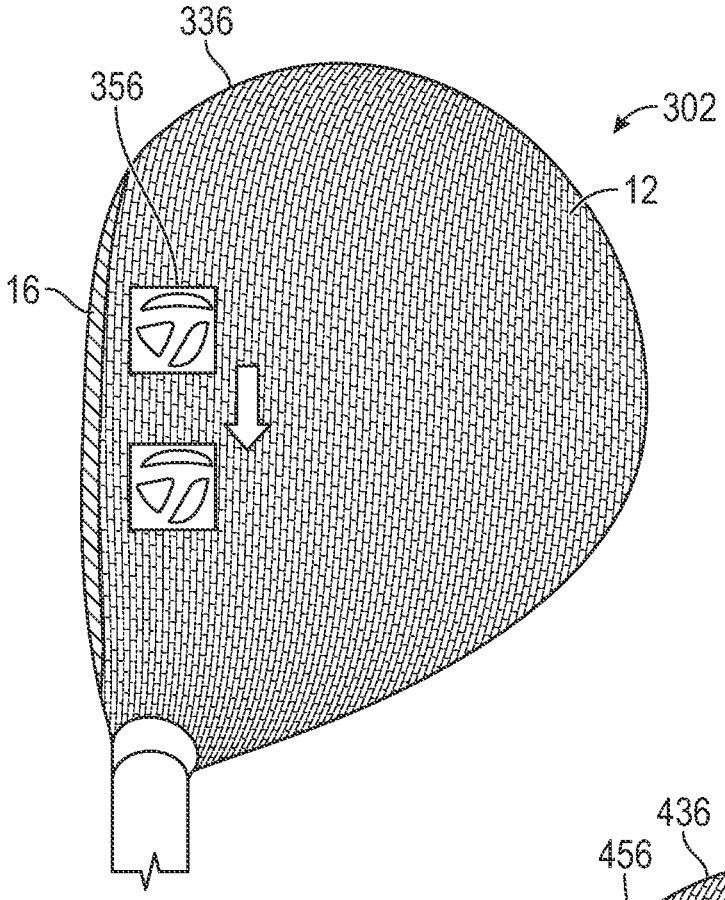
FIG. 9 shows an exemplary golf club head having a variable logo image generated by a crown display, according to one example.

FIG. 9 shows an exemplary golf club head 302 having a variable image logo 356 displayed on the crown 12 by an e-ink display 336. The position of the image logo 356 relative to the face 16 can be adjusted, such as in the heel-toe direction.

Figure 10:
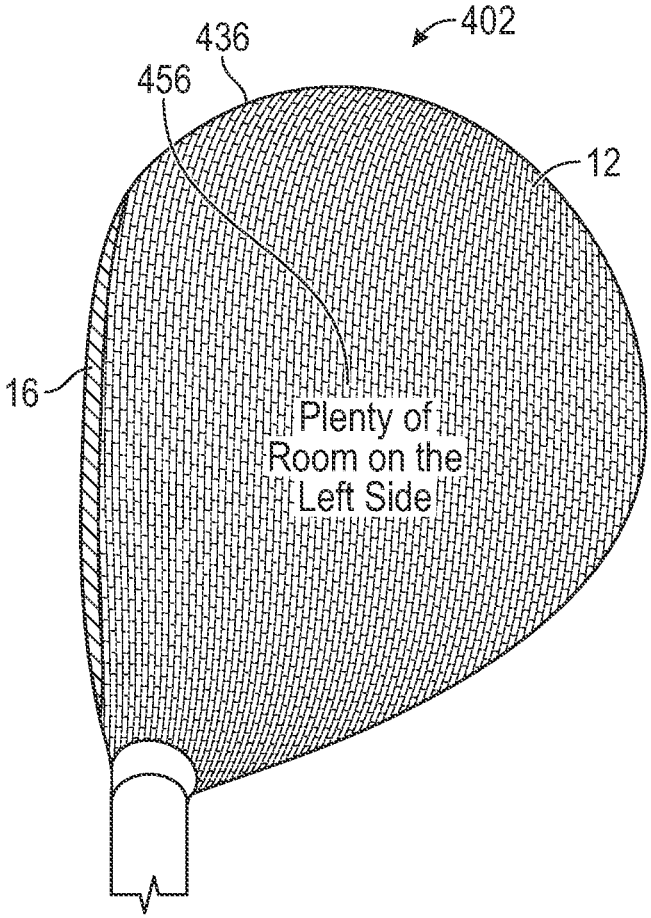
FIG. 10 shows an exemplary golf club head having a crown display, according to one example.

FIG. 10 shows an exemplary golf club head 402 having an e-ink display 436 on the crown 12 that displays various messages 456 that can be helpful to a golfer, such as situational information about the layout of the current hole. Such messages can change from shot to shot.

Figure 11:
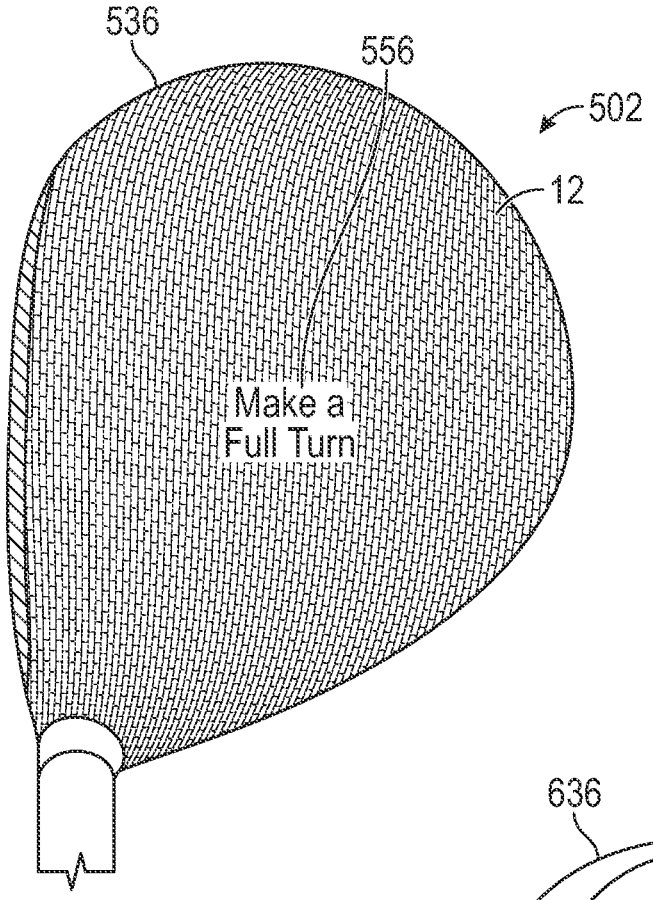
FIG. 11 shows an exemplary golf club head having a crown display, according to another example.

FIG. 11 shows an exemplary golf club head 502 having an e-ink display 536 on the crown 12 that displays swing-thought messages 556 that can be helpful to a golfer, such as to remind the golfer of certain mental cues for making a good golf swing.

Figure 12:
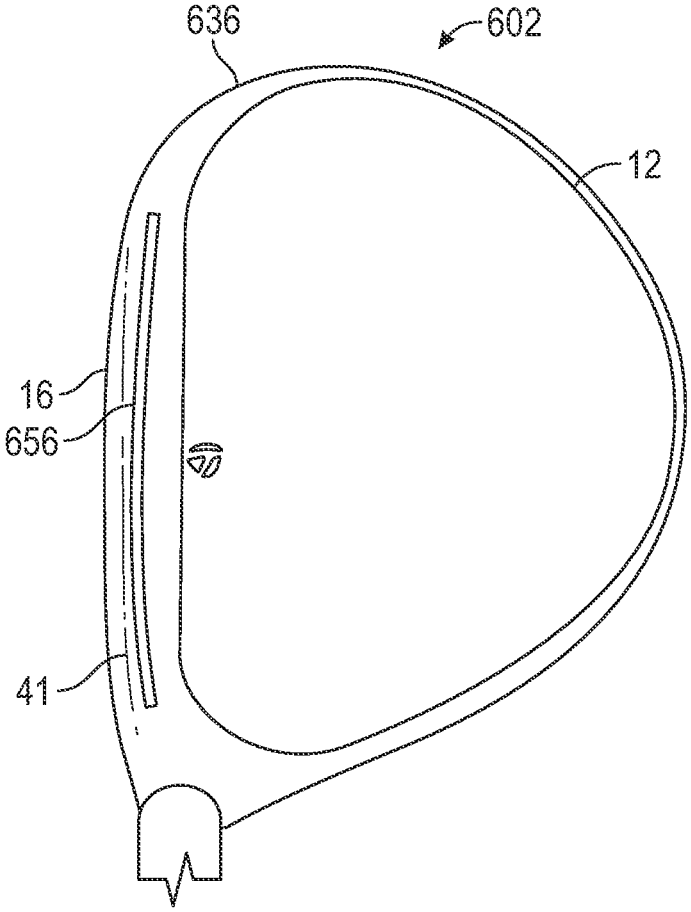
FIG. 12 shows an exemplary golf club head having a crown display that can display a variable topline parallel with a face plane, according to one example.
Figure 13:
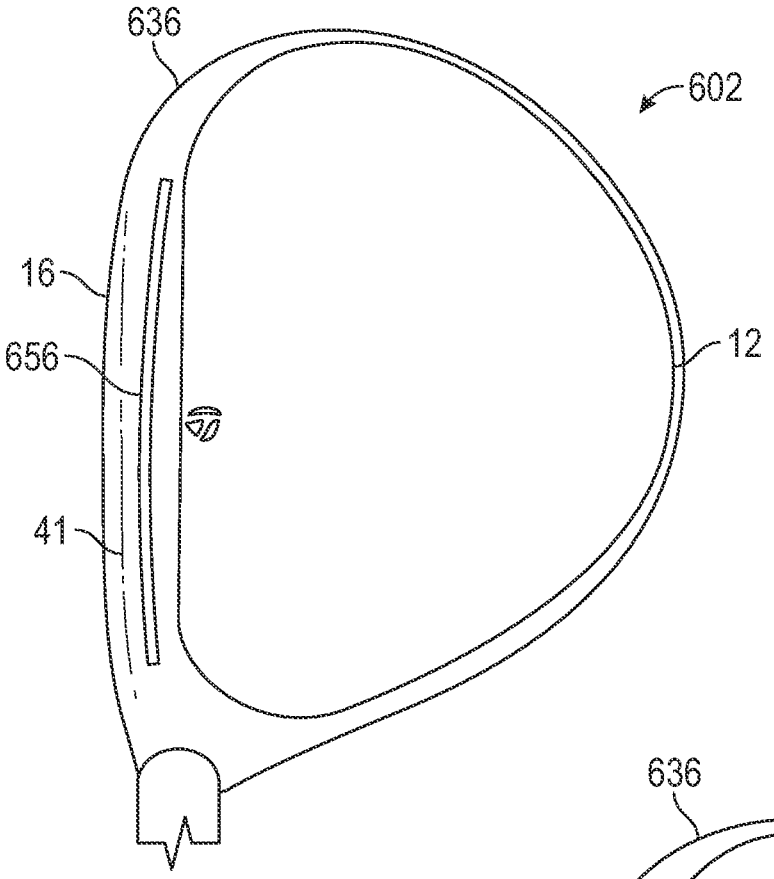
FIG. 13 shows an exemplary golf club head having a crown display that can display a topline more open than a face plane, according to one example.
Figure 14:
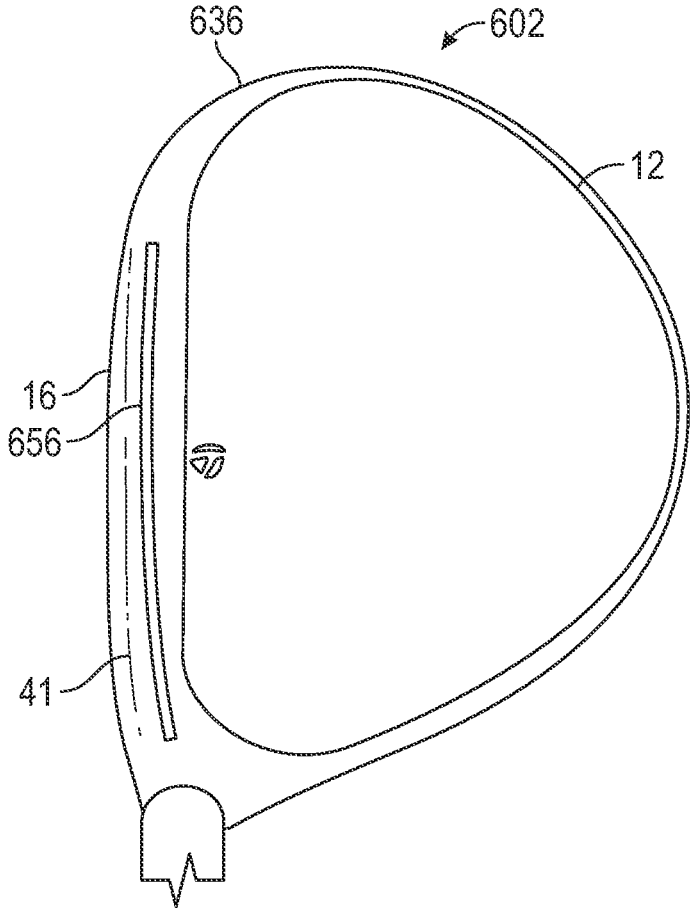
FIG. 14 shows an exemplary golf club head having a crown display that can display a topline is more closed than a face plane, according to one example.

FIGS. 12-14 show an exemplary golf club head 602 having an e-ink display 636 at the front of the crown 12 or crown/face juncture 41 that can display a variable topline 656. In FIG. 12, the displayed topline 656 is generally neutral, parallel with the face plane. In FIG. 13, the displayed topline 656 is more open than the face plane, which can cause a golfer to tend to close the face 16 more. In FIG. 14, the displayed topline 656 is more closed, which can cause a golfer to tend to open the face 16 more. The golfer can select a topline orientation that best suits their personal needs by adjusting the variable topline display.

Figure 15:
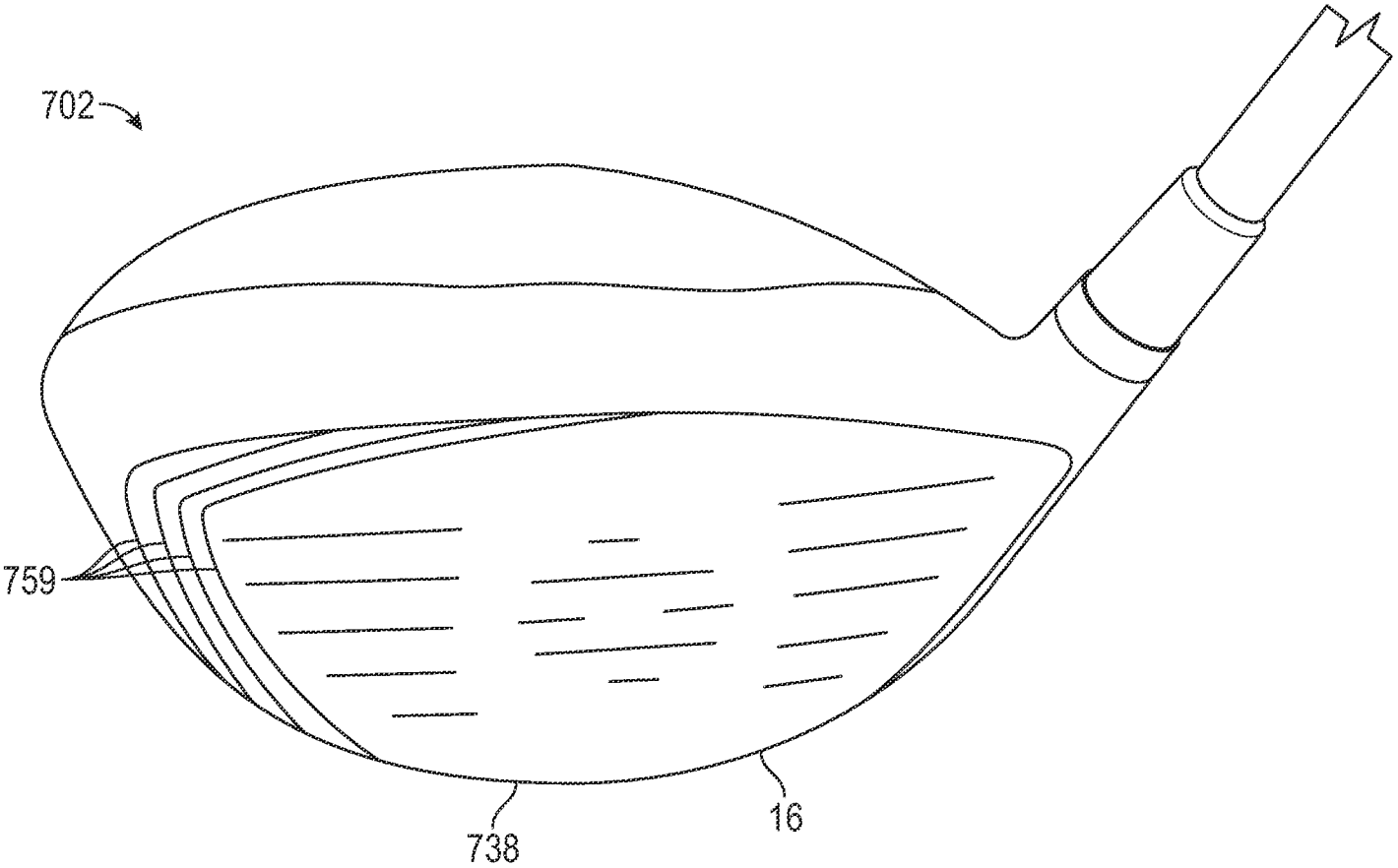
FIG. 15 shows an exemplary golf club head having a display on a face portion of the golf club head, according to one example.

FIG. 15 shows an exemplary golf club head 702 having an e-ink display 738 on the face portion 16 of the club head 702. The various outlines 759 shown in FIG. 15 are meant to be alternative outlines that can be displayed as desired, rather than all at the same time as shown. For example, a user can change the outline 759 of the face 16 and/or the angle of the topline, or other adjacent features, by adjusting the e-ink display 738, making the face 16 appear different to affect the swing.

In some embodiments, the face portion 16 can comprise a structural layer, an e-ink layer over the structural layer, and a transparent protective cover layer over the e-ink layer, so that the e-ink layer is visible through the transparent layer but protected from ball impacts. The transparent layer can also include scorelines and/or other surface texture features. In some such embodiments, an additional piezoelectric layer can be included such as behind the e-ink layer, that can respond to ball impacts by outputting an electric charge that changes the e-ink display locally, such as to show the user where the ball struck the face using the e-ink display.

Example 3: Additional Golf Club Heads with Electronic Displays

Figure 16:
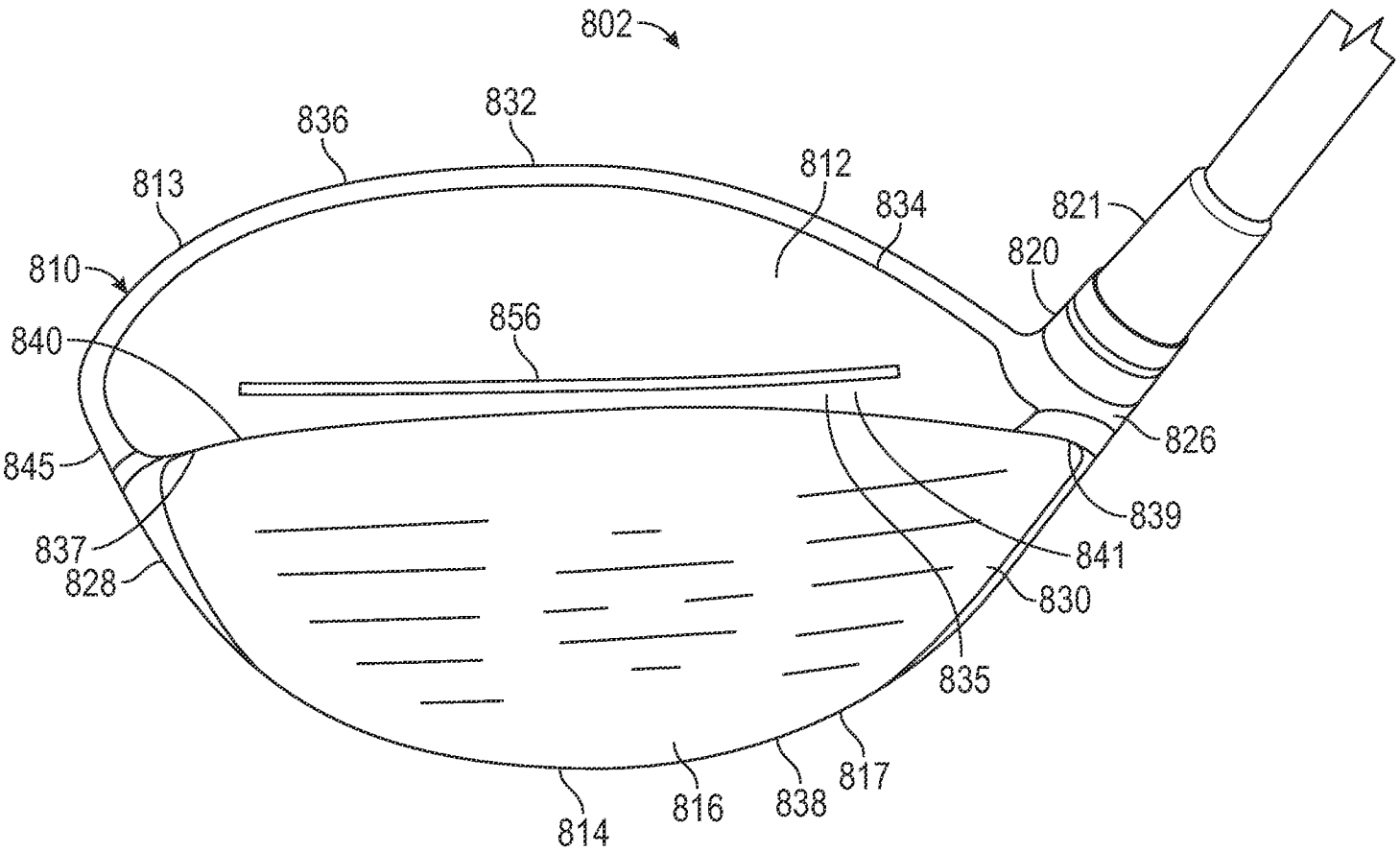
FIG. 16 shows a golf club head with a display, according to another example.

FIG. 16 shows another example golf club head 802 configured to provide a visual cue to the golfer using one or more electronic displays, such as electronic paper displays. Any of the disclosure made with specific reference to e-ink electronic paper displays is applicable to any of the disclosed electronic displays and is not limited to e-ink electronic paper displays. The club head 802 can be a wood-type golf club head comprising a body 810. The body 810 can include a crown 812, a sole 814, and a face 816.

The crown 812 can define a top portion of the club head 802 when the club head 802 is at the normal address position. The crown 812 can comprise a crown insert 813 (which is also referred to herein as a "crown panel"). The crown insert 813 can define at least a portion of a top surface of the club head 802. The crown insert 813 can extend across a portion or the entirety of the crown 812. The crown insert 813 may be formed separately from the body 810 and attached to an opening (FIG. 17) at the top of the body 810 or may be integrally formed as a unitary part of the body 810.

The sole 814 can define a bottom portion of the club head 802 when the club head 802 is at the normal address position. The sole 814 can be configured to rest on the ground plane 19 when the club head 802 is at the normal address position. In some examples, the sole 814 can comprise a sole insert (which is also referred to herein as a "sole panel"). The sole insert may be formed separately from the body 810 and attached to an opening at the bottom of the body 810 or may be integrally formed as a unitary part of the body 810.

The club head 802 may have a non-metallic crown component and/or a non-metallic sole component, which may be separate components joined together, may be formed as a single component, or may be separate components joined in part to an intermediary component such as a ring, as disclosed in U.S. Pat. No. 10,881,917, which is incorporated by reference herein in its entirety. The use of non-metallic crown component encompasses embodiments such as non-metallic crown inserts, but also non-metallic bodies where the non-metallic crown component is that portion of the non-metallic body portion, excluding the face 816, where a normal to the exterior surface of the non-metallic body portion is at least parallel to the ground plane 19 or points upward in the positive z-axis direction. Similarly, the use of non-metallic sole component encompasses embodiments such as non-metallic sole inserts, but also non-metallic bodies where the non-metallic sole component is that portion of the non-metallic body portion, excluding the face, where a normal to the exterior surface of the non-metallic body portion is at least parallel to the ground plane 19 or points downward in the negative z-axis direction.

The face 816 can define a front portion of the club head 802 when the club head 802 is at the normal address position. The face 816 can comprise a face insert 817 (which is also referred to herein as a "face panel," a "face plate," a "strike insert," or a "strike plate") comprising an inner surface facing the body 810 and an outer surface opposite the inner surface. The face insert 817 can extend across a portion or the entirety of the face 816. The face insert 817 may be formed separately from the body 810 and attached to an opening (FIG. 17) at the front of the body 810 or may be integrally formed as a unitary part of the body 810.

The body 810 can further include a hosel 820, which in some examples can be similar to the hosel 20 illustrated in FIGS. 1-6. In some examples, the hosel 820 can be configured to receive a flight control technology (FCT) system insert 821. The FCT system insert 821 can provide for adjustment of the lie 22 and/or the loft 15 of the club head 802 (see FIGS. 1 and 2). FCT system inserts 821 are described in more detail in U.S. Pat. Nos. 8,025,587, 8,235,831, 8,337,319, 8,758,153, 8,398,503, 8,876,622, 8,496,541, and 9,033,821, each of which is incorporated herein by reference in its entirety.

The body 810 may further include a heel portion 826, a toe portion 828, a front portion 830, a rear portion 832, and a top portion 834. The body 810 may further include a face-to-crown transition zone 841 (which is also referred to herein as a "face-to-crown transition region" or a "face-to-crown transition"). The face-to-crown transition zone 841 can extend in the heel-toe direction and can include a curved portion of the club head 802 where the face 816 transitions to the crown 812. The face-to-crown transition zone 841 can include a topline 835 where the face 816 meets the crown 812. In certain examples, the topline 835 can extend along the apex or forwardmost edge of the curved face-to-crown transition zone 841. Traditionally, the golf club head topline is painted in an imprecise manner to draw attention to the topline and help the golfer with alignment, and thus the topline may be used as an alignment feature. To paint an alignment feature on a golf club head, workers manufacturing the golf club head typically apply masking stickers that provide for a guide in painting the alignment feature. However, masking stickers and other guides are not easily affixed or aligned on the golf club head consistently. Because the location of the masking stickers ultimately determines the alignment feature shape and angle, the current manufacturing methods lead to variability between golf club heads manufactured to the same specifications, and consequently, variability in the performance of the product. It is often beneficial to not draw attention to the actual topline, but rather emphasize a topline alignment feature that doesn't precisely track the literal topline but rather is a simulated topline, aka a topline alignment feature, that a golfer may, or may not, realize is not the actual topline but it is there to aid the golfer in alignment. As used throughout and with reference to the figures, references to the topline 835 mean a simulated topline or a topline alignment feature, not the literal topline (also referred to as the "true topline") unless stated otherwise or illustrated truly where the face 816 meets the crown 812. In some implementations, the topline alignment feature may be provided as a parabola defined relative to the striking face. For example, a point on parabola relative to the striking face is provided from about 2 to about 4 degrees open or closed relative to the angle of the striking face. Depending on the golf club, the radius of the topline alignment feature may affect lateral dispersion in a resultant shot by a set amount. For example, changing the radius of the parabola defining the topline alignment feature of a driver by one degree may reduce dispersion by approximately five yards. In another example, changing the radius of the parabola defining the topline alignment feature of a fairway wood by one degree may reduce dispersion by approximately three yards. Providing a topline alignment feature that changes the perceived face angle of the golf club head 802 may correct for lateral dispersion caused by other characteristics of the golf club.

In some embodiments, the face-to-crown transition zone 841 may be painted the same color as other portions of the club head body 810, eliminating the need to use a masking line between the face-to-crown transition zone 841 and other portions of the club head body 810. After painting the club head body 810, the face 816 may be bonded or otherwise attached to the body 810. A contrast in color, difference in finishes, and/or difference in texture between the club head body 810 and the face 816 defines the visual cue, or topline alignment feature. For example, the face insert 817 may be a single color, or multicolored. Likewise, the club head body 810 and/or the crown 812 may also be a single color, or multicolored, providing for one or more alignment features by contrasting with the one or more colors of the face insert 817. In another example, the club head body 810 and/or the crown 812 may have one finish, such as gloss, and the face insert 817 may be a different finish, such as matte. In yet another example, the club head body 810 and/or the crown 812 may have one texture, such a visible composite weave, and the face insert 817 may be a different texture, such as a texture that appears uniform or smooth. Additionally or alternatively, the crown insert 813 may be bonded or otherwise attached to the club head body 810 to provide for a visual cue. Accordingly, a topline alignment feature may not be subject to the manufacturing variability resulting from user error and the manufactured golf club heads may be more consistent from part to part. Thus, utilizing a display to present a topline alignment feature offers numerous benefits including, but not limited to, easily changing the location, length, width, curvature, shape, and/or contrast of the topline alignment feature and thus the Sight Adjusted Perceived Face Angle (SAPFA) of the golf club head 802, as disclosed in detail in U.S. patent application Ser. No. 18/082,735, which is incorporated herein by reference in its entirety.

The body 810 may include a skirt 843 (FIG. 17) (which is also referred to herein as a "skirt portion") disposed around a periphery of the club head 802 between the crown 812 and the sole 814. The body 810 may further include a crown-to-skirt transition zone 845 (which is also referred to herein as a "crown-to-skirt region" or a "crown-to-skirt transition") where the crown 812 transitions to the skirt 843.

In some examples, the club head 802 can further comprise one or more weight members coupled to the body 810. In some examples, the weight members can be detached from the body 810 or moved within the body 810 to adjust the mass distribution and inertial properties of the club head 802. Examples of weight members that can be used in combination with the club heads and electronic displays disclosed herein are described in U.S. application Ser. No. 18/068,347, which is incorporated herein by reference in its entirety.

Materials which may be used to construct the body 810, including portions of the crown 812, which may include a crown insert 813, portions of the sole 814, which may include a sole insert, and portions of the face 816, which may include a face insert 817, can include composite materials (e.g., carbon fiber reinforced polymeric materials), titanium or titanium alloys, aluminum alloys, steels or alloys of steel, magnesium alloys, copper alloys, nickel alloys, and/or any other metals or metal alloys suitable for golf club head construction. Other materials, such as paint, polymeric materials, ceramic materials, etc., can also be included in the various components of the club head 802. In some embodiments, the various components of the club head 802 can be made of a metallic material such as titanium or titanium alloys (including but not limited to 9-1-1 titanium, 6-4 titanium, 3-2.5, 6-4, SP700, 15-3-3-3, 10-2-3, or other alpha/near alpha, alpha-beta, and beta/near beta titanium alloys), or aluminum and aluminum alloys (including but not limited to 3000 series alloys, 5000 series alloys, 6000 series alloys, such as 6061-T6, and 7000 series alloys, such as 7075), Ti Grade 9 (Ti-3Al-2.5V) having a chemical composition of ≤3.5-2.5% Al; ≤3.0-2.0% V; ≤0.02% N; ≤0.013% H; ≤0.12 Fe.

In some examples, the body 810, the crown and/or crown insert 813, the sole and/or sole insert, and the face and/or face insert 817 can comprise the same material. In some examples, at least one of the crown and/or crown insert 813, the sole and/or sole insert, and the face and/or face insert 817 can comprise a different material with a different density than the material forming the body 810 to better distribute the weight of the club head 802.

The club head 802 can comprise at least one electronic display configured to provide a visual cue to the golfer, such as the disclosed topline alignment features and/or the primary and/or secondary alignment features disclosed in U.S. patent application Ser. No. 18/082,735, which is incorporated herein by reference in its entirety. The at least one electronic display may be coupled to an electronic assembly 850 (FIG. 17) and/or may be part of the electronic assembly 850. The example club head 802 illustrated in FIG. 16 comprises two electronic displays: a crown display 836 (also referred to as a "first display") and a face display 838 (also referred to as a "second display"). However, other examples of the club head 802 can comprise one, two, three, four, or any number of electronic displays. For example, electronic displays can be disposed on any combination of the sole portion 814, the heel portion 826, the toe portion 828, the rear portion 832, the face-to-crown transition zone 841, the crown-to-skirt transition zone 845, and/or the hosel 820 of the club head 802, or a golf club shaft and/or a golf club grip coupled to the club head 802, golf bag, or head cover.

The crown display 836 can be an electronic display configured to provide a visual cue to the golfer while the club head 802 is at the normal address position. The crown display 836 can be coupled to the crown 812, the crown insert 813, or the top portion 834 of the body 810 (e.g., at the crown-to-skirt transition 845 of the club head 802). The crown display 836 may extend in the heel-toe direction partway or entirely across the crown 812 and/or the crown insert 813 between the heel portion 826 and the toe portion 828. The crown display 836 may extend in the front-rear direction partway or entirely across the crown 812 from, for example, the face-to-crown transition zone 841 to the rear portion 832. In some examples, the crown display 836 can wrap from the face 816 onto the crown 812 in the face-to-crown transition zone 841. Stated differently, the crown display 836 can extend past a front-most edge portion of the crown insert 813 and/or of the crown 812 to cover all or a portion of the topline 835 and/or of the face-to-crown transition zone.

The crown display 836 may be centered on the crown 812 or the crown insert 813 or may be offset towards either the heel portion 826 or the toe portion 828 of the club head 802. The surface area of the crown display 836 relative to the surface area of the crown insert 813 can have any ratio, such as from 10% to 100%, 10% to 90%, 25% to 100%, 50% to 100%, 20% to 80%, 30% to 70%, at least 25%, at least 40% or at least 50%. In some examples, the surface area of the crown display 836 and the surface area of crown insert 813 can be such that the crown display 836 covers the entirety of the crown insert 813. In some examples, the surface area of the crown display 836 can be greater than the surface area of crown insert 813 such that the crown display 836 covers additional portions of the club head 802, such as a portion or an entirety of the face-to-crown transition zone 841 (e.g., including the topline 835) and/or the crown-to-skirt transition zone 845.

The crown display 836 may be formed separately from the crown insert 813 or may be integrally formed with the crown insert 813. In some examples, the crown display 836 can be removed or detached from the crown insert 813. In some examples where the crown insert 813 is a composite panel comprising a plurality of layers, the crown display 836 can be integrally formed as a layer (e.g., an electronic paper display layer) of the composite crown insert 813. The crown display 836 can comprise a front edge portion 837 defining a forward-most or front-most edge of the crown display 836. In FIG. 16 the front edge portion 837 is shown positioned along the interface between the crown and the face of the club head 802, but in other examples the front edge portion 837 of the crown display 836 can be positioned on the face 816 and the crown display 836 can wrap from the face 816 onto the crown 812 as noted above.

Figure 23:
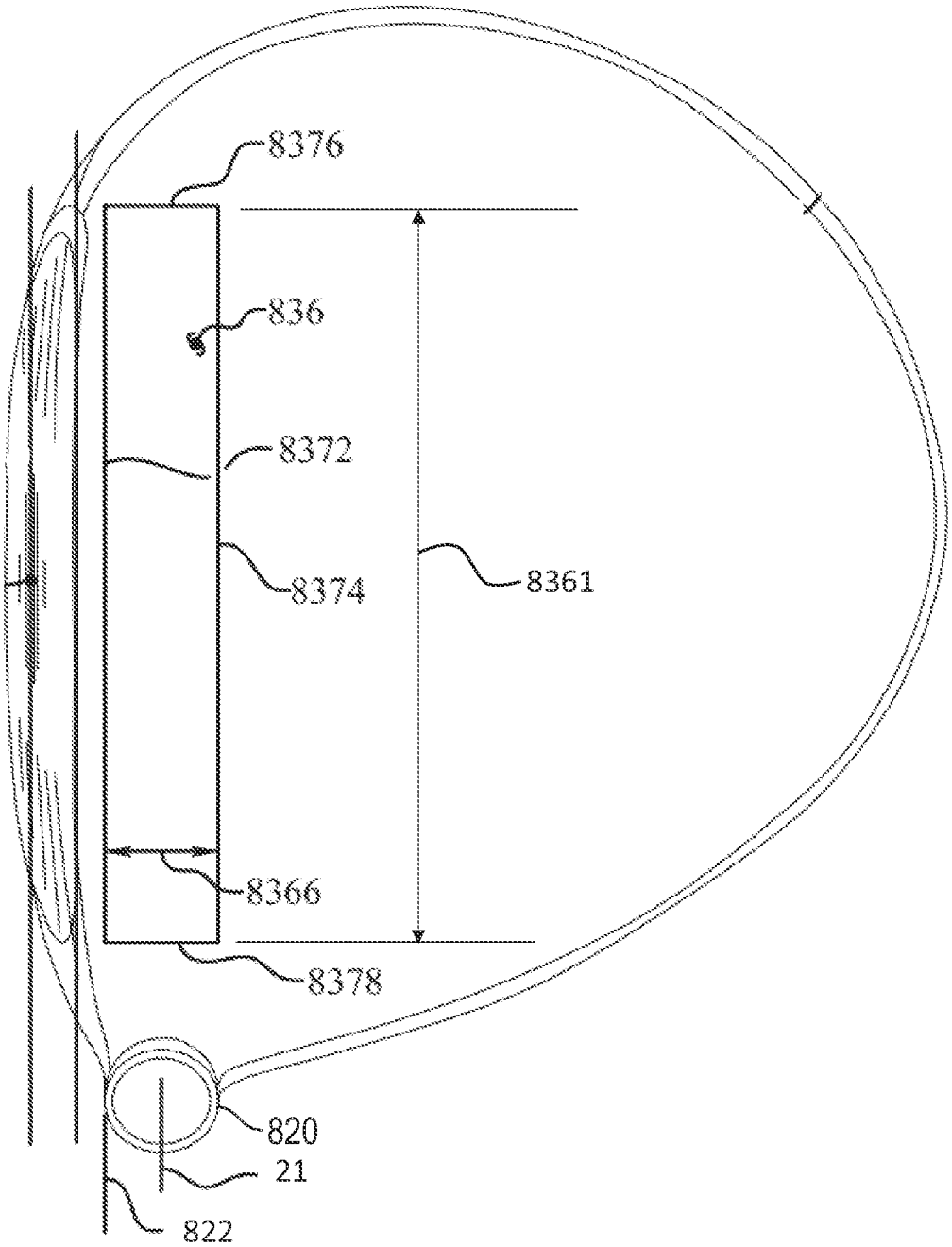
FIG. 23 shows a golf club head with a display, according to another example.

In FIG. 23 at least a portion of a front edge 8372 extends forward of a vertical plane containing the hosel axis 21. In a further embodiment at least a portion of the front edge 8372 extends forward of a vertical forward hosel plane 822, which is a vertical plane containing a forwardmost point on the constant diameter portion of the external surface of the hosel 820, and the vertical forward hosel plane 822 is parallel to a vertical plane containing the hosel axis 21.

Figure 26A:
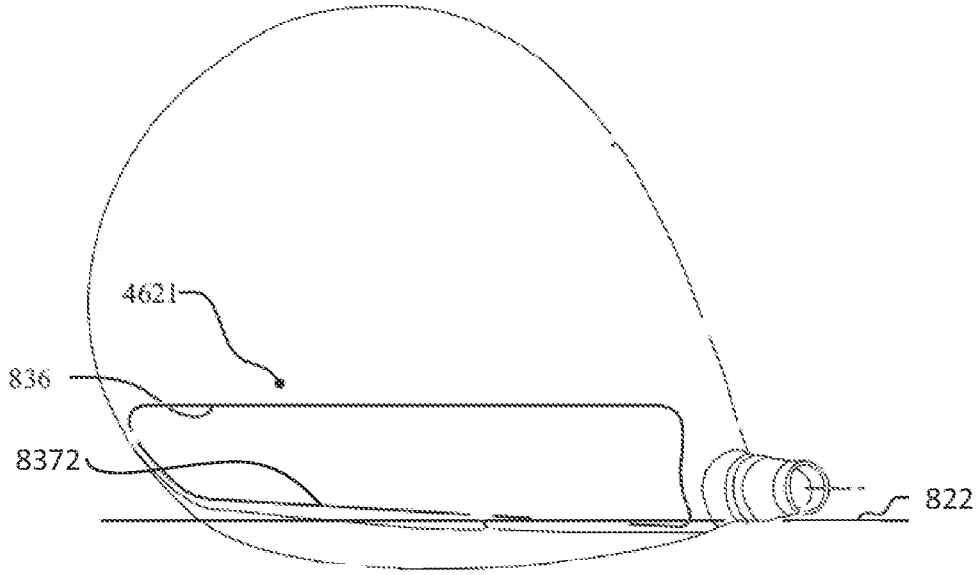
FIGS. 26A-26B show a golf club head with a display, according to another example.

As seen in FIG. 26A, in one embodiment a portion of the front edge 8372 extends forward of a vertical forward hosel plane 822, while a portion of the front edge 8372 does not extend forward of the vertical forward hosel plane 822.

Figure 26B:
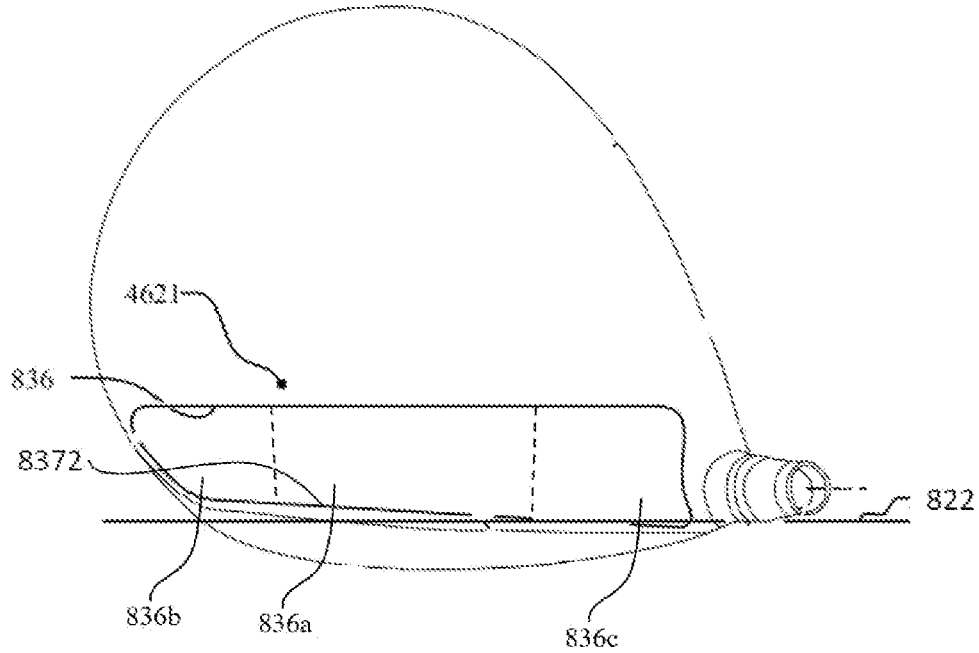

As seen in FIG. 26B, the club head 802 can comprise a plurality of crown displays 836*a*, 836*b*, 836*c*. The plurality of crown displays 836*a*, 836*b*, 836*c* may be overlapping. In certain embodiments, the use of multiple displays 836*a*, 836*b*, 836*c* instead of a single crown display (such as crown display 836) may help accommodate a varying curvature of the crown 812. As illustrated, the club head 802 can comprise three crown displays 836*a*, 836*b*, and 836*c*, which form a continuous or substantially continuous display.

Figure 24:
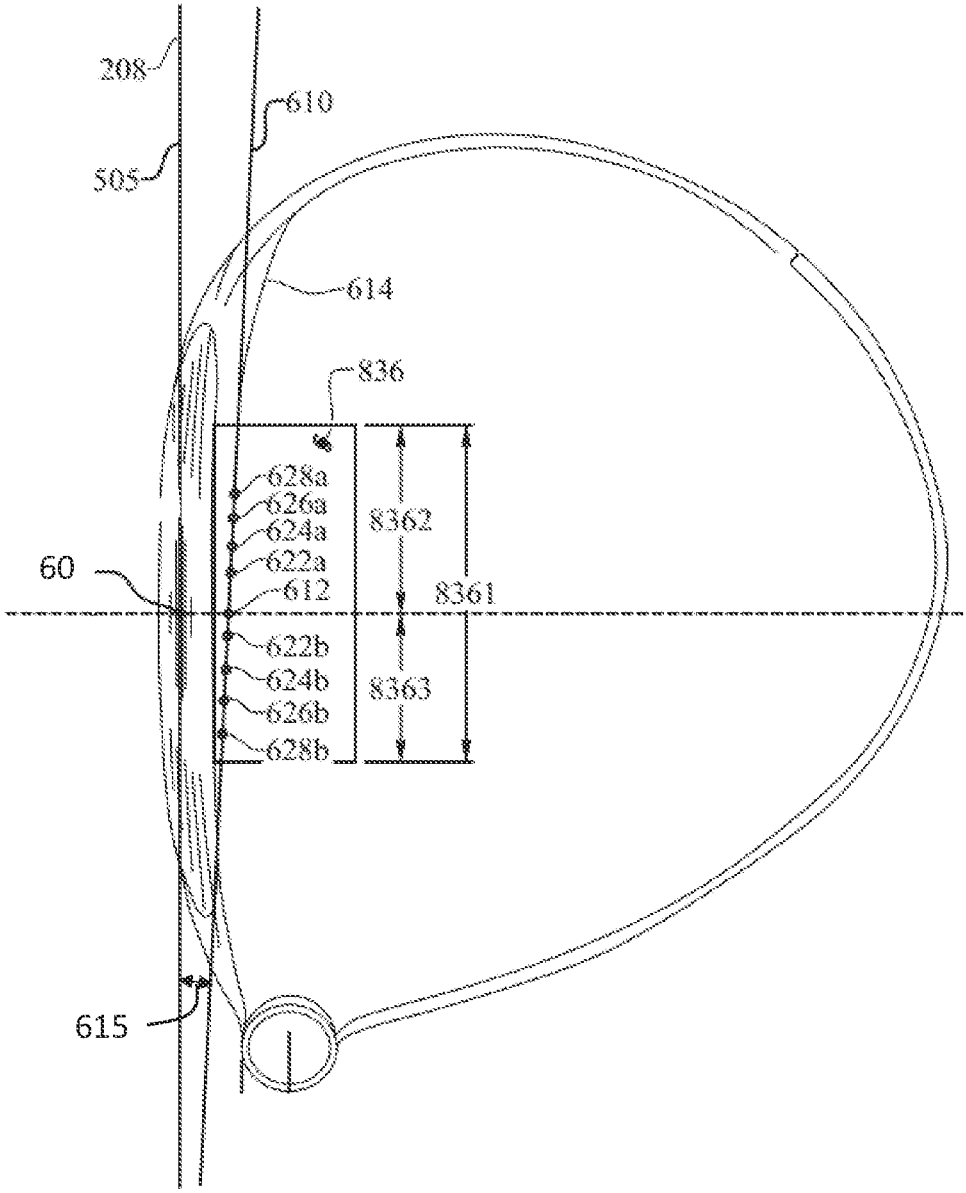
FIG. 24 shows a golf club head with a display, according to another example.

With continued reference to FIGS. 23 and 24, the crown display 836 has a rear edge 8374, a heel edge 8378, a toe edge 8376, a display length 8366 measured from the front edge 8372 to the rear edge 8374 in the direction of the head origin y-axis 75, and a display width 8361 measured from the heel edge 8378 to the toe edge 8376 in the direction of the head origin x-axis 70. In the illustrated embodiment the display length 8366 is constant from the heel edge 8378 to the toe edge 8376, however in another embodiment the display length 8366 varies from the heel edge 8378 to the toe edge 8376. Therefore, references to the display length 8366 and/or display width 8361 refer to the maximum length or width, unless noted otherwise. In one embodiment the display width 8361 is at least N times the display length 8366, where N is 2 in one embodiment, and in further embodiments N is 3, 4, 5, or 6. In a further series of embodiments the display width 8361 is no more than P times the display length 8366, where P is 20 in one embodiment, and in further embodiments P is 18, 16, 14, 12, 10, or 8. In an alternative embodiment the display width 8361 is less than the display length 8366, and in a further embodiment the display length 8366 is at least Q times the display width

8361 where Q is 1.5, 1.75, 2.0, 2.25, 2.5, 2.75, or 3.0. In yet another further embodiment the display length 8366 is no more than R times the display width 8361 where R is 10, 8, 6, or 4. In one embodiment at least one of the display length 8366 and/or display width 8361 is at least 60 mm, and in further embodiments at least 70 mm, 80 mm, 90 mm, or 100 mm.

The display width 8361 may be broken down into a heel portion display width 8363 and a toe portion display width 8362, measured from the origin y-axis. In one embodiment the crown display 836 is located such that the toe portion display width 8362 is greater than the heel portion display width 8363, in a further embodiment the toe portion display width 8362 is at least 5%, 10%, or 15% greater than the heel portion display width 8363. However, in another embodiment the toe portion display width 8362 is no more than 75%, 65%, 55%, or 45% greater than the heel portion display width 8363. In another embodiment the toe portion display width 8362 and/or the heel portion display width 8363 is greater than the display length 8366.

In one embodiment the display length 8366 varies from a minimum display length 8366 to a maximum display length 8366, and a ratio of the maximum display length to the minimum display length is at least 1.25, and in further embodiments at least 1.5, 1.75, 2.0, 2.25, or 2.5. In a further embodiment the minimum display length occurs between the head origin 60 and the heel edge 8378, while in a further embodiment the maximum display length occurs between the head origin 60 and the toe edge 8376.

In a further embodiment the display length 8366 is less than a CFY distance, which is a center-face y-axis location defined as the distance CFY measured in the y-axis direction from the center-face location to a vertical hosel axis plane containing the hosel axis 21. In a further embodiment the display length 8366 is less than a face progression (FP), defined as the y-axis distance between a leading-edge of face and a vertical hosel axis plane containing the hosel axis 21. Face progression is related to face location, loft and face height. CFY, face progression, and alignment features all influence performance of a golf club head, such as lateral dispersion. For example, if the CFY and/or face progression of the golf club head is changed, one or more alignment features may be provided to counteract the lateral dispersion created or reduced by the CFY and/or face progression.

In one embodiment the front edge 8372 is curved and has a radius of curvature, measured in the x-y plane, that is within plus, or minus, 25% of the bulge radius of curvature of the face 816, and in further embodiments ±20%, ±15%, ±10%, or ±5%. In a further embodiment the radius of curvature of the front edge 8372 is at least 200 mm, and in further embodiments at least 225 mm, 250 mm, 275 mm, or 300 mm. In a further series of embodiments the radius of curvature of the front edge 8372 is no more than 600 mm, 550 mm, 500 mm, 450 mm, or 400 mm.

In one embodiment the rear edge 8374 is curved and has a radius of curvature, measured in the x-y plane, that is within plus, or minus, 25% of the bulge radius of curvature of the face 816, and in further embodiments ±20%, ±15%, ±10%, or ±5%. In a further embodiment the radius of curvature of the rear edge 8374 is at least 200 mm, and in further embodiments at least 225 mm, 250 mm, 275 mm, or 300 mm. In a further series of embodiments the radius of curvature of the rear edge 8374 is no more than 600 mm, 550 mm, 500 mm, 450 mm, or 400 mm. In one embodiment the rear edge 8374 is concave toward the front edge 8372, and in another embodiment the front edge 8372 is concave toward the rear edge 8374. In another embodiment at least one of the heel edge 8378 and the toe edge 8376 are concave toward the hosel 820.

Figure 27:
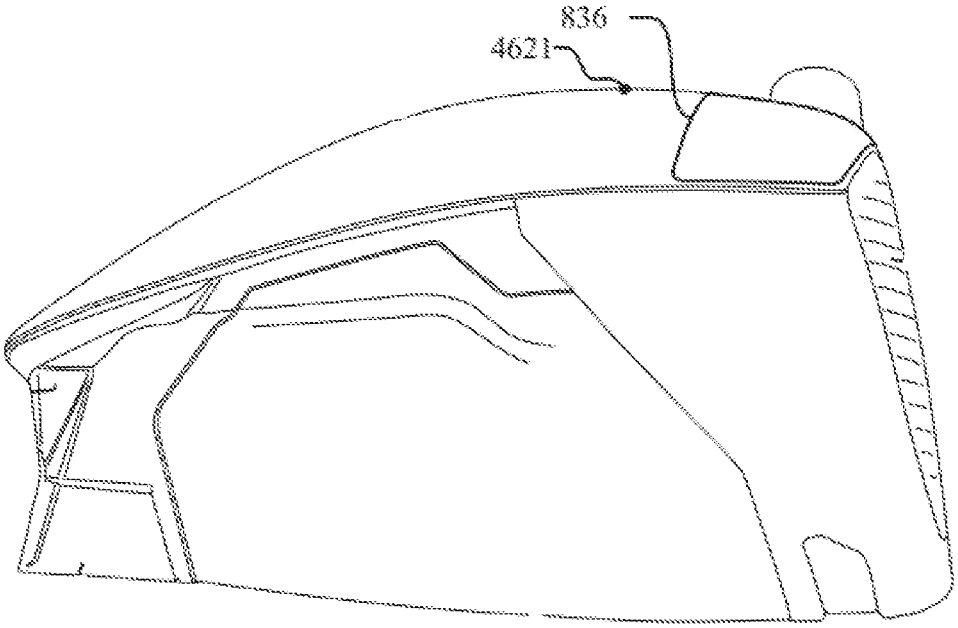
FIG. 27 shows a toe-side elevation view of a golf club head with a display, according to another example.

The crown 812 has a crown apex 4621, as seen in FIGS. 26A-27, as understood by one skilled in the art, and as disclosed in U.S. patent application Ser. No. 17/360,179, which is incorporated herein by reference in its entirety. In one embodiment the entire crown display 836 is located in front of the crown apex 4621, meaning in front of a vertical heel-toe plane containing the crown apex 4621. However, in another embodiment the crown apex 4621 occurs on the crown display 836. In another embodiment a portion of the crown display 836 has a heel-to-toe radius of curvature (Rh-t), as defined in U.S. patent application Ser. No. 17/360,179, that is less than 7.0 inches, while in further embodiments at least a portion of the crown display 836 has a heel-to-toe radius of curvature (Rh-t) that is less than 6.5", 6.0", 5.5", 5.0", 4.75", 4.5", 4.25", 4.0", or 3.75". In embodiments where the crown apex 4621 occurs on the crown display 836, a portion of the crown display 836 has an apex-to-rear radius of curvature (Ra-r) that is at least 5", and in further embodiment at least 6", 7", 8", 9", 10", or 11". However, in another series of embodiments the apex-to-rear radius of curvature (Ra-r) is no more than 25", and in further embodiments no more than 23", 21", 19", 17", 15", or 13". In embodiment where the crown apex 4621 occurs on the crown display 836, a portion of the crown display 836 has an apex-to-front radius of curvature (Ra-f) that is less than 4", and in further embodiments less than 3.75", 3.5", 3.25", or 3.0". Whether the crown apex 4621 occurs on the crown display 836 or not, a first portion of the crown display 836 has a front-to-rear radius of curvature (Rf-r), measured in a vertical front-to-rear plane that is perpendicular to the vertical plane containing the hosel axis 21, and the front-to-rear radius of curvature (Rf-r) that is at least 5", and in further embodiment at least 6", 7", 8", 9", 10", or 11". In another embodiment a second portion of the crown display 836 has a front-to-rear radius of curvature (Rf-r) that is less than 4.5", and in further embodiments less than 4.25", 4.0", 3.75" or 3.5". In one such embodiment the second portion is located between the first portion and the face. As noted, the front-to-rear radius of curvature (Rf-r) is measured in a vertical front-to-rear plane passing through the crown display 836 and perpendicular to the vertical plane containing the hosel axis 21. In one embodiment the front-to-rear radius of curvature (Rf-r) of the crown display 836 is analyzed in two such vertical front-to-rear planes, namely a first vertical front-to-rear plane and a second vertical front-to-rear plane, which by definition are parallel to each other and separated by a distance of 5 mm along the origin x-axis direction. Now, the front-to-rear radius of curvature (Rf-r) is analyzed in the first vertical front-to-rear plane and the second vertical front-to-rear plane, but within a specific analysis region along the origin y-axis direction. For instance in one embodiment a first X-Z vertical plane is located at the forwardmost point on the crown display 836, and a second X-Z vertical plane offset a mm toward the rear of the club head from the first X-Z vertical plane, where a may be 5 mm, 10 mm, 15 mm, or 20 mm. The front-to-rear radius of curvature (Rf-r) within any vertical front to rear plane is easily identified by using a best fit curve based upon points separated by 1 mm along the exterior surface of the crown display 836 starting at the first X-Z vertical plane and ending at the second X-Z vertical plane. In one embodiment a first front-to-rear radius of curvature (Rf-r) in the first vertical front-to-rear plane within the analysis region is not equal to the second front-to-rear radius of curvature (Rf-r) in the second vertical front-to-rear plane within the analysis region, and in a further embodiment the second front-to-rear radius of curvature (Rf-r) varies from the first front-to-rear radius of curvature (Rf-r) by at least 5%, and in still additional embodiments by at least 10%, 15%, or 20%. In another embodiment the second front-to-rear radius of curvature (Rf-r) varies from the first front-to-rear radius of curvature (Rf-r) by no more than 50%, and in further embodiments no more than 45%, 40%, 35%, or 30%. In another embodiment any of these same relationships is true in a third vertical front-to-rear plane separated from the second vertical front-to-rear plane by 5 mm, and in a further embodiment for a fourth vertical front-to-rear plane separated from third second vertical front-to-rear plane by 5 mm, and in additional embodiments for fifth through twentieth vertical front-to-rear planes. Additionally, in one embodiment the analysis region begins at the front edge 8372 of crown display 836 and extends rearward, while in another embodiment the analysis region begins at the rear edge 8374 of crown display 836 and extends forward, however the analysis region may be located anywhere between the front edge 8372 and the rear edge 8374. However, in another series of embodiments the front-to-rear radius of curvature (Rf-r) is no more than 25", and in further embodiments no more than 23", 21", 19", 17", 15", or 13". Whether the crown apex occurs on the crown display 836 or not, in another embodiment the entire crown display 836 has a front-to-rear radius of curvature (Rf-r) that is at least 5", and in further embodiment at least 6", 7", 8", 9", 10", or 11". However, in another series of embodiments the front-to-rear radius of curvature (Rf-r) is no more than 25", and in further embodiments no more than 23", 21", 19", 17", 15", or 13".

Thus, in one embodiment the crown display 836 has a curvature that is not constant in the front-to-rear direction when traversing the crown display 836 from the toe edge 8376 to the heel edge 8378, and/or is not constant in the heel-to-direction when traversing the crown display 836 from the front edge 8372 to the rear edge 8374. Another way to describe the complex curvature of the crown display 836 is with respect to the elevation of certain locations of the crown display 836 with respect to the ground plane; thus it is easy to think of each point on the crown display 836 having its own Zup dimension, referred to as a crown point Zup-cp. Regardless of the shape, the crown display 836 has a display perimeter, and in one embodiment at least X perimeter points on the display perimeter have unequal Zup-cp values, where the perimeter points are located 5 mm from one another along the display perimeter, and where X is a value between 2 and 50. In a further embodiment one of the perimeter points has a maximum perimeter Zup-cp value, and another point on the crown display perimeter has a minimum perimeter Zup-cp value, wherein the maximum perimeter Zup-cp value is at least 10% greater than the minimum perimeter Zup-cp value, and in further embodiments at least 15%, 20%, 25%, and 30%. In a further embodiment the maximum perimeter Zup-cp value is no more than 150% greater than the minimum perimeter Zup-cp value, and in further embodiments no more than 140%, 130%, 120%, 110%, or 100%. The highest point of the crown display above the ground plane is the crown display apex, which has a display apex Zup-ca dimension, which in one embodiment is at least 5% greater than every perimeter Zup-cp value, and in further embodiments at least 7.5%, 10%, 12.5%, or 15%. In another embodiment the display apex Zup-ca dimension is no more than 250% greater than the minimum perimeter Zup-cp value, and in further embodiments no more than 240%, 230%, 220%, 210%, or 200%. In a particularly complexly shaped embodiment the exterior surface of the crown display 836 has both a concavely inward curved portion and a concavely outward curved portion.

In one embodiment the striking face has a center face roll contour, a toe side roll contour, a heel side roll contour, a center face bulge contour, a crown side bulge contour, and a sole side bulge contour, as disclosed in U.S. patent application Ser. Nos. 15/811,430, 15/811,430, 17/476,025, 16/036,696, 16/035,929, 16/034,307, 16/037,947, 16/038,005, 16/160,884, 16/750,599, 17/105,234, which are all incorporated herein by reference in their entirety, and all of the disclosed relationships with respect to bulge contours, roll contours, loft, FA° Δ, LA° Δ, degree of twist, bulge radius, and roll radius with respect to the face are equally applicable to the present face display 838.

Further, the front edge 8372 of crown display 836 is located an offset distance below the crown apex 4621, whether the crown apex 4621 is a portion of the crown display 836, or not. Thus, all of the disclosure and embodiments contained in U.S. patent application Ser. No. 18/082,735, which is incorporated herein by reference in its entirety, and relating to the crown leading edge apex-offset distance is equally applicable to a crown display leading edge apex-offset distance.

The face display 838 can comprise an electronic display coupled to the face insert 817 or otherwise disposed on the face 816 of the club head 802. In some examples, the face display 838 may not be visible to the user when the club head 802 is at the normal address position because the face 816 is not oriented towards the golfer at address. Thus, in such examples, the face display 838 can be configured to provide a visual cue to the golfer when the club head 802 is not at the normal address position. The face display 838 may extend across a portion of the face 816 or face insert 817 or may extend across the entire face 816 or face insert 817. The face display 838 may extend in the heel-toe direction partway or entirely across the face 816 and/or the face insert 817 between the heel portion 826 and the toe portion 828. The face display 838 may extend in the top-bottom direction partway or entirely across the face 816 and/or the face insert 817 between the face-to-crown transition zone 841 and the bottom portion of the club head 102 (e.g., a face-to-sole transition zone). In some examples, the face display 838 can extend past a top-most edge portion of the face insert 817 to cover all or a portion of the face-to-crown transition zone 841 (e.g., including the topline 835). The face display 838 may be sized and located to display any of the face secondary alignment features disclosed in U.S. patent application Ser. No. 18/082,735, which is incorporated herein by reference in its entirety.

The surface area of the face display 838 relative to the surface area of the face insert 817 can have any ratio, such as from 10% to 100%, 10% to 90%, 25% to 100%, 50% to 100%, 20% to 80%, 30% to 70%, at least 25%, at least 40% or at least 50%, etc. Where the face is an integral part of the club head and not a face insert, the face display surface area and the face surface area can have the same ratios as given above. In some examples, the surface area of the face display 838 and the surface area of the face insert 817 can be equal or approximately equal (e.g., ±10%) such that the face display 838 covers the entirety of the face insert 817 or a portion of the face insert. In some examples, the surface area of the face display 838 can be greater than the surface area of face insert 817 such that the face display 838 can cover additional portions of the club head 102, such as a portion or an entirety of the face-to-crown transition zone 841, the topline 835, etc. In certain examples the face display 838 can also wrap from the face onto the toeward portion of the skirt, from the face onto the heelward portion of the skirt, from the face onto the sole, etc. The face display 838 may be centered on the face 816 and/or the face insert 817 or may be offset towards either the heel portion 826 or the toe portion 828 of the club head 802. In one embodiment the surface area of the face display 838 is at least 2000 $mm^2$, while in further embodiments it is at least 3000 $mm^2$, at least 3500 $mm^2$, at least 4000 $mm^2$, at least 4500 $mm^2$, at least 5000 $mm^2$, at least 5250 $mm^2$, at least 5500 $mm^2$, or at least 5750 $mm^2$. The procedure for measuring the face area is disclosed in U.S. Pat. No. 8,096,897, which is incorporated herein by reference in its entirety.

The face display 838 may be formed separately from the face 816 or face insert 817 or may be integrally formed with the face 816 or face insert 817. In some examples where the face 816 or face insert 817 is a composite panel comprising a plurality of layers (e.g., fiber-reinforced polymer layers), the face display 838 can be integrally formed as an electronic paper display layer of the composite face 816 or face insert 817. In some examples, the face display 838 can be removed or detached from the face 816 or face insert 817. The face display 838 can comprise a top edge portion 839 defining a top-most edge of the face display 838 oriented closest to the top portion 834 or the crown 812 of the club head 802.

In certain examples where the face 816 or face insert 817 is a composite panel, the face insert 817 can further comprise a protective cover (FIG. 17) disposed on an outer surface of the face display 838. The protective cover can comprise a layer, shell, or coating configured to protect the face display 838 from rain, wind, dust, physical damage, etc. Some examples of the protective cover can be formed from polyurethane, but in other examples the protective cover can be formed of any transparent polymer or material and may further include any of the embodiments disclosed in U.S. patent application Ser. No. 16/817,311, which is incorporated herein by reference in its entirety. Where the protective cover forms the outermost layer of the face 816, the protective cover can comprise grooves or scorelines (FIG. 17) formed in the polymer. In some examples, the protective cover can additionally or alternatively comprise a screen protective layer, an anti-glare coating, an anti-reflective coating, an anti-fingerprint coating, or any combination thereof. Further details of covers that can be used in combination with the golf club heads and displays disclosed herein are described in U.S. Publication No. 2022/0184469, which is incorporated herein by reference in its entirety.

In some examples, the front edge portion 837 of the crown display 836 can be immediately adjacent and/or in contact with the top edge portion 839 of the face display 838 to provide a substantially continuous display surface spanning portions of the top portion 834 and the front portion 830 of the club head 802. In some examples, the front edge portion 837 of the crown display 836 can extend past a front edge portion of the crown 812 or crown insert 813 such that the front edge portion 837 of the crown display 836 is immediately adjacent the top edge portion 839 of the face display 838. In some examples, the top edge portion 839 of the face display 838 can extend past a top edge portion of the face 816 or the face insert 817 such that the top edge portion 839 of the face display 838 is immediately adjacent the front edge portion 837 of the crown display 836. Thus, in such examples, at least one of the front edge portion 837 of the crown display 836 and the top edge portion 839 of the face display 838 can be disposed on the face-to-crown transition zone 841 and across the topline 835.

In some examples, the front edge portion 837 of the crown display 836 and the top edge portion 839 of the face display 838 can meet at a juncture 840 extending generally in the heel-toe direction. In the example shown in FIG. 16, the juncture 840 can be disposed at or near the topline 835 of the club head 802 in the face-to-crown transition zone 841, but in other examples the juncture 840 can be located anywhere in the upper face and/or the forward crown areas of the club head 802.

In some examples, such as the embodiments of FIGS. 23 and 24, at least one of the crown display 836 and/or the face display 838 can be configured, sized, and/or shaped to generate and/or display an image 856 to manipulate an appearance of the face-to-crown transition zone 841 (for example, the topline 835 at the face-to-crown transition zone 841). In some examples, the image 856 can comprise a representation of the face-to-crown transition zone 841 and/or the topline 835. The representation of the face-to-crown transition zone 841 and/or the topline 835 can be translated, resized, reshaped, or rotated relative to the true position and orientation of the face-to-crown transition zone 841 using the crown display 836 and/or the face display 838, or can be distorted, blurred, recolored, etc. In some examples, the image 856 can comprise a marking (such as a line or a dot) indicative of a location or orientation of the face-to-crown transition zone 841 and/or the topline 835 relative to the club head 802. The displays 836, 838 can manipulate the image 856 by translating, rotating, resizing, reshaping, distorting, recoloring, etc. the marking relative to the club head 802.

As seen with reference to FIG. 24, a feature, or image, on the crown display 836 may be used to alter the perceived angle of the face for the user, and in some embodiments is user adjustable. In the current embodiment, a crown alignment feature top tangent 610 that is aligned at an angle 615 with respect to the face angle tangent 505 such that the perceived angle of the face (Perceived Face Angle, PFA) is different from the actual alignment of the face angle tangent 505. In the current embodiment, the angle 615 is about 4°. In various embodiments, the angle 615 may be user adjustable from about 2° to about 15°. In one embodiment the crown alignment feature top tangent angle 615 is user adjustable by at least 2°, and in further embodiments at least 4°, 6°, 8°, or 10°. The top tangent 610 is an indicator of the alignment of an edge of a crown alignment feature on the crown display 836, which may include an area of contrasting color, shade, texture, and/or visible surface feature on a first portion of the crown display 836 versus a second portion of the crown display 836.

In various embodiments, a perceived angle may be determined by finding a linear best-fit line of various points. For such approximation, a perceived angle tangent may be determined by best fitting points on the crown alignment feature edge 614 at coordinates of the x-axis that are coincident with center face and at points ±5 mm of center face (points 622*a,b*), at points ±10 mm of center face (points 624*a,b*), at points ±15 mm of center face (points 626*a,b*), and at points ±20 mm of center face (points 628*a,b*). As such, nine points are defined along the edge 614 for best fit of the crown alignment feature top tangent 610. In the current embodiment, the perceived angle tangent is the same as the crown alignment feature top tangent 610. In one embodiment the user establishes the location of at least three of the disclosed points and the later disclosed electronics create the associated crown alignment feature on the crown display 836, thus the user is effectively defining the parameters to create the crown alignment feature. A user adjustability control system may limit the range of adjustability that a user may manipulate, and/or automatically override the user inputs to bring the crown alignment feature within a predefined allowed range of parameters.

Figure 25:
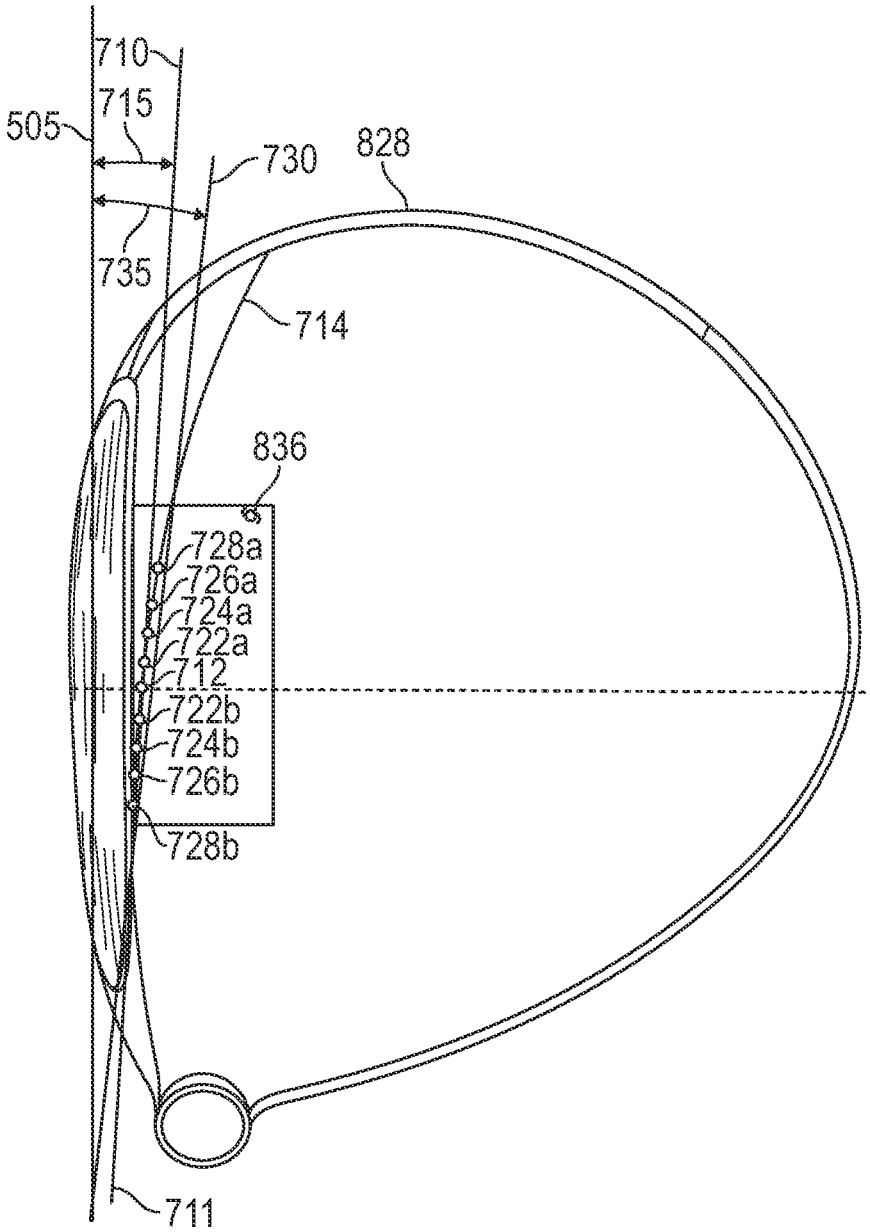
FIG. 25 shows a golf club head with a display, according to another example.

The crown alignment feature edge 714 seen in FIG. 25 is more aggressively rounded proximate the toe 828 than prior embodiments. As such, a line 711 that is literally tangent to the crown alignment feature edge 714 at a point 712 that is coincident with the y-axis may not adequately describe the perception. Such a line would be the crown alignment feature top tangent 710. However as noted previously with reference to FIG. 24, points 712, 722*a,b*, 724*a,b*, 726*a,b*, and 728*a,b*, can be used to form a best fit line 730 that is aligned at a perceived angle 735 that is greater than an angle 715 of the crown alignment feature top tangent 710. In various embodiments, the perceived angle 735 may be within the increments of angle 615, above, or may be up to 20° in various embodiments. In most embodiments, the perceived angle 735 may be 7-11°. In various embodiments, the perceived angle 735 may be 9-10°. In various embodiments, the perceived angle 735 may be 7-8.5°.

In some examples, the displayed image 856, which is the crown alignment features discussed with respect to FIGS. 24 and 25, but again may include any of the disclosed alignment aides, crown alignment features, simulated toplines, topline alignment features, or visual cues, generically referred to as topline 835, can change an apparent position of the topline 835 relative to the club head 802 from the perspective of the user when the golf club head 802 is at the normal address position. For example, the crown display 836 and/or the face display 838 can display the image 856 on a first portion of the crown display 836 and/or the face display 838. The crown display 836 and/or the face display 838 can subsequently display the image 856 on a second portion of the crown display 836 and/or the face display 838, wherein the second portion is located a specified distance along a positive y-axis (FIGS. 18A-18B) from the first portion. As such, displaying the image 856 on the second portion rather than the first portion can change the apparent position of the topline 835 along or relative to the positive y-axis. In some examples, the crown display 836 and/or the face display 838 can be sized and shaped to display the image 856 such that the image 856 changes the angle and/or shape of the face-to-crown transition zone 841 and/or the topline 835 from the perspective of the user when the club head 802 is at the normal address position. For example, the crown display 836 and/or the face display 838 can display the image 856 in a first configuration. The crown display 836 and/or the face display 838 can subsequently display the image 856 in a second configuration, wherein the image 856 in the second configuration is rotated, translated, or resized relative to the image 856 in the first configuration, where resizing includes changing the radius of curvature, measured in the x-y plane, of a portion of the image 856, such as those illustrated in FIGS. 24 and 25. Further, the image 856 in the second configuration may simply be a different color, shade, brightness, reflectance, gloss, and/or texture than the image 856 in the first configuration. Further, the image 856 in the second configuration may simply be a different line type than the image 856 in the first configuration, such as a change from a solid line to a broken, or discontinuous, line type. In one embodiment the image 856 in the second configuration is user adjustable at least 2 mm in the origin y-axis direction, and in further embodiments at least 4 mm, 6 mm, 8 mm, or 10 mm. In another embodiment the image 856 in the second configuration is user adjustable no more than 40 mm in the origin y-axis direction, and in further embodiments no more than 36 mm, 32 mm, 28 mm, 24 mm, 20 mm, or 16 mm. In one embodiment the image 856 in the second configuration is user adjustable at least 2 mm in the origin x-axis direction, and in further embodiments at least 4 mm, 6 mm, 8 mm, or 10 mm. In another embodiment the image 856 in the second configuration is user adjustable no more than 80 mm in the origin x-axis direction, and in further embodiments no more than 70 mm, 60 mm, 50 mm, or 40 mm.

In the illustrated example, the image 856 can comprise a line extending along at least a portion of the crown display 836 at, along, or near the juncture 840 of the crown display 836 and the face display 838, as further described below. As discussed later in this disclosure, the image 856 can be an alignment indicator that indicates an orientation of the club head 802 relative to the user. However, the image 856 can be any visual cue configured to convey any information that could be relevant to the user (for example, any information disclosed with respect to FIGS. 18A-18B, as well as information obtained from a launch monitor allowing a golfer to review the launch monitor data on the club head without having to move from the hitting position). For example, the image 856 can comprise an arrow, a dot, a target, a textual message, an alignment indicator including any shape, such as rectangular, trapezoidal, triangular, other polygonal shape, elliptical, oval, other rounded shape, or various irregular shapes. In some examples, the image 856, or alignment feature, can be represented by one or more predefined shapes (e.g., circles, ovals, squares, triangles, or the like) along a line, whether straight or curved.

The electronic displays described herein such as the crown display 836 and/or the face display 838 can comprise any of various display types. For example, the electronic displays can include an emissive display where each pixel in the display screen is an emitter that outputs light when electric current is applied. Example emissive displays include liquid crystal display (LCD), thin-film-transistor (TFT) LCD, light emitting diodes (LED), organic LED (OLED), active-matrix LED (AMOLED), etc. In some examples, the electronic display can operate in a transmissive LCD mode. In some examples, the electronic display can operate in a transflective LCD mode. In both transmissive and transflective LCD modes, the electronic display includes a backlight source (e.g., an array of LEDs) emitting the light which passes through the display screen. In some examples, the electronic display can comprise a reflective display. The reflective display uses ambient light instead of a backlight as a light source. Because there is no need for electricity to emit light, power consumption is very low compared with conventional LCDs. In one example, the electronic display can operate in a reflective LCD mode, e.g., by installing a mirror behind the LCD screen, such that ambient light that passes through the LCD screen from the front side can be reflected by the mirror back to a viewer. In another example, the reflective display can be a memory-in-pixel (MiP) display based on Low Temperature Poly Silicon (LTPS).

In yet another example, the reflective display can be an e-ink or electronic paper display based on microencapsulated electrophoretic display technologies. For example, in some examples the electronic paper display can be an electrophoretic display, an electrowetting display, or an electrochromic display. Compared to LED-based displays, using an electrophoretic display can have certain advantages, e.g., reducing power consumption (e.g., may run for many years using a coin cell battery), having an "image memory" (e.g., power is only needed to change the display, and the displayed image can hold indefinitely until a voltage is applied to change the display), being considered bi-stable, and not requiring a backlight. Because the electrophoretic display reflects light, but does not emit light, it can improve readability, especially in bright conditions, and have wide visibility angles and high contrast (e.g., black/white and colors that are native ink appear bold while mixing native ink colors can fade/reduce contrast). The electrophoretic display can be configured to be thin and lightweight, and can be flexible (e.g., plastic backplane and/or film based). In some cases, the update timings can be on the order of less than 1600 msec, less than 1200 msec, less than 1000 msec, or less than 750 msec, e.g., when using native ink to generate colors, and for monochrome screens, the update timing can be on the order of less than 1000 msec, less than 850 msec, or less than 700 msec. In some case, the display may update faster if less than an entire screen is updated, for example, a partial image may update in less than 600 msec, less than 500 msec, less than 350 msec, or less than 300 msec. In some cases, the electrophoretic display can have a monochrome screen with an RGB filter, e.g., controlling the monochrome by applying different voltages to generate image on gray scale and then applying the RGB filter to provide colors for the user to experience (in which case the update timing is on the monochrome scale and not on the color scale). The electrophoretic display can be implemented in different ways, e.g., by using tiny capsules that contain fluid and ink (positive and negatively charged so applied voltage causes desired ink to be at surface). In some examples, the electronic display can be a segmented electronic paper display.

Other electronic paper displays can include electrowetting and electrochromic displays. Ynvisble is one company that specializes in electrochromic displays. The Ynvisible Display is an e-paper technology, a so-called Electrochromic Display ("ECD"), based on organic electrochromic polymers. It is categorized as a reflective display—meaning that it reflects ambient light instead of using a backlight. The displays are screen-printed on a plastic substrate, which makes the displays very thin and flexible. The Ynvisble displays may be segmented e-paper displays and offer ultra-low power consumption. For static usage (when the display maintains the same image) the display consumes a maximum of 0.28 μW per $cm^2$ segment area. For dynamic usage, the power consumption depends on the number of display updates per day according to the formula below. See, for example, U.S. Pat. Nos. 9,625,782, 8,907,918, 8,773,747, and US Publication numbers 2014/0361211, 2014/0139576, incorporated by reference herein in their entirety.

Etulipa is a supplier of Electro Wetting Display technology (EWD). Etulipa offers a full-color Electro Wetting Display (EWD) panel that consumes less than 7 $W/m^2$ and runs continuously on a solar panel and battery. Electronic paper displays like these use the ambient light that falls on the display surface and reflect it back to the eye of the observer, resulting in excellent readability under all conditions. Since reflective displays do not emit light but reflect it, they create zero light pollution, are not intrusive, and produce zero emissions. See, for example, US publication numbers 2013/0278994 and 2011/0235146 directed to EWD, both of which are incorporated by reference herein in their entirety.

In some examples, at least one of the crown display 836 and the face display 838 can be an electronic paper display (which is also referred to herein as an "e-paper display", an "e-ink display," or an "e-ink layer"). As used herein, the terms "electronic paper display," "e-ink display," "e-paper display," and "e-ink layer" refer to a reflective display that uses ambient light instead of a backlight as a light source. Example types of electronic paper displays can include, but are not limited to, electrophoretic displays, electrowetting displays, and electrochromic displays. Electronic paper displays can beneficially feature low power consumption and good readability in certain golfing conditions. For example, because the electronic paper display does not emit light, it can display wide visibility angles and high contrast in bright or outdoor conditions.

In some examples, the electronic paper display can be bi-stable. The bi-stable electronic paper display can comprise a plurality of capsules, each of which contains at least one ink suspended in a fluid. The ink can be positive or negatively charged such that an applied voltage can cause the ink to migrate to a surface of the capsule. Since bi-stable displays only require power when the display is changed, the bi-stable electronic paper display can beneficially display an image indefinitely until a voltage is applied to change the electronic paper display.

The electronic paper display can be configured to display images in black & white, grayscale, a plurality of colors, or any color palate. In some examples, the electronic paper display can have any one of a two-color palate, three-color palate, four-color palate, five-color palate, six-color palate, seven-color palate, etc. In some examples, the electronic paper display can comprise a monochrome screen with an RGB filter (e.g., comprising a red filter, a green filter, and a blue filter). A color image can be displayed on the electronic paper display by generating a grayscale image on the monochrome screen and then applying the RGB filter to provide colors.

In some examples, at least one electronic display can be additionally configured to receive input. In some examples, the at least one electronic display can be a touch-sensitive screen (such as a resistive, capacitive, piezoelectric, infrared, or optical touchscreen) configured to receive touch input from the golfer.

The displays described herein, such as the crown display 836 and/or the face display 838 configured as electronic paper displays or any other display, can be substantially flat or can have a curvature. In some examples, the crown display 836 can be covered by a curved cover that follows a contour of the top surface of the golf club head 802. In some examples, the crown display 836 itself can be curved (e.g., using a flexible screen material) about multiple axes, e.g., with a spherical or circular curvature in heal-to-toe and/or front-to-back directions. In one embodiment the face display 838 has a curvature that matches the bulge and roll of the face 816, which in one embodiment is a radius of curvature of no more than 500 mm, and in further embodiments no more than 450 mm, 400 mm, 375 mm, 350 mm, or 330 mm. In a further embodiment the radius of curvature is at least 200 mm, and in further embodiments at least 225 mm, 250 mm, 275 mm, or 300 mm.

In some examples, the crown display 836 can have a sloped surface along the front-to-back direction (e.g., along the y-axis 875) so as to facilitate water runoff and avoid water pooling. For example, a first elevation at a forward portion of the crown display 836 can be greater than a second elevation at a rearward portion of the crown display 836 as measured relative to the ground plane 19 when the club head 802 is at the normal address position. In certain examples, the crown display 836 can have an apex at or near the geometric center of the crown 812, and the peripheral edges of the crown display 836 can be lower (e.g., along the z-axis) than the apex.

In some examples, the display(s) can be covered by a screen protective layer, an anti-glare layer, an anti-reflective layer, an anti-fingerprint layer, transparent lens, or any combination thereof, as well as any of the display features, and/or components associated with the display, disclosed in U.S. patent application Ser. No. 17/878,734, which is incorporated herein by reference in its entirety.

In some examples, through a controller, the display(s) can have an auto-dim feature. For example, the displays described herein be configured to automatically adjust the brightness of the display (e.g., decreasing the brightness in dusk, dawn, shade, or low light condition, increasing the brightness in the sun, etc.). In some examples, to provide good readability in a bright environment and/or reduce power consumption, and where the display is an LCD display, the display can be configured to operate in a reflective LCD mode or transflective LCD mode. In some examples, to reduce power consumption and/or sunlight readability, the display can be configured as a MIP display where each pixel is individually addressable.

In some examples, any or all of the electronic displays described herein can be configured as segmented display(s), where a plurality of pre-configured line segments can be independently turned ON or OFF. Illumination of individual line segments can be based on a limited number of colors (e.g., 2, 3, 4, etc.). A selected number of dots or line segments forming a predefined shape or pattern (e.g., a straight line, a curved or angled line, an elongated, curved region approximating the shape of the crown-to-face transition zone 841, a cross, one or more squares, one or more triangles, one or more circles, one or more polygons, e.g., hexagon or octagon, etc.) can be simultaneously illuminated to display the predefined shape or pattern. In addition to common geometric shapes, the predefined shape could be a logo or one or more icons representing a shape such as a heart, power button (partial circle with a line bisecting the top of the circle), various emojis, a low battery icon or fully charged battery icon, or a temperature warning icon such as a thermometer for indicating excessive heat. Icons, dots, line segments, and other shapes may be replicated at different positions, allowing for selectively moving the icon, dots, line segments, or other shapes along a heel-to-toe direction and/or along a front-to-back direction of the electronic display. Additionally, other sight lines or alignment features disclosed throughout may be selectively movable along the heel-to-toe direction and/or along the front-to-back direction of the electronic display using a mobile device to control the movement.

Because only a limited number of individually addressable line segments need to be turned ON or OFF, using the segmented display may have certain benefits, such as a lower cost to customize and more energy efficient compared to matrix-based displays which rely on individual pixels to form an image or a shape pattern, which may cause pixelated lines in certain circumstances. In contrast, the segmented display can create crisp images and straight lines without the need for high matrix resolution. For example, a segmented display may have pre-defined shapes (angled lines, circles, curved features, etc.) that when turned on appear crisp to the eye. Typically, if you have a low-resolution matrix-based display and try to have an angled line or another shape that does not directly utilize the square nature of those pixels, i.e., a circle, you are limited by the pixels themselves as to the clarity of your image. In other words, a segmented display may offer more crisp shapes that would only be achievable with a much higher resolution matrix display and much higher power consumption matrix display. Additionally, the segmented display can be used with or without a backlight and reduce power dissipation within the electronic system, may require only minimal componentry, do not require drivers, is easy to produce, and result in robust field operation.

In some examples, the electronic paper display can be a matrix display which can have any screen resolution, such as ranging from 10 pixel per inch (PPI) to 1000 PPI or higher, such as at least 200 PPI.

The images displayed by the electronic displays described herein can be black/white, greyscale, colored, or other color palate. The electronic display can have any shape, such as rectangular, trapezoidal, triangular, other polygonal shape, elliptical, oval, other rounded shape, or various irregular shapes. The crown display 836 can have the same or approximately the same shape as the crown 812 or the crown insert 813. Thus, the crown display 836 may extend all the way to any of the crown edges disclosed in U.S. patent application Ser. No. 18/082,735, which is incorporated herein by reference in its entirety. The face display 838 can have the same or approximately the same shape as the face 816 or face insert 817. In some examples, selective portion (s) of the electronic display can be masked by parts of the body 810 of the club head 802 so as to give appearance of any desired shape to a user of the club head 802.

Further descriptions of example e-ink displays can be found in U.S. Pat. Nos. 9,625,782, 8,907,918, 8,773,747, and U.S. Patent Application Publication Nos. 2014/0139576, 2013/0278994, and 2011/0235146, each of which is incorporated by reference herein in its entirety.

Figure 17:
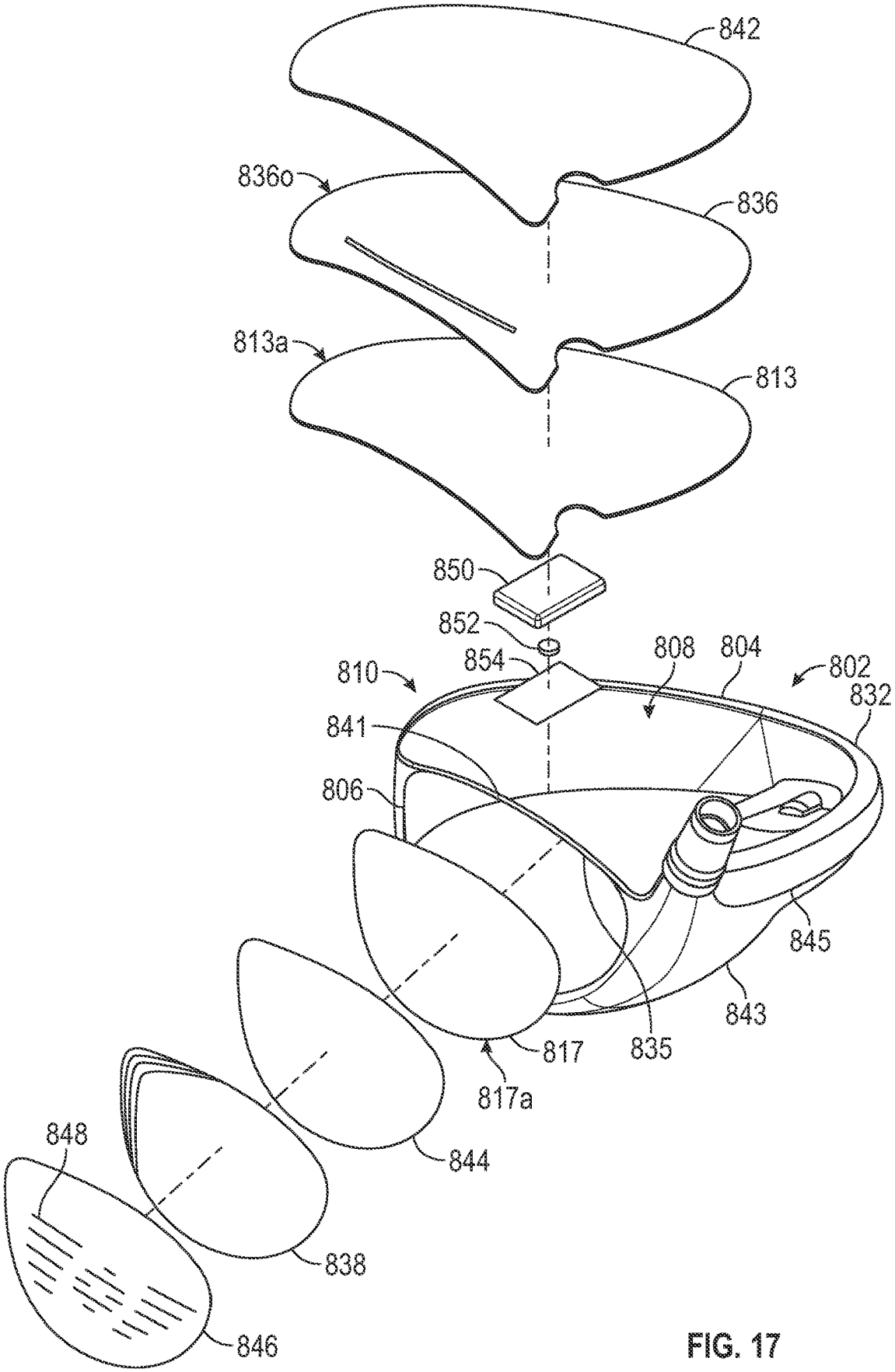
FIG. 17 shows an exploded view of the golf club head of FIG. 16.

FIG. 17 shows an exploded view of the club head 802. The club head 802 can comprise the body 810, the crown insert 813, the face insert 817, the crown display 836, the face display 838, and an electronic assembly 850. The body 810 can comprise a top opening 804, a front opening 806, and a cavity 808 connected to the top opening 804 and the front opening 806. The crown insert 813 can be configured to cover the top opening 804, the face insert 817 can be configured to cover the front opening 806, and the electronic assembly 850 can be configured to be disposed within the cavity 808. Although the body 810, the crown insert 813, and the face insert 817 are exploded as separate components for illustrative purposes, it should be understood that the body 810 and at least one of the crown insert 813 and the face insert 817 can be formed as a unitary or inseparable component.

The crown insert 813 can comprise an inner surface (which is also referred to herein as a "lower surface") facing the top opening 804 and an outer surface 813*a* (which is also referred to herein as an "upper surface") opposite the inner surface. In certain examples, the crown display 836 can be coupled to the outer surface 813*a* of the crown insert 813. The crown display 836 may be inseparably coupled to the outer surface 813*a* (for example, by bonding, welding, adhering, or fastening) or may be removably coupled to the outer surface 813*a*. In some examples, the crown display 836 can be a flexible electronic display or electronic paper display with a plastic backplane or a thin-film backplane that conforms to a curvature of the outer surface 813*a* of the crown insert 813. Although the crown display 836 is shown in FIG. 16 as having substantially the same shape as the crown insert 813, it should be understood that the crown display 836 can have any size, shape, or form factor.

The club head 802 can optionally comprise a protective layer 842 disposed on an outer surface 8360 of the crown display 836 to protect the crown display 836 from rain, wind, dust, physical damage, etc. The surface area of the protective layer 842 may be equal to the surface area of the crown display 836 or may be greater than the surface area of the crown display 836. In some examples, the protective layer 842 can comprise a polyurethane coating or shell. However, the protective layer 842 can be formed of any other transparent polymer or material. In some examples, protective layer 842 can additionally or alternatively comprise a screen protective layer, an anti-glare coating, an anti-reflective coating, an anti-fingerprint coating, or any combination thereof.

In some examples where the crown display 836 is integrally formed with the crown insert 813, the crown insert 813, the crown display 836, and the optional protective layer 842 can form a composite panel referred to herein as a "crown stack." In such examples, the crown insert 813 can be an integral "base layer" or "structural layer" of the crown stack and the crown display 836 can be an integral "electronic paper display layer" of the crown stack. In certain examples, the crown insert 813 can comprise a plurality of "prepreg" layers or plies of woven fibers impregnated with a polymeric resin. The fibers can comprise carbon fibers, glass fibers, and/or aramid fibers. The resin can be an epoxy resin, or another type of resin or adhesive. The crown display 836 and its associated electrical leads can be included with the prepreg layers during layup of the crown insert 813 or can be coupled to the crown insert 813 after it is formed. Exemplary materials and processes for forming the crown insert 813 are described in detail in U.S. Publication No. 2022/0184469, which is incorporated by reference herein in its entirety. In one embodiment the thickness of the substrate of the crown 812 and/or crown insert 813 located under the crown display 836 is reduced. In one such embodiment the number of prepreg layers under the crown display 836 is less than the portion of the crown 812 that is not covered by the crown display 836, and a further embodiment has at least two less prepreg layers located under the crown display 836 compared to the number of prepreg layers within the portion of the crown 812 that is not covered by the crown display 836.

The face insert 817 can comprise an inner surface facing the front opening 806 and an outer surface 817*a* (which is also referred to herein as a "forward surface") opposite the inner surface. The face display 838 can comprise an electronic paper display coupled on the outer surface 817*a* (i.e., the front-facing surface) of the face insert 817. The face display 838 can be inseparably coupled to the outer surface 817*a* (for example, by bonding, welding, adhering, or fastening) or can be removably coupled to the outer surface 817*a*. In some examples, the face display 838 can be a flexible electronic display or electronic paper display with a plastic backplane or a thin-film backplane that conforms to a curvature or a contour of the outer surface 817*a* (e.g., to a bulge contour and a roll contour of the face 816). Although the face display 838 is shown in FIGS. 16-17 as having substantially the same shape as the face insert 817, it should be understood that the face display 838 can have any size, shape, or form factor. In some examples, the club head 802 can optionally be configured to show where a golf ball impacts the face 816 during or after a swing or stroke. In such examples, the club head 802 can comprise a piezoelectric layer 844 configured to detect an impact between the golf ball and the face 816 or an impact location (i.e., a location where the golf ball impacts or contacts the face 816 of the club head 802). The piezoelectric layer 844 can be disposed between the face insert 817 and the face display 838. The piezoelectric layer 844 may be coupled to the outer surface 817*a* of the face insert 817 and an inner surface of the face display 838. The piezoelectric layer 844 may cover a portion of the outer surface 817*a* of the face insert 817 or may cover the entirety of the outer surface 817*a*. In response to detecting the impact of the golf ball against the face 816, the piezoelectric layer 844 can be configured to send a signal to the electronic assembly 850. The electronic assembly 850 can determine the impact location based on the received signal and send a subsequent signal to the face display 838 to display the impact location on the face display 838. Displaying the impact location on the face 816 can provide valuable feedback to the user by allowing the user to see where the golf ball contacted the club head 802 after a shot.

In some examples, the face display 838 can be reset or refreshed to stop displaying the impact location. In some examples, the electronic assembly 850 can further comprise a switch configured to generate a signal to the controller to reset the face display 838. In response to receiving the signal, the electronic assembly 850 can send a reset signal to the face display 838. In some examples, the face display 838 can be reset based on a signal received by the electronic assembly from an external device (such as a mobile computing device or cloud computing server). In some examples, the electronic assembly 850 can determine when to send the reset signal based on sensor input (e.g., a detected movement of the club head 802), user input, an elapsed time, a wireless communication, etc. Unlike conventional means of determining impact locations on a club face, the face display 838 of the club head 802 can be quickly and easily reset after a stroke without the need to reapply tapes, powders, or inks to the face 816.

In some examples, the club head 802 can optionally comprise a cover or protective layer 846 covering at least a portion of the face display 838 to protect the face display 838 from rain, wind, dust, physical damage, etc. and from the impact of the golf ball. The surface area of the protective layer 846 can be equal to or greater than the surface area of the face display 838. In some examples, the protective layer 846 can comprise a polyurethane cover. However, the protective layer can be formed of any other suitable polymer or material. In some examples, the protective layer may include grooves 848 (which are also referred to herein as "score lines" or "scorelines") on an outer surface of the protective layer 846, wherein the grooves 848 are configured to impart advantageous spin characteristics to a golf ball. In some examples, the grooves 848 can be oriented in the horizontal direction. Further details regarding exemplary covers that can be used in combination with the face inserts described herein can be found in U.S. Publication No. 2022/0184469 incorporated by reference above.

In some examples where the face display 838 is integrally formed with the face insert 817, the face insert 817, the optional piezoelectric layer 844, the face display 838, and the optional protective layer 846 can form a composite panel referred to herein as a "face stack." In such examples, the face insert 817 can be an integral "base layer" or "structural layer" of the face stack and the face display 838 can be an integral "electronic paper display layer" of the face stack.

In some embodiments, the face insert 817 of some examples of the golf club heads disclosed herein can be manufactured from multiple layers of composite materials. Exemplary composite materials and methods for making the same are described in U.S. patent application Ser. No. 13/452,370 (published as U.S. Pat. App. Pub. No. 2012/

0199282), which is incorporated by reference herein in its entirety. In some embodiments, an inner and outer surface of the composite face can include a scrim layer, such as to reinforce the strike face with glass fibers making up a scrim weave. Multiple quasi-isotropic panels (which are also referred to herein as "Q panels" or "Q's") can also be included, with each Q panel using multiple plies of unidirectional composite panels offset from each other. In an exemplary four-ply Q panel, the unidirectional composite panels are oriented at 90°, −45°, 0°, and 45°, which provide for structural stability in each direction. Clusters of unidirectional strips (C's) can also be included, with each C using multiple unidirectional composite strips. In an exemplary four-strip C, four 27 mm strips are oriented at 0°, 125°, 90°, and 55°. C's can be provided to increase thickness of the strike face, or other composite features, in a localized area, such as in the center face at the preferred impact zone. Some Q's and C's can have additional or fewer plies (e.g., three-ply rather than four-ply), such as to fine tune the thickness, mass, localized thickness, and provide for other properties of the strike face, such as to increase or decrease COR of the strike face.

Additional composite materials and methods for making the same are described in U.S. Pat. Nos. 8,163,119 and 10,046,212, which are each incorporated by reference herein in its entirety. For example, the usual number of layers for a strike plate is substantial, e.g., fifty or more. However, improvements have been made in the art such that the layers may be decreased to between 30 and 50 layers.

In some examples where the body 810, the crown insert 813, the sole insert, and/or the face insert 817 are formed as separate components, the club head 802 can further comprise one or more gaskets, O-rings, or sealants disposed between the body 810 and the crown insert 813, the sole insert, and/or the face insert 817 to prevent ingress of water, dirt, dust, or other contaminants into the cavity 808. The club head 802 can further comprise one or more fasteners, welds, adhesives, or bonds to secure the crown insert 813, sole insert, and/or the face insert 817 to the body 810.

Example 4: Representative Electronic Assembly

The electronic assembly 850 shown in FIG. 17 can include various electronic components forming an electronic circuit, such as a controller, one or more memory units, one or more sensors, a communication unit (which is also referred to herein as a "communication connection"), one or more batteries, storage devices, connecting wires, antenna, coil, input/output (I/O) ports, etc. The electronic assembly can be configured as a computing system, which is described more fully below with respect to FIG. 20. The electronic assembly can be disposed within the cavity 808 of the body 810, the golf bag, and/or the head cover. In some examples, the body 810 and the electronic assembly 850 can be fixedly coupled together to form a unitary piece such that the electronic assembly 850 is permanently attached to the body 810.

The controller can be configured to manage and control various aspects of the operation of the electronic circuit, including battery management, on/off status of the electronic displays (such as the crown display 836 and/or the face display 838 and/or a sole display (FIGS. 29A-29B) and/or a golf bag electronic display (FIGS. 30-37) and/or a head cover electronic display (FIGS. 38-41)), control of power levels, sensor measurement, analysis of the measured sensor data, controlling electronic displays to show alignment indicators, images, messages, or other information, communication with external computing devices, and the like.

In some examples, the sensors can include at least one inertial measurement unit (IMU). In some examples, the IMU can be a 9-axis sensor including one or more accelerometers, gyroscopes, and magnetometers that measure 3D orientation, 3D velocity, 3D gravitational forces, and/or other properties of the golf club head 802. In some examples, the sensors can include one or more proximity sensor, gesture sensor, motion sensor, impact sensor, pressure/barometer sensor, sound sensor (e.g., microphone, etc.), humidity sensor, light or optical sensor (e.g., camera, etc.), color sensor, or the like. The sensors can be electronically coupled to the controller, battery, and/or other electronic components. The sensors can be positioned at various locations around the club head 802 and can be enclosed within the body 810 or outside the body 810, around the golf bag and can be enclosed within the golf bag or outside the golf bag, and/or around the head cover and can be enclosed within the head cover or outside the head cover.

In some examples, the electronic assembly 850 can further comprise an antenna. The antenna can enable the electronic assembly 850 to wirelessly send data to and/or receive data from an external device, such as a mobile computing device (such as a laptop or a smartphone) or a cloud computing resource (such as computer server). The wireless communication can be implemented via any of various low power radio communication protocols such as Bluetooth™, Bluetooth Low Energy, Wi-Fi, Wireless USB, cellular, or any suitable wireless communication protocol. In some examples, the antenna can be part of a Bluetooth™ module.

In some examples, the electronic assembly 850 can further comprise a user interface control (such as a switch, a button, a knob, etc.) configured to enable and/or disable electrical operation of the electronic assembly 850. In other examples, the control can be used to pair or wirelessly connect the club head 102, the golf bag, and/or the head cover with a mobile computing device, enable and/or disable electrical operation of at least one of the electronic displays (such as the crown display 836, the face display 838, the sole display, the golf bag electronic display, and/or the head cover electronic display), reset at least one of the electronic displays, or receive input from the golfer. In some examples, the control can be multi-functional. The control can extend through an opening in the body 810, the golf bag, or the head cover. In some examples, the position of the control can be configured to be higher than the ground surface 19 when the club head 802 is at a normal address position, such that the control does not contact the ground surface 19 when the club head 802 is at the normal address position.

The club head 802, golf bag, and/or head cover can further comprise a battery 852 for powering the electronic assembly 850 and/or the electronic paper displays. The battery 852 can be replaceable or permanently installed, can be rechargeable, and can have any form factor. For example, the battery 852 can be a coin cell battery, a nickel cadmium battery, a lithium-ion battery, a nickel metal hydride battery, or other suitable type of battery. The battery 852 can be configured to have an extended battery life. For example, a fully charged battery can have an operating duration of at least 4-5 hours (e.g., more than 8 hours) such that the battery 852 can power the electronic assembly 850 over an entire game of golf.

In some examples, the battery 852 can also be utilized as a weight member to advantageously distribute the mass within the club head 802. The weight of the battery 852

(and/or together with the electronic assembly 850 and/or the electronic displays) can be so distributed within the club head 802 as to achieve a desired center of gravity location and/or desired moment of inertia properties of the club head 802. In some examples, the battery 852 can be configured to have an asymmetric mass distribution over the club head 802 to provide a greater/more desirable moment of inertia.

In some examples, the battery 852 can be recharged through a wired connection (e.g., via a USB port or the like). In some examples, the battery 852 can be charged wirelessly, e.g., via magnetic inductive charging. In certain examples, the club head 802, the golf bag, and/or the head cover can include a receiving coil 854 electrically connected to the battery 852 and disposed above a bottom cover of the club head 802 (e.g., above the sole insert). When aligned with a transmitting coil of an external charging device, the battery 852 can be wirelessly charged through electromagnetic coupling between the receiving coil 854 and the transmitting coil. In some examples, wireless charging can be controlled by an external device, such as a mobile phone. In some examples, a head cover configured to receive the club head 802 or an associated golf bag for the golf club can be configured as a power source for charging the battery 852, either through a wired connection or wirelessly. In some examples, the head cover and/or golf bag can have a solar panel configured to provide electric power for charging the battery 852 of the club head 802.

In some examples, the body can further comprise a bottom opening sized and shaped to receive the electronic assembly 850 and/or the battery 852. The sole insert can be attached to the bottom opening. The electronic assembly 850 and/or the battery 852 can be removed through the bottom opening, for example, to replace the battery 852.

Figure 28:
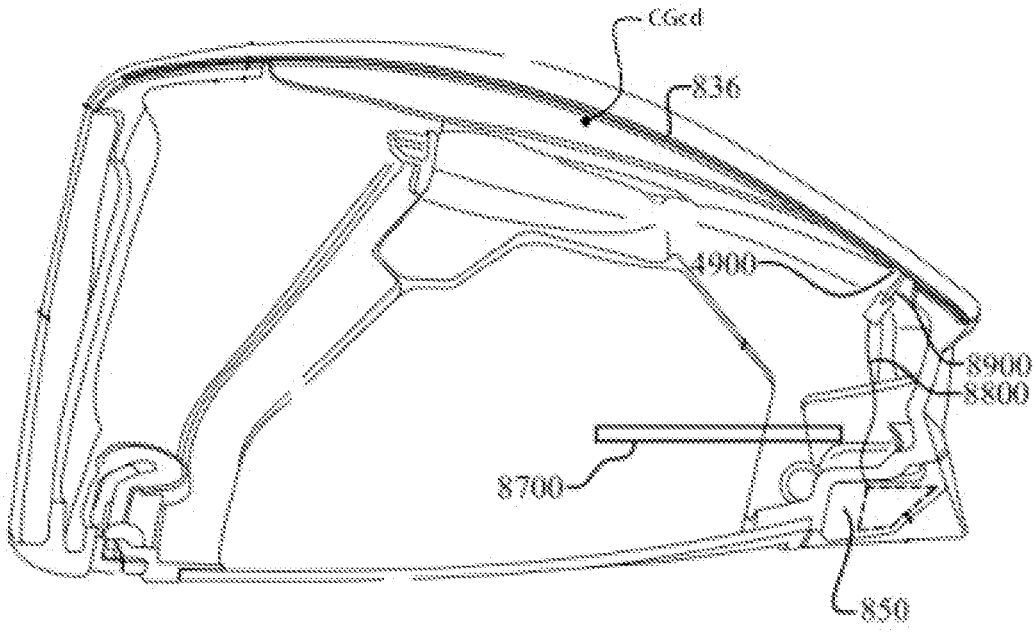
FIG. 28 shows a cross-sectional view of a golf club head with a display, according to another example.

FIG. 28 illustrates a crown display 836 that extends to the rear perimeter of the club head 802. In this embodiment a connector 8900 is located such that it penetrates a crown aperture 4900 near the rear of the club head 802 where stresses are less prominent; however this embodiment also facilitates an embodiment having a rear edge located connector 8900 that does not require penetration of the crown 812, but rather may enter the interior of the club head 802 by passing through a joint at the connection other club head components such as a ring, weight track, weight, or sole component. In another embodiment the electronic assembly 850 is externally attached to the club head 802 and may have the appearance of a weight assembly. Likewise, in another embodiment the battery 852 is externally attached to the club head 802 and may have the appearance of a weight assembly. Wiring 8800 electronically connects the electronic assembly 850 and the connector 8900. In a further embodiment an antenna 8700 is mounted internal to the club head 802, and in one embodiment is oriented parallel to the origin y-axis. The crown display 836 has a crown display center of gravity CGcd.

Figure 29A:
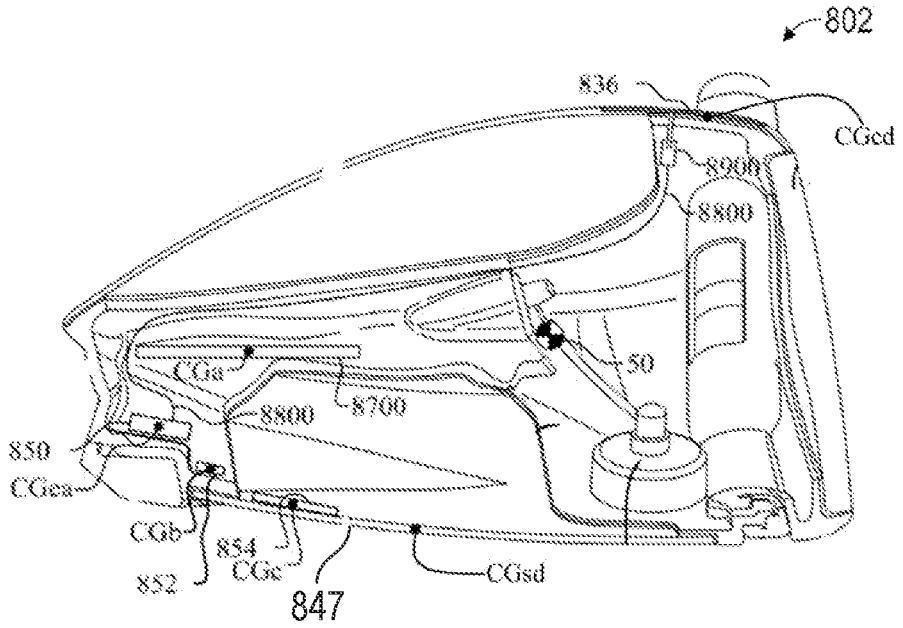
FIG. 29A shows a cross-sectional view of a golf club head with a display, according to another example.

FIG. 29A illustrates a side view of the club head 802 and, more particularly, the crown display 836 located at the front of the club head 802. FIG. 29A furthermore illustrates the fact that each of the components has a component center of gravity. Thus, the electronic assembly 850 has an electronic assembly center of gravity CGea; the antenna 8700 has an antenna center of gravity CGa; the battery 852 has a battery center of gravity CGb; the coil 854 has a coil center of gravity CGc; the crown display 836 has the crown display center of gravity CGcd; and a sole display 847 has a sole display center of gravity CGsd. In one embodiment at least one of the CGea, CGa, CGb, and CGc is located behind the club head CG 50; while in a further embodiment at least two are located behind the club head CG 50, and at least three in yet another embodiment, and all four in still a further embodiment. In one embodiment at least one of the CGea, CGa, CGb, and CGc is located below the elevation of the club head CG 50, meaning Zup; while in a further embodiment at least two are located below Zup, and at least three in yet another embodiment, and all four in still a further embodiment. In another embodiment at least one of the CGea, CGa, CGb, and CGc has a CG elevation measured in the same manner as Zup, and the CG elevation is less than 75% of Zup; while in a further embodiment this is true for at least two of CGea, CGa, CGb, and CGc; and in yet another embodiment this is true for at least three of CGea, CGa, CGb, and CGc; and in still a further embodiment this is true for all four of CGea, CGa, CGb, and CGc. In another embodiment at least one of the CGea, CGa, CGb, and CGc has a CG elevation measured in the same manner as Zup, and the CG elevation is less than 50% of Zup; while in a further embodiment this is true for at least two of CGea, CGa, CGb, and CGc; and in yet another embodiment this is true for at least three of CGea, CGa, CGb, and CGc; and in still a further embodiment this is true for all four of CGea, CGa, CGb, and CGc. In another embodiment at least one of the CGea, CGa, CGb, and CGc has a CG elevation measured in the same manner as Zup, and the CG elevation is less than 25% of Zup; while in a further embodiment this is true for at least two of CGea, CGa, CGb, and CGc; and in yet another embodiment this is true for at least three of CGea, CGa, CGb, and CGc; and in still a further embodiment this is true for all four of CGea, CGa, CGb, and CGc.

Each of the CGea, CGa, CGb, CGc, CGcd, and CGsd are located to the rear of the center face of the club head 802 a corresponding CGeay, CGay, CGby, CGcy, CGcdy, and CGsdy distance measured along the CG Y-axis. Additionally, each of the CGea, CGa, CGb, CGc, CGcd, and CGsd are located at an elevation, measured vertically above the ground plane 19 when the club head 802 is positioned in the normal address position, referred to respectively as Zup-ea, Zup-a, Zup-b, Zup-c, Zup-cd, and Zup-sd.

In one embodiment the Zup-cd of the crown display 836 is at least 75% greater than Zup of the club head 802, and in further embodiments at least 85%, 95%, 100%, 110%, or 120%. In another embodiment the Zup-cd of the crown display 836 is greater than a top face elevation, as disclosed and defined in U.S. patent application Ser. No. 18/082,735, which is incorporated herein by reference in its entirety. In another embodiment the Zup-cd of the crown display 836 is 100-130% of the top face elevation, and in further embodiments no more than 125%, 120%, 115%, or 110%.

In another embodiment the Zup-cd of the crown display 836 is at least $\alpha$ % greater than Zup-ea, Zup-a, Zup-b, Zup-c, and/or Zup-sd, where $\alpha$ is a constant that in one embodiment is 200, and in further embodiments is 225, 250, 275, 300, 325, 350, 375, 400, 425, 450, 475, 500, 525, 550, 575, or 600. In another embodiment the Zup-cd of the crown display 836 is no more than $\alpha$ % greater than Zup-ea, Zup-a, Zup-b, Zup-c, and/or Zup-sd, where $\alpha$ is a constant that in one embodiment is 1500, and in further embodiments is 1450, 1400, 1350, 1300, 1250, 1200, 1150, or 1100. In one embodiment Zup-cd of the crown display 836 is at least 30 mm greater than Zup-ea, Zup-a, Zup-b, Zup-c, and/or Zup-sd, and at least 32.5 mm, 35 mm, 37.5 mm, 40 mm, or 42.5 mm in additional embodiments. In another embodiment Zup-cd of the crown display 836 is at least 10 mm greater than Zup of the club head, and at least 15 mm, 20 mm, 22.5 mm, 25 mm, or 27.5 mm in additional embodiments.

In another embodiment at least 2 of the CGeay, CGay, CGby, CGcy, CGcdy, and CGsdy distances are at least β times the club head CGy distance, where β is a constant that in one embodiment is 1.1, and in further embodiments is 1.2, 1.3, 1.4, 1.5, 1.6, 1.7, 1.8, 1.9, or 2.0. In another embodiment at least 3 of the CGeay, CGay, CGby, CGcy, CGcdy, and CGsdy distances are at least β times the club head CGy distance, where β is a constant that in one embodiment is 1.1, and in further embodiments is 1.2, 1.3, 1.4, 1.5, 1.6, 1.7, 1.8, 1.9, or 2.0. In another embodiment CGeay and/or CGby are at least 40 mm greater than the club head CGy, and in further embodiments at least 50 mm greater, 55 mm greater, 60 mm greater, 65 mm greater, or 70 mm greater.

In one embodiment the mass of the crown display 836, the face display 838, and/or the sole display 847 is less than 2.5 grams, and in further embodiments less than 2.0, 1.5, or 1.0 grams. In another embodiment the mass of the crown display 836, the face display 838, and/or the sole display 847 is at least 0.25 grams, and in further embodiments at least 0.35, 0.45, 0.55, or 0.65 grams. In another embodiment the mass of the electronic assembly 850 is less than 15 grams, and in further embodiments less than 12.5, 10, 9, 8, 7, 6, or 5 grams. In a further embodiment the mass of the electronic assembly 850 is at least 1 gram, and in still other embodiments at least 2, 3, or 4 grams. In still a further embodiment the antenna 8700 has a mass that is less than 4 grams, 3 grams, 2 grams, or 1 gram. In another embodiment the antenna 8700 has a mass that is at least 0.25 grams, and in further embodiments at least 0.35, 0.45, 0.55, or 0.6 grams. Further, in one embodiment the battery 852 has a mass of less than 5 grams, and in further embodiments less than 4, 3, or 2 grams. In another embodiment the battery 852 has a mass of at least 0.5 grams, and in further embodiments at least 0.75, 1.0, 1.25, or 1.5 grams. In yet another embodiment the coil 854 has a mass that is less than 4 grams, 3 grams, 2 grams, or 1 gram. In still a further embodiment the coil 854 has a mass of at least 0.25 grams, and in additional embodiments at least 0.35, 0.45, 0.55, or 0.65 grams.

In one embodiment having a non-metallic crown component, the mass of the crown display 836 attached to the non-metallic crown component, is no more than 20% of a mass of the non-metallic crown component, and in further embodiments no more than 17.5%, 15%, 12.5% or 10%. In one embodiment having a non-metallic sole component, the mass of the crown display 836 is no more than 20% of a mass of the non-metallic sole component, and in further embodiments no more than 17.5%, 15%, 12.5% or 10%. The use of non-metallic crown component encompasses embodiments such as non-metallic crown inserts, but also non-metallic bodies where the non-metallic crown component is that portion of the non-metallic body portion, excluding the face 816, where a normal to the exterior surface of the non-metallic body portion is at least parallel to the ground plane 19 or points upward in the positive z-axis direction. Similarly, the use of non-metallic sole component encompasses embodiments such as non-metallic sole inserts, but also non-metallic bodies where the non-metallic sole component is that portion of the non-metallic body portion, excluding the face 816, where a normal to the exterior surface of the non-metallic body portion is at least parallel to the ground plane 19 or points downward in the negative z-axis direction. In another embodiment having a non-metallic crown component, the mass of the sole display 847 attached to the non-metallic sole component is no more than 20% of a mass of the non-metallic crown component, and in further embodiments no more than 17.5%, 15%, 12.5% or 10%. In one embodiment having a non-metallic sole component, the mass of the sole display 847 is no more than 20% of a mass of the non-metallic sole component, and in further embodiments no more than 17.5%, 15%, 12.5% or 10%.

Tables 1-3 below provides several mass properties of exemplary embodiments of the golf club head 802, with the club head 802 oriented with a face angle of 0 degrees.

TABLE 1

| | Example 1 | Example 2 | Example 3 | Example 4 | Example 5 |
|---|---|---|---|---|---|
| CGX | −5 to 5 mm | −4 to 4 mm | −3 to 3 mm | −2.5 to 2.5 mm | −1.5 to 1.5 mm |
| CGY | 33-50 mm | 35-47 mm | 35-45 mm | 35-44 mm | 36-44 mm |
| CGZ | −10 to 0 mm | −7 to −1 mm | −6 to −1.5 mm | −5 to -2.5 mm | −4 to −3 mm |
| ZUP | 18-30 mm | 20-28 mm | 21-27 mm | 22-27 mm | 23-27 mm |
| DELTA1 | 20-40 mm | 23-36 mm | 24-35 mm | 25-34 mm | 26-32 mm |
| DELTA2 | 34-42 mm | 35-40 mm | 35.5-39 mm | 35.5-38 mm | 35.5-38 mm |
| MASS | 180-210 g | 195-208 g | 197-206 g | 199-205 g | 200-205 g |
| IXX | 300-440 kg · mm$^2$ | 310-430 kg · mm$^2$ | 320-420 kg · mm$^2$ | 340-420 kg · mm$^2$ | 360-420 kg · mm$^2$ |
| IYY | 265-350 kg · mm$^2$ | 275-340 kg · mm$^2$ | 285-330 kg · mm$^2$ | 295-320 kg · mm$^2$ | 300-315 kg · mm$^2$ |
| IZZ | 480-700 kg · mm$^2$ | 500-675 kg · mm$^2$ | 520-625 kg · mm$^2$ | 540-600 kg · mm$^2$ | 560-600 kg · mm$^2$ |
| CFX | 45-70 mm | 45-70 mm | 45-70 mm | 45-70 mm | 45-70 mm |
| CFY | 9-18 mm | 11-16 mm | 12-15 mm | 12.5-14.5 mm | 13-14 mm |
| CFZ | 35-45 mm | 37-43 mm | 38-41 mm | 38-40 mm | 38-40 mm |
| BP PROJ | −5 to 5 mm | −4 to 4 mm | −3 to 3 mm | −2 to 3 mm | −1 to 3 mm |
| BODY LIE (CASTING) | 53-60 degrees | 54-59 degrees | 55-58 degrees | 55-58 degrees | 55-58 degrees |
| ASM LIE (FCT IN STD) | 51.25-58.25 degrees | 52-57 degrees | 53-56.5 degrees | 53-56.5 degrees | 53-56.5 degrees |
| LOFT | 6-12 degrees | 7-12 degrees | 8-12 degrees | 8.5-12 degrees | 9-12 degrees |
| VOLUME | 390-500 cm$^3$ | 400-490 cm$^3$ | 410-480 cm$^3$ | 420-470 cm$^3$ | 430-465 cm$^3$ |

TABLE 2

| | Example 6 | Example 7 | Example 8 | Example 9 | Example 10 |
|---|---|---|---|---|---|
| MASS | 180-200 g | 182.5-197.5 g | 185-195 g | 185-194 g | 185-193 g |
| CGX | −5 to 5 mm | −4 to 4 mm | −3 to 3 mm | −2.5 to 2.5 mm | −1.5 to 1.5 mm |
| CGY | 33-50 mm | 35-47 mm | 35-45 mm | 35-44 mm | 36-44 mm |
| CGZ | −10 to 0 mm | −7 to −1 mm | −6 to −1.5 mm | −5 to −1.5 mm | −4 to −1.5 mm |
| ZUP | 18-30 mm | 20-28 mm | 21-27 mm | 22-27 mm | 23-27 mm |
| DELTA1 | 20-40 mm | 23-36 mm | 24-35 mm | 25-34 mm | 26-32 mm |
| DELTA2 | 34-42 mm | 35-40 mm | 35.5-39 mm | 35.5-38 mm | 35.5-38 mm |
| IXX | 300-440 kg · mm$^2$ | 310-430 kg · mm$^2$ | 320-420 kg · mm$^2$ | 340-420 kg · mm$^2$ | 360-420 kg · mm$^2$ |
| IYY | 265-350 kg · mm$^2$ | 275-340 kg · mm$^2$ | 285-330 kg · mm$^2$ | 295-320 kg · mm$^2$ | 300-315 kg · mm$^2$ |
| IZZ | 480-700 kg · mm$^2$ | 500-675 kg · mm$^2$ | 520-625 kg · mm$^2$ | 540-600 kg · mm$^2$ | 560-600 kg · mm$^2$ |
| CFX | 45-70 mm | 45-70 mm | 45-70 mm | 45-70 mm | 45-70 mm |
| CFY | 9-18 mm | 11-16 mm | 12-15 mm | 12.5-14.5 mm | 13-14 mm |
| CFZ | 35-45 mm | 37-43 mm | 38-41 mm | 38-40 mm | 38-40 mm |
| BP PROJ | −5 to 5 mm | −4 to 4 mm | −3 to 3 mm | −2 to 3 mm | −1 to 3 mm |
| BODY LIE (CASTING) | 53-60 degrees | 54-59 degrees | 55-58 degrees | 55-58 degrees | 55-58 degrees |
| ASM LIE (FCT IN STD) | 51.25-58.25 degrees | 52-57 degrees | 53-56.5 degrees | 53-56.5 degrees | 53-56.5 degrees |
| LOFT | 6-12 degrees | 7-12 degrees | 8-12 degrees | 8.5-12 degrees | 9-12 degrees |
| VOLUME | 390-500 cm$^3$ | 400-490 cm$^3$ | 410-480 cm$^3$ | 420-470 cm$^3$ | 430-465 cm$^3$ |

TABLE 3

| | Example 11 | Example 12 | Example 13 | Example 14 | Example 15 |
|---|---|---|---|---|---|
| MASS | 200-210 g | 201-209 g | 202-208 g | 202-207 g | 202-206 g |
| CGX | −5 to 5 mm | −4 to 4 mm | −3 to 3 mm | −2.5 to 2.5 mm | −1.5 to 1.5 mm |
| CGY | 38-50 mm | 39-47 mm | 40-45 mm | 41-45 mm | 42-45 mm |
| CGZ | −10 to 0 mm | −7 to −1 mm | −6 to −1.5 mm | −5 to −1.5 mm | −4 to −1.5 mm |
| ZUP | 18-30 mm | 20-28 mm | 21-27 mm | 22-27 mm | 23-27 mm |
| DELTA1 | 24-40 mm | 26-36 mm | 28-35 mm | 29-34 mm | 30-32 mm |
| DELTA2 | 34-42 mm | 35-40 mm | 35.5-39 mm | 35.5-38 mm | 35.5-37 mm |
| IXX | 340-450 kg · mm$^2$ | 350-445 kg · mm$^2$ | 360-440 kg · mm$^2$ | 370-435 kg · mm$^2$ | 380-430 kg · mm$^2$ |
| IYY | 265-350 kg · mm$^2$ | 275-340 kg · mm$^2$ | 285-330 kg · mm$^2$ | 295-320 kg · mm$^2$ | 300-315 kg · mm$^2$ |
| IZZ | 530-700 kg · mm$^2$ | 540-675 kg · mm$^2$ | 550-625 kg · mm$^2$ | 560-600 kg · mm$^2$ | 570-600 kg · mm$^2$ |
| CFX | 45-70 mm | 45-70 mm | 45-70 mm | 45-70 mm | 45-70 mm |
| CFY | 9-18 mm | 11-16 mm | 12-15 mm | 12.5-14.5 mm | 13-14 mm |
| CFZ | 35-45 mm | 37-43 mm | 38-41 mm | 38-40 mm | 38-40 mm |
| BP PROJ | −5 to 5 mm | −4 to 4 mm | −3 to 3 mm | −2 to 3 mm | −1 to 3 mm |
| BODY LIE (CASTING) | 53-60 degrees | 54-59 degrees | 55-58 degrees | 55-58 degrees | 55-58 degrees |
| ASM LIE (FCT IN STD) | 51.25-58.25 degrees | 52-57 degrees | 53-56.5 degrees | 53-56.5 degrees | 53-56.5 degrees |
| LOFT | 6-12 degrees | 7-12 degrees | 8-12 degrees | 8.5-12 degrees | 9-12 degrees |
| VOLUME | 390-500 cm$^3$ | 400-490 cm$^3$ | 410-480 cm$^3$ | 420-470 cm$^3$ | 430-465 cm$^3$ |

In the tables above, if a value is not defined herein, the definitions used in U.S. Pat. No. 10,195,497 and/or U.S. patent application Ser. No. 17/722,748 are to be applied, both of which are herein incorporated by reference in their entirety. As used in the tables above, "BP PROJ" means "projected CG location," also referred to as "balance point" projection, or "CG projection." In fact, CFZ is measured in the same manner as DELTA2, as defined in U.S. Pat. No. 10,195,497 but is measured to a projection of the center face in the y-axis direction, onto the imaginary vertical shaft axis plane thereby defining a point referred to as the CFZ point, and the shortest distance from the CFZ point to the shaft axis is the CFZ value.

In addition to the Ixx, Iyy, and Izz moments of inertia disclosed above, one skilled in the art will be familiar with the products of inertia Ixy, Ixz, Iyx, Iyz, Izx, and Izy. In one embodiment Ixy, Iyx, Iyz, and/or Izy is no more than 4.2 times Izx and/or Ixz, and in further embodiments no more than 4.1, 4.0, 3.9, 3.8, or 3.7. In another embodiment Ixy, Iyx, Iyz, and/or Izy is at least 3.0 times Izx and/or Ixz, and in further embodiments at least 3.1, 3.2, 3.3, 3.4, 3.5, or 3.6. In one embodiment Ixy, Iyx, Iyz, and/or Izy are no more than 520 g*cm$^2$, and in further embodiments no more than 510 g*cm$^2$, 500 g*cm$^2$, or 490 g*cm$^2$. In a further embodiment at least one of Iyz and Izy are at least 30 g*cm$^2$ less than Ixy, Iyx, Iyz, and/or Izy, and in further embodiments at least 35 g*cm$^2$ less, 40 g*cm$^2$ less, or 45 g*cm$^2$ less.

Figure 29B:
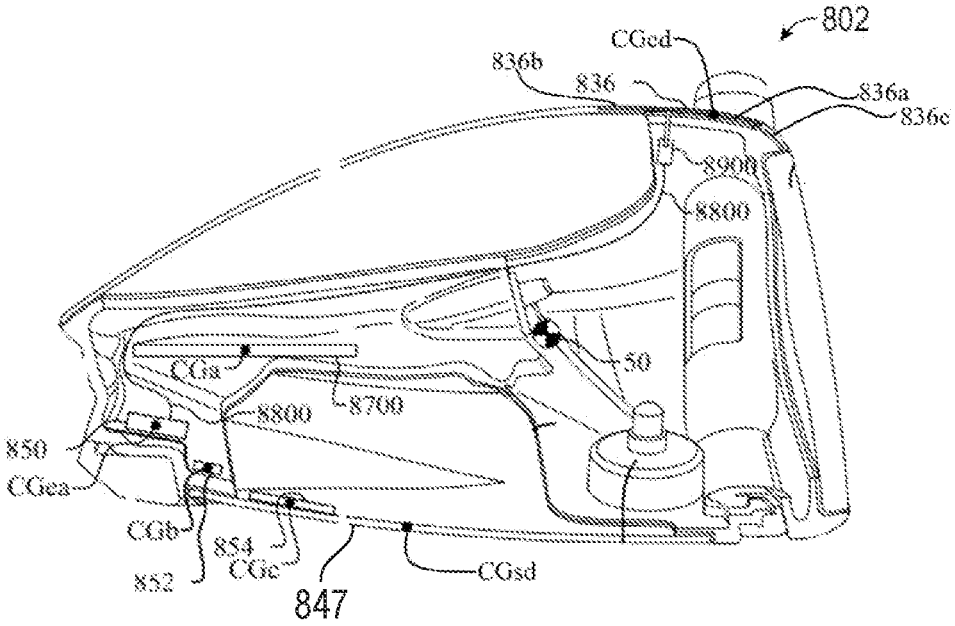
FIG. 29B shows a cross-sectional view of a golf club head with a plurality of displays, according to another example.

FIG. 29B illustrates the club head 802 comprising the plurality of crown displays 836*a*, 836*b*, 836*c*. In some embodiments, the crown display 836 and/or the sole display 847 may be comprised of two or more displays, or three or more displays, up to and including ten displays. Having additional displays may be beneficial for matching areas high curvature, highly changing curvature, or highly changing perimeter shape and geometry such as the crown 812 and/or the sole 814. For example, a single display may not be able to contort to the curvature of the crown 812 in some regions, but two or three displays could be used in conjunction to appear as a single display from the perception of the user and may better accommodate the curvature change along the crown 812 in the heel-toe direction and along the crown 812 in a fore to aft direction as the crown 812 and the plurality of crown displays 836*a*, 836*b*, 836*c* transition to the face region 816. In some instances, one of the plurality of crown displays 836*a*, 836*b*, 836*c* may overlap another one of the plurality of crown displays 836*a*, 836*b*, 836*c* or any other display (such as the face display 838) to make a more seamless transition or less apparent transition to the viewer of the display, especially when viewed from a distance. Furthermore, it should be understood that any other of the electronic displays disclosed in this application—such as the face display 838, the wraparound display 903, the golf bag electronic display (FIGS. 30-37) and/or the head cover electronic display (FIGS. 38-41)—can be embodied as a plurality of displays or display portions arranged to appear to the user as a single display.

Example 5: Representative Display Images

Figure 18A:
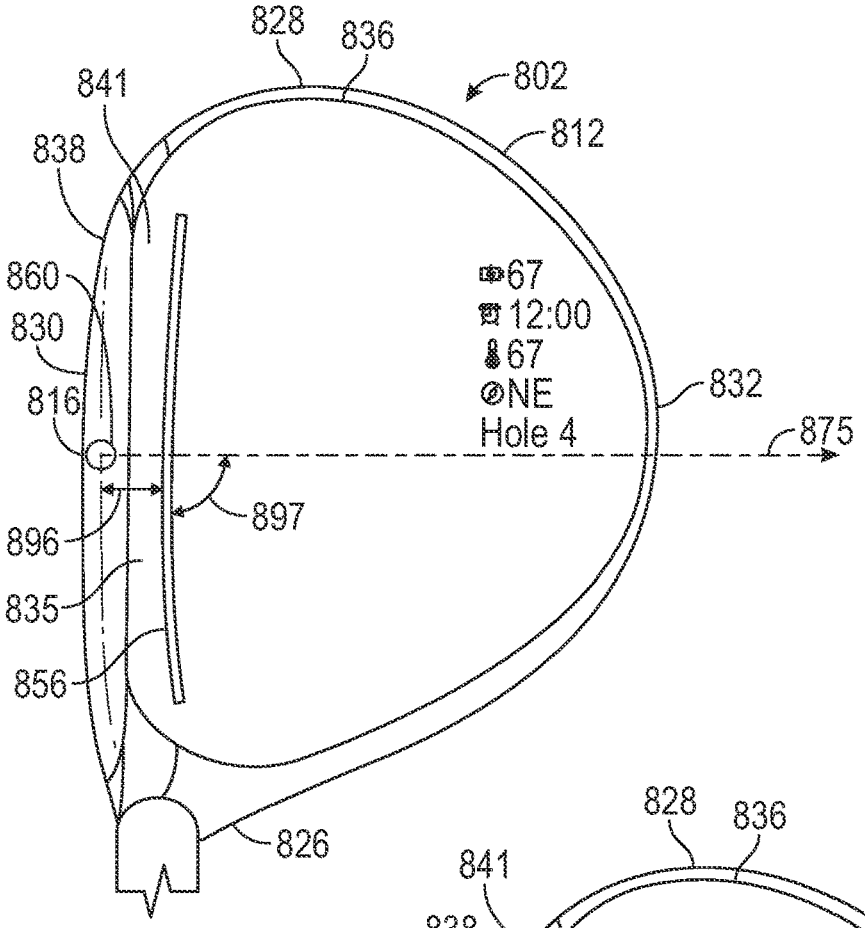
FIGS. 18A-18B show a top-down view of the golf club head of FIG. 16.
Figure 18B:
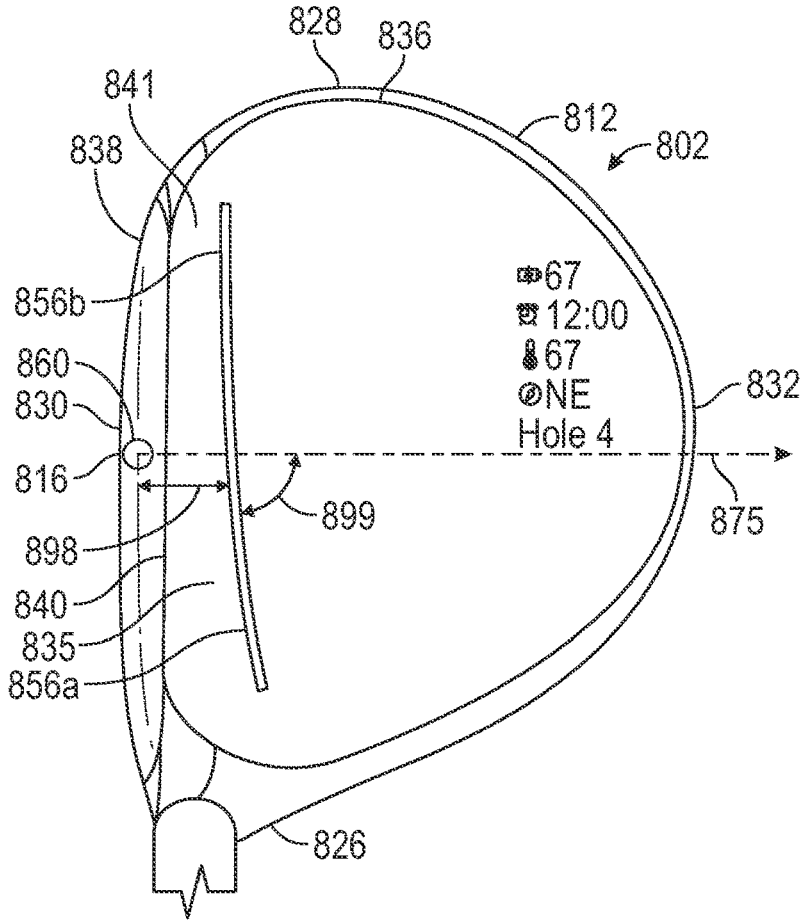

FIGS. 18A-18B show a set of exemplary alignment aides, crown alignment features, simulated toplines, topline alignment features, or visual cues, generically referred to as topline 835, that can be displayed to a user on the club head 802 with the crown display 836 and/or the face display 838. The visual cues can include any information that could be relevant to the user. Examples of visual cues can include alignment information (such as a topline, a dot, or one or more alignment aids or alignment indicators that help the user align the club head 802), weather conditions (such as wind speed, wind direction, humidity, or temperature), a time and/or date, geographic information (such as information regarding a layout of a particular hole or an elevation, a direction, or a distance of the club head 102 relative to a hole), score information (such as a score or a number of strokes), swing information (such as data about the user's stance, grip, or swing during a stroke or an impact location of a golf ball against the face 816), performance metrics (such as statistics comparing a particular golf stroke to past strokes, past games, other golfers' statistics, or known PGA professional statistics), launch monitor data, golfing tips (such as lessons or areas needing improvement), strategic advice, and situational messages (such as which club should or should not be used for a particular golf shot or stroke). Other examples of visual cues can include, but are not limited to, club information (such as a battery status or a wireless connectivity status of the electronic assembly 850 within the club head 802), a logo, a message, an advertisement, a decorative design, or any other text or image. The visual cues can be displayed on the crown display 836, the face display 838, the sole display 847, or any other electronic display on a golf club. Additionally or alternatively, the visual cues can be displayed on any one of a sole display on the sole 814 of the club head 802, a golf bag electronic display on a golf club bag, and/or a head cover electronic display on a golf club head cover.

The set of visual cues can comprise an image such as the image 856, also shown in FIG. 16, which can be manipulated by the crown display 836 and/or the face display 838 to change the appearance of the face-to-crown transition zone 841 and/or of the topline 835 from the perspective of the user. For example, the displayed image can be configured, sized, shaped, colored, etc., to change the position and/or orientation of the topline 835 relative to the face from the perspective of the user. In some examples, the image 856 can be configured to give the appearance of the topline 835 as being at a location on the club head 802 that is displaced a distance along the positive y-axis 875 (e.g., rearward) relative to the true position of the topline 835. In certain examples, the displayed image can be configured, sized, shaped, colored, etc., to make the face-to-crown transition zone 841 appear larger from the perspective of the user than the true size of the face-to-crown transition zone 841. In some examples, the displayed image can be configured, sized, shaped, colored, etc., to make the face-to-crown transition zone 841 appear to have a different shape from the perspective of the user than the true shape of the face-to-crown transition zone 841 (e.g., by making the topline 835 appear more open or more closed from the perspective of the user). In some examples, the image 856 can be configured to give the appearance of the topline 835 as being disposed at an angle relative to the face plane, wherein the angle is different than the true angle of the topline 835 relative to the face plane.

As shown in FIGS. 18A-18B, the image 856 can be an alignment indicator comprising a line extending across at the crown display 836 in the heel-toe direction and in the face-to-crown transition zone 841 or rearward of the face-to-crown transition zone 841. Although the illustrated image 856 comprises the line, the image 856 can have any form that gives the appearance of the topline 835 being at a specified location on, or a specified orientation relative to, the face plane and/or the user. In some examples, the image 856 can comprise another form of an alignment indicator such as an arrow, a dot, a textual message, etc. In some examples where the image 856 comprises a representation of the face-to-crown transition zone 841, the image 856 can comprise a first portion configured to resemble a front edge portion of the crown 812 and a second portion configured to resemble a top edge portion of the face 816. The first portion and the second portion can be translated, rotated, resized, recolored, reshaped, etc. either in unison or relative to each other to change the appearance (such as the size, shape, position, or angle) of the face-to-crown transition zone 841 from the perspective of the user. For example, at least one of the first portion and the second portion can be moved relative to the other along the y-axis (e.g., the positive y-axis 875) to increase or decrease the apparent size/width of the face-to-crown transition zone 841. In some examples where the image 856 comprises a representation of the topline 835, the image 856 representing the topline 835 can be moved, rotated, expanded, shrunk, etc. relative to the true topline 835, thereby changing the appearance of the topline 835 from the perspective of the user.

The image 856 may be displayed on the club head 802 at or near the face-to-crown transition zone 841, the topline 835, and/or the juncture 840 of the crown display 836 and the face display 838. Although the image 856 is shown on the crown display 836 in FIG. 18A, it should be understood that the image 856 can additionally or alternatively be displayed on the face display 838. For example, a first portion of the image 856 can be shown on the crown display 836 and a second portion of the image 856 can be shown on the face display 838.

The user can utilize the image 856 to align the club head 802 before a golf shot. For example, the user can align the club head 802 such that the image 856 is substantially perpendicular to a desired line of flight of a golf ball. Since the image 856 can be indicative of the angle of the topline 835, which in turn is indicative of the angle of the club head 802 relative to the user, aligning the image 856 with the golf ball such that the club head 802 contacts the golf ball with a neutral face can reduce a chance of slicing the golf ball. Alternatively, the user can align the club head 802 such that the image 856 is non-perpendicular to the desired line of flight to cause the golf ball to follow a curved flight trajectory (e.g., as in a fade or draw shot).

As shown in FIG. 18A, the image 856 can be displayed on at least one of the electronic displays (e.g., the crown display 836) in a first configuration. The first configuration of the image 856 can be aligned with the topline 835 of the club head 802. For example, the image 856 and the topline 835 can be disposed at the same angle relative to the club head 802 and/or be disposed the same distance along the positive y-axis 875 from a head origin 860. Thus, in the illustrated example, the image 856 is disposed a first distance 896 along the positive y-axis 875 from the head origin 860 and both the topline 835 and the image are disposed at a first angle 897 relative to the positive y-axis 875. In some examples, the first configuration can be a default configuration of the image 856. In some examples, the image 856 shown on the crown display 836 can be visually similar to the topline 835 of the club head 802.

As shown in FIG. 18B, the image 856 can be displayed on one or more of the electronic displays 836, 838 in a second configuration to compensate for idiosyncrasies in the user's posture, stance, swing, or style, thereby resulting in a more accurate golf shot. For example, if the user positions the club head 102 in a "closed" orientation at address (i.e., angled towards the user), the user's shots may have a tendency to veer to the left of the desired line of flight. However, the club head 802 can induce the user to squarely address the golf ball by displaying the image 856 at a second angle 899 relative to the positive y-axis 875, wherein the second angle 899 is different than the first angle 897 between the topline 835 and the positive y-axis 875. As shown, the image 856 is oriented such that the club head 802 appears in a more closed orientation. When the image 856 is transformed to the second configuration, the user will subsequently adjust the club head 802 to a more "open" orientation such that the image 856 becomes more perpendicular to the desired line of flight. As such, when the user addresses the golf ball, the face 816 can be substantially perpendicular to the desired line of flight, potentially leading to a shot trajectory that better follows the desired line of flight. It should be understood that in other examples, the image 856 can alternatively be angled such that image 856 induces the user to angle the club head 802 to a more "closed" orientation.

Additionally or alternatively, the image 856 can be translated along the positive y-axis 875 relative to the head origin 860 to change the appearance of the face-to-crown transition zone 841. As illustrated in FIG. 18B, the image 856 in the second configuration can be moved away from the head origin 860 in the direction of the positive y-axis 875 such that the image 856 is a second distance 898 from the head origin 860 along the positive y-axis 875. Since the user may associate the position of the image 856 with the position of the topline 835, moving the image 856 away from the head origin 860 along the positive y-axis 875 can change the appearance of the position of the topline 835 from the perspective of the user when the golf club head 802 is in the normal address position. Making the topline 835 appear closer to the rear portion 832 of the club head 802 can beneficially make the face 816 appear larger than it is, which can inspire confidence in the user. Where the image is a line as in FIGS. 18A and 18B, angling the line image or a portion of the line image relative to the y-axis 875 can also change the location of the line image along the y-axis, and thus the perceived position of the topline 835 from the perspective of the user. For example, where the image 856 is angled to make the face appear more closed as in FIG. 18B, the portion 856*a* of the image on the heelward side of the y-axis 875 can be more rearward along the y-axis than the portion 856*b* on the toeward side of the y-axis.

Additionally or alternatively, the shape of the image 856 can be changed to change the appearance of the face-to-crown transition zone 841. As illustrated in FIG. 18B, the shape of the image 856 in the second configuration can change such that the image 856 has a straight first portion 856*a* and a curved second portion 856*b*.

The controller of the electronic assembly 850 can send a signal to the electronic displays 836, 838 to show the image 856 in the second configuration based on any combination of data, inputs, or instructions (i.e., any combination of wireless communications, sensor data, user input, and/or computer-executable instructions).

In some examples, the controller of the electronic assembly 850 can send a signal to the electronic displays 836, 838 to show the image 856 in the second configuration based on data received from the one or more sensors of the electronic assembly 850. For example, the controller can send a signal to the electronic displays 836, 838 to show the image 856 in the second configuration based on data from the IMU suggesting that the golf club head 802 has moved away from a desired position or orientation.

In some examples, the controller of the electronic assembly 850 can send a signal to the electronic displays 836, 838 to show the image 856 in the second configuration based on input received by a user interface control of the electronic assembly 850. For example, the controller can send a signal to the electronic displays 836, 838 to show the image 856 in the second configuration based on the user's selection of an image configuration using a button, switch, dial, keypad, or touchpad coupled to the electronic assembly 850.

In some examples, the controller of the electronic assembly 850 can send a signal to the electronic displays 836, 838 to show the image 856 in the second configuration based on input received by a user interface control of the electronic assembly 850. For example, the controller can send a signal to the electronic displays 836, 838 to show the image 856 in the second configuration based on a wireless communication (e.g., a Bluetooth™ communication) received by the antenna of the electronic assembly 850 from an external device, such as a mobile computing device or a cloud computing server.

In some examples, the controller of the electronic assembly 850 can send a signal to the electronic displays 836, 838 to show the image 856 in the second configuration based on computer executable instructions stored in the memory of the electronic assembly 850. For example, the controller can send a signal to the electronic displays 836, 838 to show the image 856 in the second configuration based on a user preference saved to the memory.

The image 856 can be configured to have various sizes (e.g., lengths and widths) and/or colors. The image 856 can extend a partial or full length of an electronic display (such as the crown display 836 or the face display 838). In any examples described herein, a partial length of the electronic display can be a predefined percentage of the full length of the electronic display (e.g., along the x-axis), wherein the percentage can be any value between 0 and 100% (e.g., 10%, 20%, 25%, 33%, 40%, 50%, 67%, 75%, 80%, etc.). The image 856 can also be configured to have various line styles (e.g., solid, dashed, dotted, dash-dotted, etc.).

In some examples, the electronic assembly 850 can be configured to select a particular configuration (such as a particular size, shape, color, position, or orientation) of the image 856 to show on one or more of the electronic displays 836, 838. In some examples, the electronic assembly 850 can receive an instruction from an external device (such as a mobile computing device or a cloud computing server) to select a particular configuration of the image 856 to show on the electronic displays 836, 838. For example, the controller can be configured to receive data from the external device through the communication unit (such as communication connection 1070) and select a configuration of the image 856 on the electronic display based on the data received from the external device.

In certain examples, the electronic assembly 850 can receive an instruction from a shot tracker system. In some embodiments the shot tracker system can comprise an external device in wired or wireless communication with the electronic assembly. Example external devices can include a smartphone, a wearable device (such as a smartwatch), or a laptop with a shot tracker software application loaded therein. In other embodiments the shot tracker system can comprise a set of instructions loaded into the memory of the electronic assembly 850 or a computer module connected to the electronic assembly 850. Example shot tracker systems include the ARCCOS® shot tracker system.

In certain examples, the controller can be configured to adjust the image 856 (e.g., the size, shape, position, orientation, color, etc., of the image 856) in response to data collected from sensors on the golf club head 802 (e.g., the IMU, the piezoelectric layer of the face, etc.), and/or data from external sources. For example, if data received by the controller indicates that the user consistently hits shots that are more open than desired, the controller can adjust the image 856 displayed on the appropriate display to make the topline 835 appear more open so that the user adjusts their swing to be more closed.

In some examples, at least one of the electronic displays (such as the crown display 836 and the face display 838) can be configured as a segmented display, where a plurality of pre-configured line segments or shape segments can be independently turned on or off. The activation of individual segments can be based on a limited number of colors (e.g., 2, 3, 4, etc.). A selected number of segments forming a predefined shape or pattern (e.g., a straight line, a curved or angled line, a cross, one or more squares, one or more triangles, one or more circles, one or more polygons, e.g., hexagon or octagon, etc.) can be simultaneously activated to display the predefined shape or pattern. For example, the crown display 836 and/or the face display 838 can comprise a first set of pre-configured line segments corresponding to the first configuration of the image 856 (shown in FIG. 18A) and a second set of pre-configured line segments corresponding to the second configuration (e.g., an open or closed configuration) of the image 856 (shown in FIG. 18B). Additional sets of line segments may correspond to different configurations of alignment indicators (e.g., image 856) spaced along the heel-toe direction and/or along a front to rear direction of the electronic displays. In some examples, the user can use a mobile device to select the set of line segments (e.g., by selecting a position, orientation, shape, form factor, etc. of the alignment indicator on a mobile app) to show on the electronic displays.

In addition to common geometric shapes, the predefined shape could be a logo or one or more icons representing a shape such as a heart, power button (partial circle with a line bisecting the top of the circle), various emojis, a low battery icon or fully charged battery icon, or a temperature warning icon such as a thermometer for indicating excessive heat. Icons, dots, lines, and other shapes may be replicated at different positions, allowing for selectively moving the icon, dots, lines, or other shapes along the heel-toe direction and/or along a front to back direction of the electronic displays.

Because only a limited number of individually addressable line segments need to be turned on or off, using the segmented display may have certain benefits, such as a lower cost to customize and more energy efficient compared to matrix-based displays which rely on individual pixels to form an image or a shape pattern, which may cause pixelated lines in certain circumstances. In contrast, the segmented display can create crisp images and straight lines without the need for high matrix resolution. For example, a segmented display may have pre-defined shapes (angled lines, circles, curved features, etc.) that when turned on appear crisp to the eye. A segmented display may offer more crisp shapes that would only be achievable with a much higher resolution matrix display and much higher power consumption matrix display. Additionally, the segmented display can be used with or without a backlight and reduce power dissipation within the electronic system, may require only minimal componentry, do not require drivers, is easy to produce, and can result in robust field operation.

Figure 19:
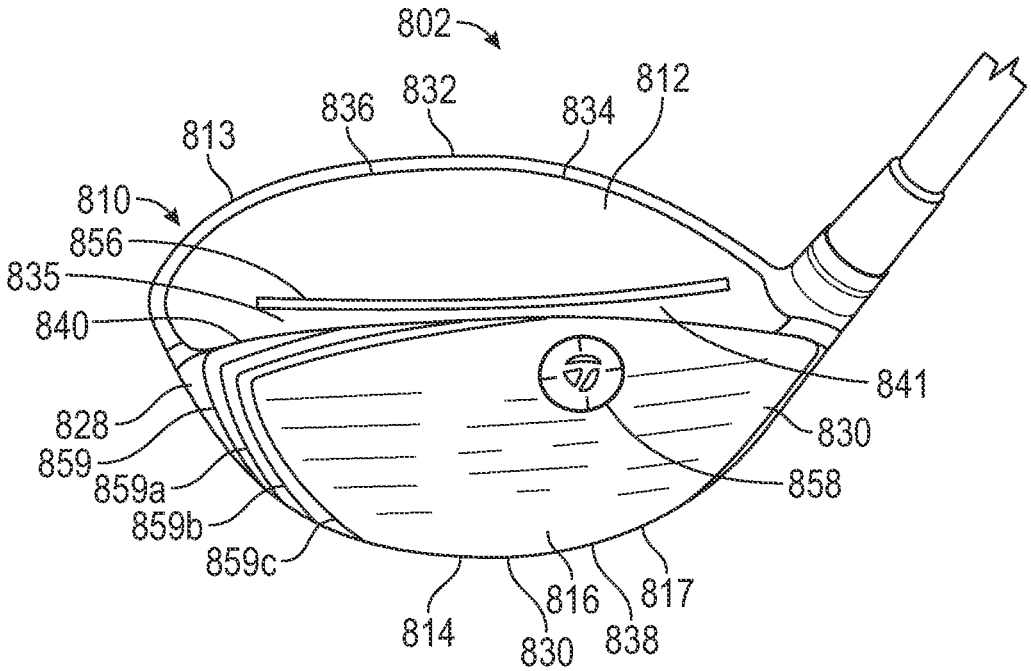
FIG. 19 shows a front view of a golf club head with a display, according to a third example.

FIG. 19 shows a front view of the golf club head 802 with electronic paper displays. As previously discussed in connection with FIG. 17, the club head 802 can be configured to display an impact location on the face 816, thereby allowing the user to see where the golf ball contacts the club head 802 after a shot. In response to receiving a signal from the piezoelectric layer 844 indicating that the golf ball has contacted the face 816, the controller can be configured to determine the location of the impact between the golf ball relative to the face 816. The controller can subsequently send a signal to the face display 838 to display an impact indicator 858 at the impact location. Although the impact indicator 858 is illustrated as an image logo surrounded by a circle, the impact indicator 858 can have any appropriate shape, color, or form factor. For example, other embodiments of the impact indicator 858 can comprise a heat map of contact pressures on the face 816, an arrow or line indicating a distance and/or direction between the impact location and an ideal impact location (which in some examples can be similar to ideal impact location 23), etc. In some examples, the face display 838 can additionally or alternatively be configured to display an indicator at the ideal impact location. The controller can send a signal to the face display 838 to stop showing the impact indicator 858 based on any combination of sensor input (e.g., a detected movement of the club head 802), user input, an elapsed time, a wireless communication, etc. In some examples, the face display 838 can comprise a set of pre-configured segments (e.g., circles, pixels, logos, etc.) corresponding to various possible positions of the impact indicator 858 on the face 816. In certain examples, the memory of the electronic assembly 850 can store data of multiple impact locations (e.g., from a golfing session) and can recall and display all or a portion of the stored impact locations on the face display at the same time.

The face display 838 can further display a border 859 outlining the face 816. In some examples, at least a portion of the border 859 can define a boundary between the crown and the face 816. In some examples, the size, shape, or configuration of the border 859 can be adjusted. In some examples where the face display 838 is a segmented display, the face display 838 can comprise one or more sets of pre-configured line segments corresponding to different border configurations 859*a*, 859*b*, 859*c*.

Example 6: Additional Golf Club Heads with Wraparound Electronic Displays

Figure 20:
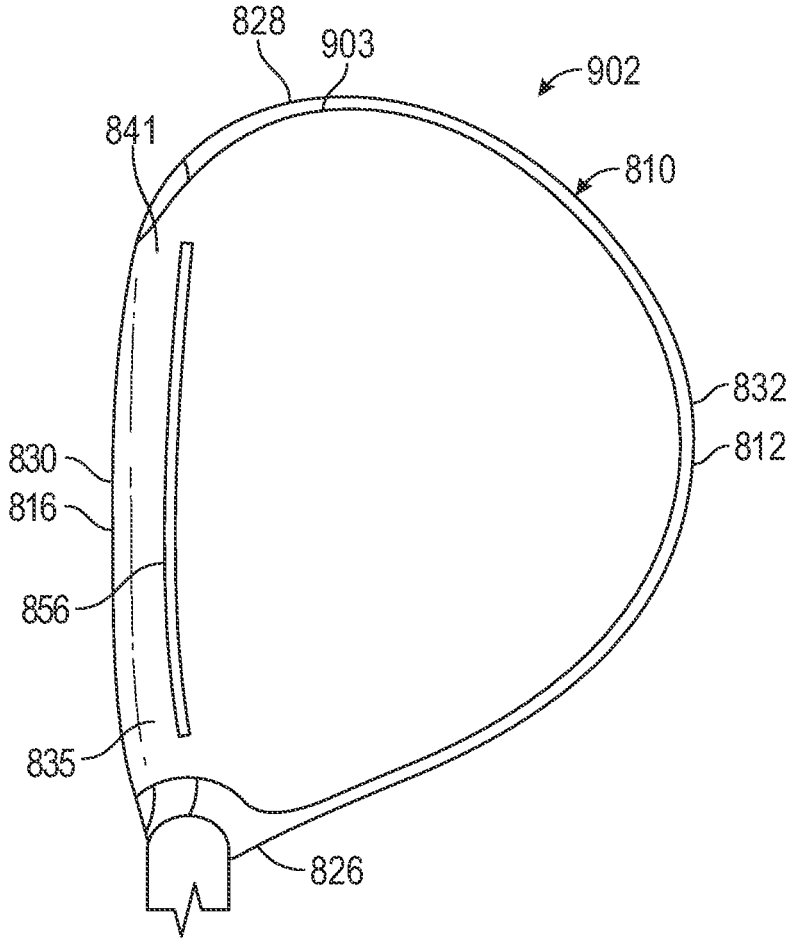
FIG. 20 shows a golf club head having a display, according to a fourth example.

FIG. 20 shows an example club head 902 configured to provide a visual cue to the golfer, according to one example. One exemplary difference between the club head 902 and the club head 802 shown in FIGS. 16, 17, and 18A-18B is that the club head 802 shown in FIG. 20 can comprise a single electronic display 903 (which is also referred to herein as a "wraparound display") instead of a plurality of displays (such as crown display 836 and face display 838). The wraparound display 903 can be configured to cover multiple surfaces of the club head 902, such as the crown 812, the face 816, the face-to-crown transition zone 841 (e.g., including the topline 835), and/or the crown-to-skirt transition zone 845. In some examples, the wraparound display 903 can be configured to cover at least a portion of each of the crown 812, the face 816, and the face-to-crown transition zone 841. In some examples, the wraparound display 903 can cover the entirety of the crown insert 813, the entirety of the face insert 817, and the entirety of the portion of the face-to-crown transition zone 841 disposed between the crown insert 813 and the face insert 817. The wraparound display 903 can be configured to show any of the visual cues (such as the image 856 and/or the impact indicator 858) illustrated in or described in connection with the figures.

In some examples, the wraparound display 903 can be an electronic paper display. In some examples, a piezoelectric layer (such as piezoelectric layer 844) can be disposed on the face 816 under the wraparound display 903 to detect an impact between the electronic display and a golf ball. In some examples, the wraparound display 903 can be a segmented display.

As noted above, each of the crown display and/or the face display in any of the examples herein can comprise any one of a liquid crystal (LCD) display, a light-emitting diode (LED) display, an organic light emitting diode (OLED) display, an active-matrix organic light-emitting diode (AMOLED) display, an electroluminescent display, a plasma display, a thin-film transistor (TFT) display, and/or an electronic paper display such as an electrophoretic display, an electrowetting display, an electrochromic display, or any other type of electronic display. In other examples, the golf club heads described herein can include a single display, such as a crown display only or a face display only.

Example 7: Mobile Communication

As described above, the electronic assembly 850, the golf bag and/or the golf bag electronic display coupled to the golf bag (FIGS. 30-37), and/or the head cover and/or the head cover electronic display coupled to the head cover (FIGS. 38-41) can wirelessly communicate with a mobile computing device, which can be a smart phone, a smart watch, a personal digital assistant (PDA), a tablet, or other types of wearable/portable device. The wireless communication can be in the form of Bluetooth™, Bluetooth Low Energy, WiFi, cellular, Wireless USB, etc. The mobile computing device can receive data measured by the sensors located on the various club heads disclosed in this application. All information presented on the electronic display(s) (such as crown display 836, face display 838, and wraparound display 903) of can be displayed on the mobile computing device. In addition, the mobile computing device can be configured to perform additional analysis of the position and/or motion data and provide instructions and/or recommendations for the golfer. In certain examples, the mobile computing device can further transmit the sensor measured data to a remote server, which can cloud source data measured from different golfers and perform more advanced analysis and provide individualized recommendations or training modules. Communication between the mobile computing device and the remote server is described further below in "Example Cloud Computing Environment."

Example 8: Representative Computing Systems

Figure 21:
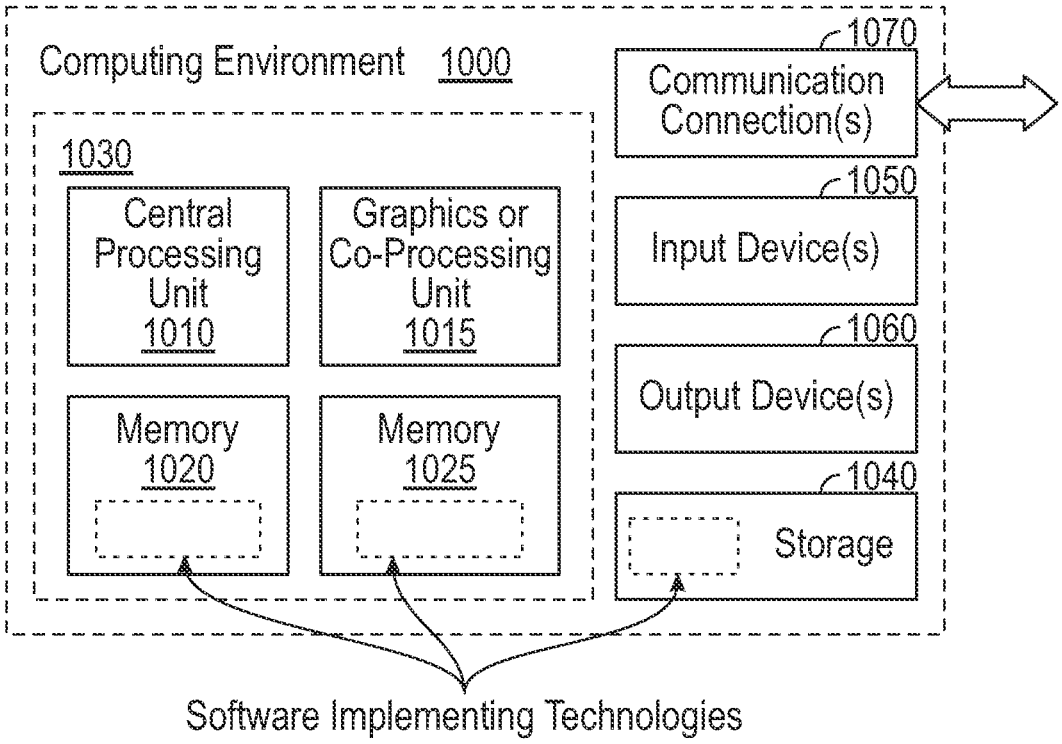
FIG. 21 shows a block diagram of an example computing system in which described examples can be implemented.

FIG. 21 depicts an example of a suitable computing system 1000 in which the described innovations can be implemented. The computing system 1000 is not intended to suggest any limitation as to scope of use or functionality of the present disclosure, as the innovations can be implemented in diverse computing systems.

With reference to FIG. 21, the computing system 1000 can include one or more processing units 1010, 1015 and memory 1020, 1025. In FIG. 21, this basic configuration 1030 is included within a dashed line. The processing units 1010, 1015 can execute computer-executable instructions, such as for implementing the features described in the examples herein. A processing unit can be a general-purpose central processing unit (CPU), processor in an application-specific integrated circuit (ASIC), or any other type of processor. In a multi-processing system, multiple processing units can execute computer-executable instructions to increase processing power. For example, FIG. 21 shows a central processing unit 1010 as well as a graphics processing unit or co-processing unit 1015. The tangible memory 1020, 1025 can be volatile memory (e.g., registers, cache, RAM), non-volatile memory (e.g., ROM, EEPROM, flash memory, etc.), or some combination of the two, accessible by the processing unit(s) 1010, 1015. The memory 1020, 1025 can store software implementing one or more innovations described herein, in the form of computer-executable instructions suitable for execution by the processing unit(s) 1010, 1015.

The computing system 1000 can have additional features. For example, the computing system 1000 can include storage 1040, one or more input devices 1050 (such as the IMU described above), one or more output devices 1060 (such as the crown display 836, the face display 838, the wraparound display 903, golf bag electronic display, and/or head cover electronic display), and one or more communication connections 1070, including input devices, output devices, and communication connections for interacting with a user. An interconnection mechanism such as a bus, controller, or network can interconnect the components of the computing system 1000. Typically, operating system software can provide an operating environment for other software executing in the computing system 1000, and coordinates activities of the components of the computing system 1000.

The tangible storage 1040 can be removable or non-removable, and includes magnetic disks, magnetic tapes or cassettes, CD-ROMs, DVDs, or any other medium which can be used to store information in a non-transitory way and which can be accessed within the computing system 1000. The storage 1040 can store instructions for the software implementing one or more innovations described herein.

The input device(s) 1050 can be an input device such as a keyboard, mouse, pen, or trackball, a voice input device, a scanning device, touch device (e.g., touchpad, display, or the like) or another device that provides input to the computing system 1000. The output device(s) 1060 can be a display, printer, speaker, CD-writer, or another device that provides output from the computing system 1000. For example, the input device(s) 1050 can include the one or more sensors (e.g., the IMU) described above or one or more of the various piezoelectric layers 844 described above.

Some examples of the output device(s) 1060 can include the various electronic displays 836, 838, 903 described above.

The communication connection(s) 1070 can enable communication over a communication medium to another computing entity. The communication medium can convey information such as computer-executable instructions, audio or video input or output, or other data in a modulated data signal. A modulated data signal is a signal that has one or more of its characteristics set or changed in such a manner as to encode information in the signal. By way of example, and not limitation, communication media can use an electrical, optical, RF, or other carrier. In one specific example, the communication connection(s) 1070 can include a communication unit (e.g., a Bluetooth module) of the electronic assembly 850 described above which is configured to wirelessly communicate with a mobile computing device.

The innovations can be described in the context of computer-executable instructions, such as those included in program modules, being executed in a computing system on a target real or virtual processor (e.g., which is ultimately executed on one or more hardware processors). Generally, program modules or components include routines, programs, libraries, objects, classes, components, data structures, etc. that perform particular tasks or implement particular abstract data types. The functionality of the program modules can be combined or split between program modules as desired in various examples. Computer-executable instructions for program modules can be executed within a local or distributed computing system.

For the sake of presentation, the detailed description uses terms like "determine" and "use" to describe computer operations in a computing system. These terms are high-level descriptions for operations performed by a computer and should not be confused with acts performed by a human being. The actual computer operations corresponding to these terms vary depending on implementation.

Example 9: Computer-Readable Media

Any of the computer-readable media herein can be non-transitory (e.g., volatile memory such as DRAM or SRAM, nonvolatile memory such as magnetic storage, optical storage, or the like) and/or tangible. Any of the storing actions described herein can be implemented by storing in one or more computer-readable media (e.g., computer-readable storage media or other tangible media). Any of the things (e.g., data created and used during implementation) described as stored can be stored in one or more computer-readable media (e.g., computer-readable storage media or other tangible media). Computer-readable media can be limited to implementations not consisting of a signal.

Any of the methods described herein can be implemented by computer-executable instructions in (e.g., stored on, encoded on, or the like) one or more computer-readable media (e.g., computer-readable storage media or other tangible media) or one or more computer-readable storage devices (e.g., memory, magnetic storage, optical storage, or the like). Such instructions can cause a computing device to perform the method. The technologies described herein can be implemented in a variety of programming languages.

Example 10: Cloud Computing Environment

Figure 22:
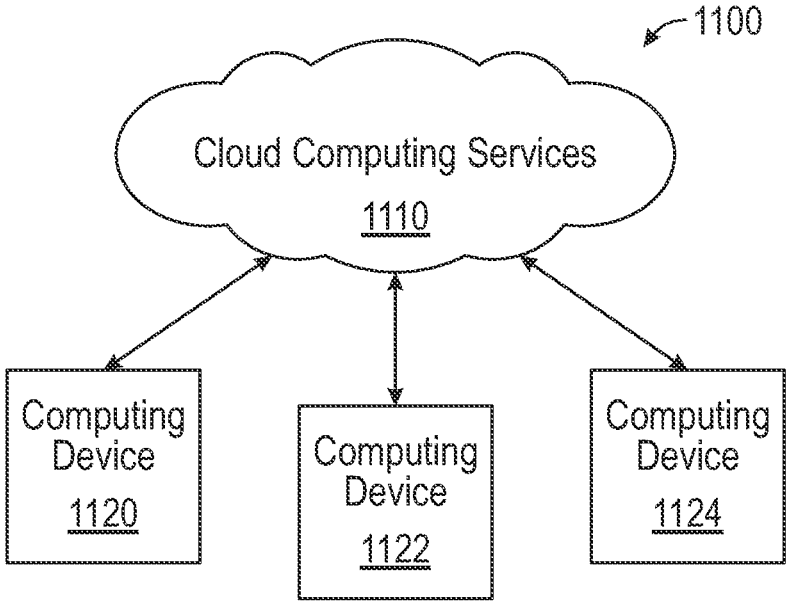
FIG. 22 shows a block diagram of an example cloud computing environment that can be used in conjunction with the technologies described herein, according to one example.

FIG. 22 depicts an example cloud computing environment 1100 in which the described technologies can be implemented, including, e.g., the system disclosed above and other systems herein. The cloud computing environment 1100 can comprise cloud computing services 1110. The cloud computing services 1110 can comprise various types of cloud computing resources, such as computer servers, data storage repositories, networking resources, etc. The cloud computing services 1110 can be centrally located (e.g., provided by a data center of a business or organization) or distributed (e.g., provided by various computing resources located at different locations, such as different data centers and/or located in different cities or countries).

The cloud computing services 1110 can be utilized by various types of computing devices (e.g., client computing devices), such as computing devices 1120, 1122, and 1124. For example, the computing devices (e.g., 1120, 1122, and 1124) can be computers (e.g., desktop or laptop computers), mobile devices (e.g., tablet computers or smart phones), or other types of computing devices. For example, the computing devices (e.g., 1120, 1122, and 1124) can utilize the cloud computing services 1110 to perform computing operations (e.g., data processing, data storage, and the like).

In practice, cloud-based, on-premises-based, or hybrid scenarios can be supported.

Example 11: Golf Bags and Head Covers with Electronic Displays

FIGS. 30-41 illustrate embodiments of golf bags and head covers having electronic displays. All of the prior disclosure relating to electronic displays applies equally to the golf bag electronic displays and the head cover electronic displays. Further, in one particular embodiment the golf bag electronic display and/or the head cover electronic display is a non-rigid electronic display. As used herein a non-rigid display is one in which the display is pliable and functional when bent such that a portion of the display is non-planar and characterized by a radius of curvature of less than β mm, wherein in one embodiment β is 1000 mm, and in further embodiments β is 900, 800, 700, 600, 500, 400, 300, 200, or 100 mm. In another embodiment the golf bag electronic display and/or the head cover electronic display is a display having a curved resting state, meaning it may be rigid or non-rigid, and has a radius of curvature of less than β mm when not acted upon by external forces; wherein in one embodiment β is 1000 mm, and in further embodiments β is 900, 800, 700, 600, 500, 400, 300, 200, or 100 mm. As previously noted, the golf bag or head cover may contain the disclosed electronic assembly 850, or any of the disclosed individual electronic components such as a controller, one or more memory units, one or more sensors, a communication unit (which is also referred to herein as a "communication connection"), one or more batteries, storage devices, connecting wires, antenna, coil, and/or input/output (I/O) ports.

FIGS. 30-37 illustrate embodiments of a golf bag 1200 comprising at least one golf bag electronic display 1236. All of the prior disclosure relating to electronic displays, and in particular to electronic paper displays, flexible/non-rigid displays, and/or segmented displays, applies equally to the golf bag electronic display 1236. In one embodiment the golf bag electronic display 1236 can be a non-rigid or flexible electronic display. In one embodiment the golf bag electronic display 1236 can comprise a plastic backplane or a thin-film backplane that can conform to a surface of the golf bag 1200.

As shown in FIGS. 30-33, the golf bag electronic display 1236 can be disposed on an outer surface of the golf bag 1200. The golf bag electronic display 1236 can be disposed on any portion of the outer surface of the golf bag 1200. For example, the golf bag electronic display 1236 can be disposed on portions or entireties of outer surfaces of a center, an apparel pocket, a shoulder strap, an accessories pocket, a ball pocket, etc. of the golf bag 1200. The outer surface of the golf bag 1200 can define a golf bag outer surface area. The golf bag electronic display 1236 can define a golf bag electronic display surface area. The golf bag electronic display surface area relative to the golf bag outer surface area can have any ratio, such as from 10% to 100%, 10% to 90%, 25% to 100%, 50% to 100%, 20% to 80%, 30% to 70%, at least 25%, at least 40% or at least 50%. In certain examples, the golf bag 1200 can comprise a plurality of golf bag electronic displays 1236 disposed in any configuration or arrangement.

The golf bag electronic display 1236 can be configured to show one or more visual cues to a user of the golf bag 1200. The visual cues can comprise any combination of the visual cues disclosed in this application, including alignment information (such as a message indicating alignment between a golf ball and a golf club head), weather conditions (such as wind speed, wind direction, humidity, or temperature), a time and/or date, geographic information (such as information regarding a layout of a particular hole or an elevation, a direction, or a distance of the golf bag 1200, a golf club, a golf ball, a golf cart, a mobile device, or a user relative to a hole), score information (such as a score or a number of strokes), swing information (such as data about the user's stance, grip, or swing during a stroke), performance metrics (such as statistics comparing a particular golf stroke to past strokes, past games, other golfers' statistics, or known PGA professional statistics), launch monitor data, golfing tips (such as lessons or areas needing improvement), strategic advice, and situational messages (such as which club should or should not be used for a particular golf shot or stroke). Other examples of visual cues can include, but are not limited to, golf bag status information (such as a battery status or a wireless connectivity status of an electronic assembly or computing system coupled to a golf bag), a logo, a message, an advertisement, a decorative design, an indication of contents stored in the golf bag 1200 (such as an inventory of golf clubs, golf balls, or other golfing equipment stored in the golf bag 1200, an inventory of contents missing from the golf bag 1200, or the status or condition of contents stored in the golf bag 1200), or any other text or image such as a corporate logo.

Figure 31:
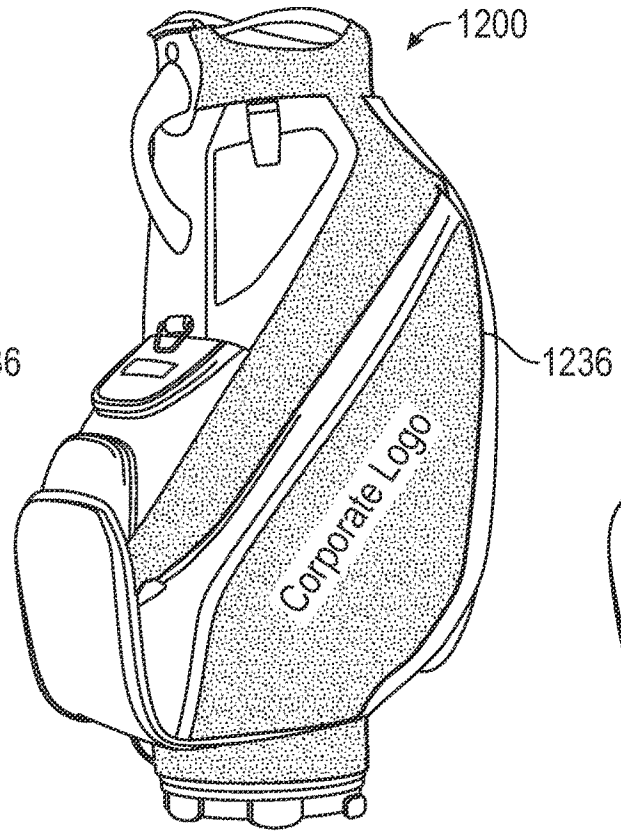
FIG. 31 shows a front view of a golf bag with a display, according to another example.
Figure 30:
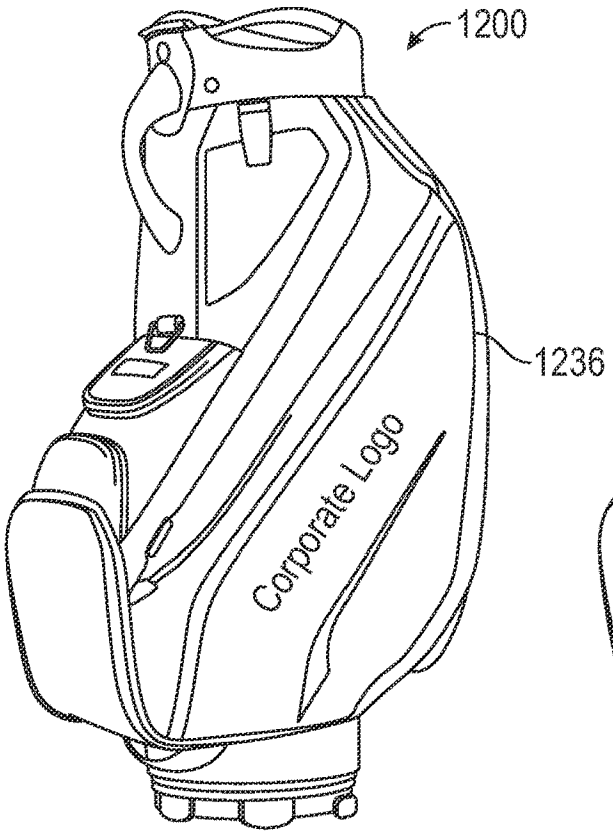
FIG. 30 shows a front view of a golf bag with a display, according to another example.

In some embodiments, such as the embodiments illustrated in FIGS. 30-31, the golf bag electronic display 1236 can be configured to change an apparent exterior color of the golf bag 1200, such that the golf bag 1200 appears to change colors from the perspective of a user or a viewer (such as a spectator viewing a golf game involving a user of the golf bag 1200). For example, the golf bag 1200 is shown in FIG. 30 in a first configuration, wherein the golf bag electronic display 1236 is sized and shaped to display a first image that makes a portion or the entirety of the golf bag 1200 appear a first color to the user or viewer. The golf bag electronic display 1236 can change (for example, based on input from an external computing device, cloud computing server, user input, sensor data, etc.) such that the golf bag electronic display 1236 displays a second image that makes the portion or the entirety of the golf bag 1200 appear a second color to the user or viewer. In some examples, the golf bag 1236 can change from displaying the first image to displaying the second image based on input received over a wireless connection from an external computing device or an external server controlled by someone other than the user or the viewer (for example, a sponsor as defined in this application, a golf course operator, a third party advertiser, a manufacturer or retailer of the golf bag 1200, etc.).

Figure 32:
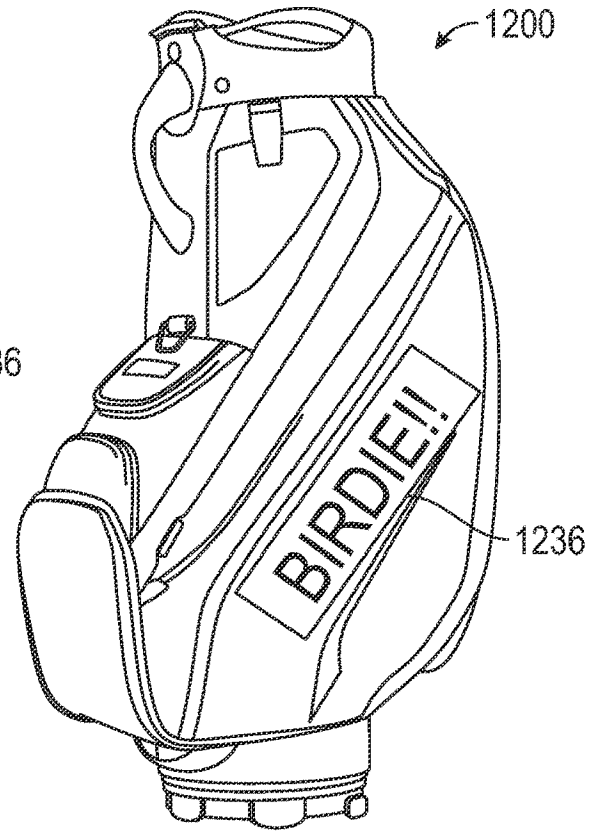
FIG. 32 shows a front view of a golf bag with a display, according to another example.

In some embodiments, such as the embodiment illustrated in FIG. 32, the golf bag electronic display 1236 can be disposed on a pocket of the golf bag 1236. The pocket can be any one of an apparel pocket, an accessories pocket, a ball pocket, etc. In other embodiments the golf bag electronic display 1236 can be disposed on any other portion of the golf bag 1200. The golf bag electronic display 1236 can be configured to display a situational message to the user of the golf bag 1200. For example, the golf bag electronic display 1236 can display a situational message indicating a score (e.g., a birdie) to the user. In certain examples, the golf bag electronic display 1236 can be configured to change such that the situational message is displayed rather than the corporate logo shown in FIGS. 30-31.

Figure 33:
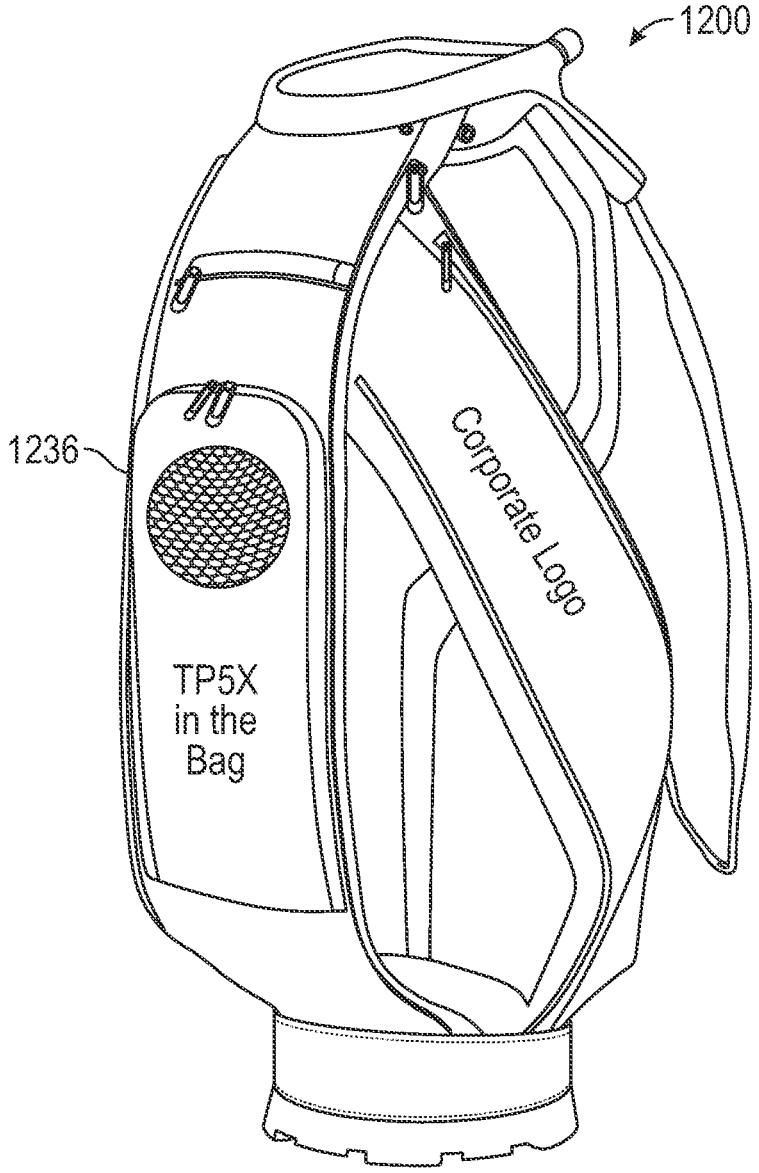
FIG. 33 shows a front view of a golf bag with a display, according to another example.

In some embodiments, such as the embodiment illustrated in FIG. 33, the golf bag electronic display 1236 can be disposed on a pocket of the golf bag 1236. The pocket can be any one of an apparel pocket, an accessories pocket, a ball pocket, etc. The golf bag electronic display 1236 can be configured to display a partial or entire inventory of the golf bag 1200 to the user of the golf bag 1200 or to another viewer (for example, a bystander or a spectator watching the user play a golf game). In some embodiments, the partial or entire inventory can comprise a make and/or model of a golf club being currently stored in the golf bag 1200. In some embodiments, the partial or entire inventory can comprise a make and/or model of a golf club removed from the golf bag 1200, e.g., a golf club removed by the user to play a round of golf.

Example 12: Electronic Display Controllable by a Sponsor and Information Targeted at a Spectator The golf bag electronic display 1236 on the golf bag 1200 is a feature that allows a sponsor of a tournament or a sponsor of a tour player to control what is displayed on the golf bag 1200. Unless otherwise stated, the term "sponsor" refers interchangeably to both a tournament sponsor and a player sponsor. The golf bag electronic displays 1236 in these examples are controllable by sponsors and not by the player. Multiple golf bags 1200 can be present on the course at any given time and each golf bag 1200 can have one or more golf club displays 1236, which can be controlled separately by one or a plurality of third parties, such as sponsors. The golf club display 1236 can show various messages, images, or advertisements, promotions, including birdie, score relative to par, logos, hole number, distance to hole, tournament ranking, season long ranking, world ranking, golf equipment used, weather, elevation, adjusted yardage based on weather and elevation, safety messages and other messages to spectators e.g., "lightning predicted in 30 minutes, please evacuate course and head for nearest shelter or nearest exit," and more. The display 1236 may also be used to change the look and appearance of the golf bag 1200. For example, as shown in FIGS. 30-31, the golf bag 1200 may be changed based on input from the sponsor from red to black or to various patterns and images. Or, the golf bag electronic display 1236 could have a specific theme such as a Masters theme (e.g., green with azaleas) or a U.S. OPEN® theme. This would potentially allow a sponsor to easily change the look and appearance of the golf bag 1200 every week or daily without the waste of creating a whole new golf bag. In these embodiments, an individual golf player does not have control over the content displayed on the golf bag electronic display 1236. In certain instances the content displayed by the golf bag electronic display 1236 may not relevant to the golf player (i.e., the user of the golf bag 1200). Instead, the content displayed by the golf bag electronic display 1236 would more likely be relevant to a spectator either at the golf course or a spectator watching remotely.

Each of the golf bag electronic displays 1236 may be capable of wireless communication using WiFi, 5G, cellular data, a WiFi mesh, Bluetooth, NFC, RFID, and the like. The golf course may be temporarily wired with one or more WiFi hotspots or a WiFi mesh to support the tournament, or the individual electronic displays may rely on cellular data to send and receive information. The golf bag electronic displays 1236 may further be connected to memory, storage, a CPU, a GPU, GPS, IMU(s), buttons, various input/output ports, charging port, or coil for inductive charging, and other common components (e.g., components similar to those forming computing system 1000) included in most smart devices. This would allow for remote control of the golf bag electronic displays 1236 by a sponsor. Alternative embodiments may be preprogrammed with content that is triggered to play once the golf bag 1200 enters a prescribed geo-location or geo-fence, or after prescribed time limits. Alternatively, other embodiments of golf bags 1200 and/or golf bag electronic displays 1236 may be preprogrammed with content, but not change until additional programming instructions are received, or not change based on location, or not change based on prescribed time. For example, a logo or bag color on the golf bag electronic display 1236 may stay the same throughout the tournament. The programming instructions could be stored in storage or memory (e.g., storage or memory similar to memory 1020, 1025).

Each golf bag 1200 and each golf bag electronic display 1236 may be individually controlled by the sponsor to show unique messages, for example birdie or score relative to par (as shown in FIG. 32), or unique images such as a logo for the tournament or a logo of the sponsor, or the same message (sponsor name "TaylorMade" or tournament name) or same image. Other examples of messages include hole number, hole layout and overall distance (yards or meters), distance to hole (yards or meters), informational naming, overall ranking in the tournament or season long ranking, make percentage, advertising, what golf clubs or golf ball is in the golf bag. For example, as shown in FIG. 33, the golf bag electronic display 1236 can be configured to display a logo such as "TP5x in the bag" or "Spider tour putter in the bag."

The golf bag electronic display 1236 can be configured to display situational messages to user(s) of the golf bag 1200, spectator(s), and/or other viewer(s). In one example, the golf bag electronic display 1236 can display a situational message comprising. "Congratulations! Hole-in-One on Hole 5 with TaylorMade STEALTH® Driver!" This message can be displayed on the golf bag electronic display 1236 after a golfer has scored a hole-in-one on a particular hole using a specific club (in this case, a TaylorMade STEALTH® Driver). This not only showcases the golfer's achievement but also promotes the sponsor's brand and product.

Figure 34:
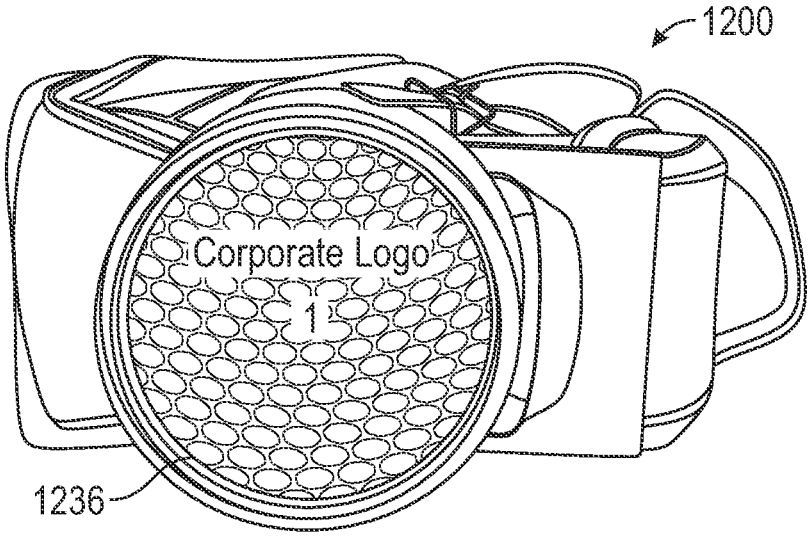
FIG. 34 shows a bottom view of a golf bag with a display, according to another example.
Figure 35:
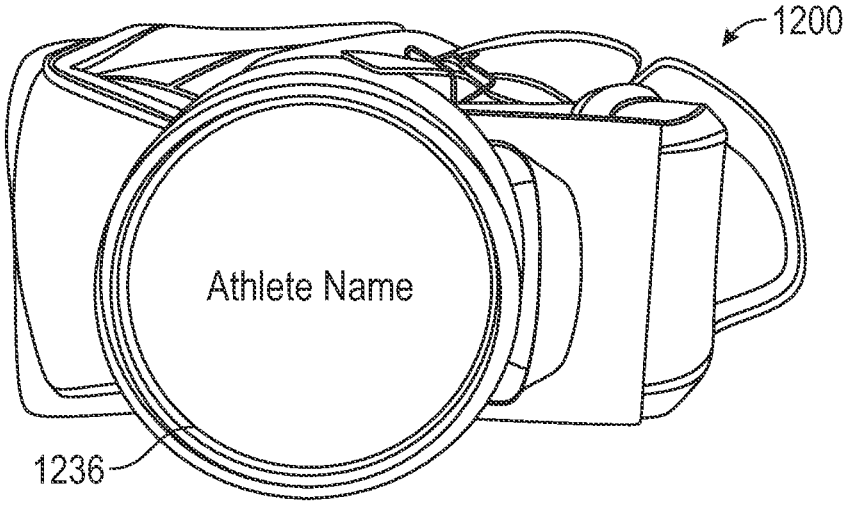
FIG. 35 shows a bottom view of a golf bag with a display, according to another example.
Figure 36:
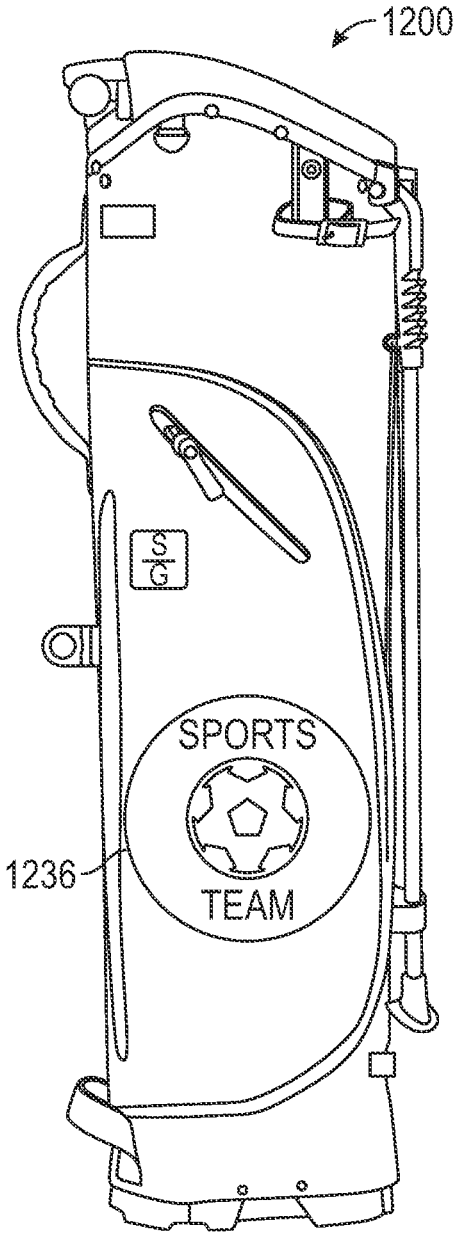
FIG. 36 shows a side view of a golf bag with a display, according to another example.

As shown in FIGS. 34-36, the golf bag electronic display 1236 can additionally or alternatively be configured to display a team logo or sponsor logo on a side portion and/or a bottom portion of the golf bag 1200. For example, as shown in FIG. 34, the golf bag electronic display 1236 can be disposed on the bottom portion (e.g., a bottom surface of the golf bag 1200 as defined when the golf bag 1200 is in an upright position) of the golf bag 1200 and can be configured to show a logo (e.g., a logo comprising a stylized golf ball) to a user, spectator, and/or other viewer when the golf bag 1200 is not in an upright position. As shown in FIG. 35, the golf bag electronic display 1236 can be configured to show an athlete's name (such as the name of a sponsored athlete and/or the user of the golf bag 1200) when the golf bag 1200 is not in an upright position. As shown in FIG. 36, the golf bag electronic display 1236 can be disposed on the side portion of the golf bag 1200 and can be configured to display a logo, e.g., a logo of a sports team selected based on input from the user of the golf bag 1200 or the sponsor or selected based on preprogrammed instructions from a computing system operably coupled to the golf bag electronic display 1236.

This provides a unique opportunity for the sponsor to showcase their brand and increase visibility. The logos can be displayed consistently or alternated with other messages, such as player performance updates, tournament information, and other advertisements. The golf bag electronic display 1236 can be highly customizable, allowing the sponsor to control the content displayed and ensure their brand is prominently featured. This not only promotes the sponsor's brand but also enhances the overall look of the golf bag 1200 and adds a modern touch to the sport.

Figure 37:
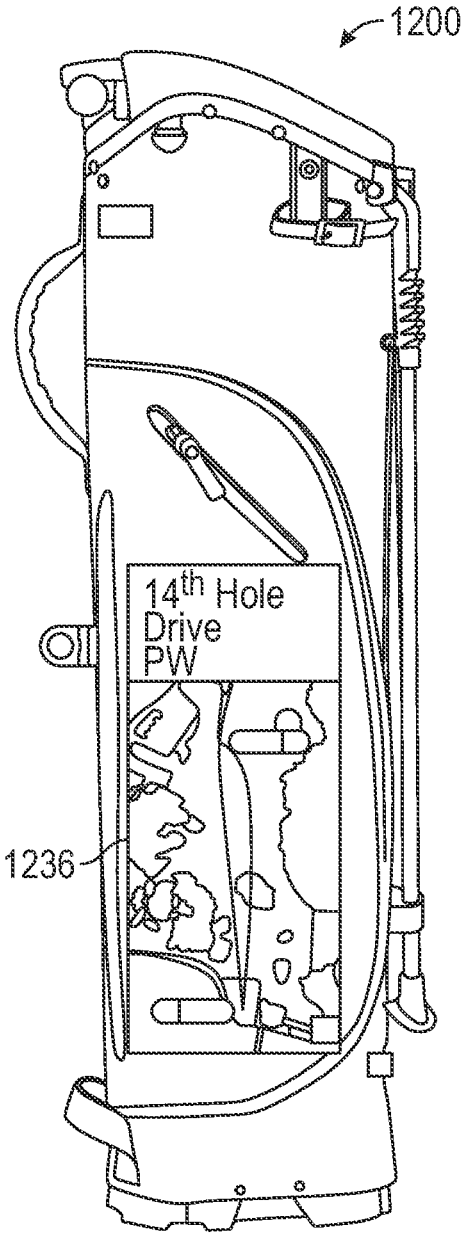
FIG. 37 shows a side view of a golf bag with a display, according to another example.

As shown in FIG. 37, the one or more golf bag electronic displays 1236 on the golf bag 1200 may display situational messages. Situational messages based on the specific golf hole can provide valuable information and enhance the viewing experience for spectators on course and off course. For example, the golf bag 1200 can comprise the golf bag electronic display 1236 disposed on the side portion of the golf bag 1200. The golf bag electronic display 1236 can be configured to display a situational message comprising a map of a golf course or a map of a golf hole. The golf bag electronic display 1236 can be additionally or alternatively configured to display the hole number. Other situational messages can include:

1. Hole layout and overall distance (yards or meters)—This message displays the layout of the current hole and the total distance it spans, helping players strategize their shots.
2. Distance to hole (yards or meters)—This message shows the golfer's current distance from the hole, allowing them to gauge the remaining length of their shot.
3. Hole number and par information—This message displays the current hole number and its corresponding par, helping players keep track of their score relative to par.
4. Leaderboard updates—This message displays the current tournament leaderboard, allowing spectators to follow their favorite players and see how they are faring in the competition.
5. Hole statistics—This message can display information about a golfer's performance on a specific hole, such as their average score, fairway hit percentage, and more.

These situational messages provide valuable information and keep spectators informed about the tournament, adding to the excitement and engagement of the event. These messages can be pushed to the golf bag 1200 by the sponsor. For example, the golf bag electronic display 1236 can display these situational messages based on a wired or wireless communication from a computing device controlled by the sponsor. In other examples, the golf bag electronic display 1236 can display these situational messages based on pre-programmed instructions stored in a computing system (such as computing system 1000) operably coupled to the golf bag electronic display 1236. In some instances, the messages may be pre-recorded and based upon GPS, geo-fencing, or some other proximity sensor or location sensor, pre-programmed messages may be displayed that provide valuable information to the spectators such as a hole number, a hole layout, and hole statistics for the week or prior tournaments. Messages and/or images and/or content associated with, for example, a particular location on a course (e.g., a particular hole), selected GPS coordinates, etc., can be displayed when a controller or other electronics of the golf bag detect that the golf bag is at the selected location.

Below are more examples of what a sponsor may display on the golf bag electronic display 1236 on a sponsored tour player's golf bag 1200. In certain examples, these messages could be directed towards a spectator and not the tour player. These examples are in addition to the other examples discussed throughout.

1. Logo and brand name of the sponsor
2. Golf equipment used by the player
3. Golf equipment being used for a particular shot by a player, which could be detected by what club is pulled out of the golf bag. How far the player typically hits this golf club, or percent chance of hitting green or fairway, or percent chance of making a putt.
4. Product advertisements and promotions
5. Upcoming events and sponsorships
6. Golf tips and tutorials
7. Social media and website links
8. Player profiles and statistics
9. Live scores and leaderboards
10. Course map and hole information
11. Food and beverage specials
12. Sponsored prizes and giveaways.

Below are some examples of what a tournament sponsor may display on the golf bag electronic display 1236 disposed on the golf bag 1200 for a spectator to view:

1. Company logo and branding
2. Product and service promotions
3. Sponsorship or partnership recognition
4. Interactive advertisements and games
5. Up-to-date leaderboard and scores
6. Live streaming of select golf holes
7. Contest or giveaway information
8. Celebrity appearances or interviews
9. Pro-golfer and brand ambassador profiles
10. Social media promotion and engagement opportunities.
11. Safety or inclement weather messages In addition to the above, further examples that may appear on the golf bag electronic display 1236 display that may be visible to a spectator can include:

1. Hole information, including yardage, par, and stroke index
2. Live leaderboard updates and scorecard
3. Highlight reels from previous holes
4. Real-time weather updates
5. Advertisements from tournament sponsors
6. Interactive hole maps with hazards and strategy tips
7. Player statistics and biographies
8. Course statistics, such as fairway hit percentage and greens in regulation
9. Virtual merchandise store with golf equipment and accessories
10. Social media updates from players and fans
11. Shot tracer technology
12. Player swing analysis and video replays
13. Hole-by-hole highlights from previous rounds
14. Fantasy golf league updates
15. Live video feeds of key shots and holes
16. Sponsored contests and giveaways
17. Latest golf news and headlines
18. Behind-the-scenes footage and interviews with players
19. Virtual "Fan Zone" with games, quizzes, and other interactive features
20. Live broadcast of post-round press conferences and interviews.

Any of the above could be displayed on screens throughout the tournament, such as fixed screens, but additionally may be displayed on individual golfer's golf bags 1200 or on golf carts and/or other vehicles parked or roaming around the tournament grounds.

Furthermore, it should be mentioned that any of the example visual cues, situational messages, images, or information that can be displayed on the golf bag electronic display 1236 can additionally or alternatively be displayed on any other display disclosed in this application (such as the crown display 836, the sole display 847, the face display 838, the wraparound display 903, and/or a head cover electronic display (FIGS. 38-41)).

Example 13: Electronic Display Having Information Targeted at a Golfer

In another embodiment, the golf bag electronic displays 1236 on the golf bags 1200 can provide situational messages to golfers during non-competitive play, such as club recommendations or specific shot recommendations. For example, the situational message "Hit 3 wood and fade it off the left bunker" can provide golfers with guidance and suggestions during their round of golf. This type of situational message can be particularly useful for amateur golfers who are looking to improve their game and make smarter club selections. By displaying real-time information and advice, the golf bag electronic displays 1236 can enhance the golfing experience and help players make the most of their round.

FIGS. 38-41 illustrate embodiments of a golf club head cover 1300 (which is also referred to herein as a "head cover") comprising a head cover electronic display 1336 disposed on the head cover 1300. The head cover electronic display 1336 can be disposed on any portion of an outer surface of the head cover 1300.

The head cover electronic display 1336 can be configured to display any visual cue or image disclosed in this application. For example, the head cover 1300 covering a driver type golf club head, which is not recommended for use for a particular hole, may display the message "$14^{th}$ NOPE! HIT YOUR 3 WOOD." However, the head cover 1300 covering a recommended club to hit, (e.g., the 3-wood) may indicate that it is the preferred club to hit and display a recommended swing thought or target, e.g., "$14^{th}$ FADE IT OFF LEFT BUNKER." This indicates to the golfer not only what club to hit but provides some situational course knowledge and shot recommendation that may be specific to the golfer. In this example, it's hole 14 and the recommended shot is a 3-wood faded off the left bunker. In other words, this messaging may be prompted and based on numerous calculations and/or simulations performed by a computing device (such as computing system 1000) coupled to the head cover electronic display 1336 and/or by an external device (such as a mobile phone, laptop, or cloud computing service 1110) in communication with the head cover electronic display 1336. In certain embodiments, the calculations and simulations can be based at least in part on historical rounds that are unique to this particular golfer. For example, calculations and simulations based on historical rounds can suggest that a particular golfer is more likely to score better on a particular hole using a 3-wood and in particular hitting a fade of the left bunker as opposed to a draw off the right bunker. The head cover electronic display 1336 may also provide percentages of likelihood to make par if a driver is used off the tee versus a 3-wood. For example, the head cover electronic display 1336 for the head cover 1300 covering a driver might display 42% chance of par, and the head cover electronic display 1336 for the head cover 1300 covering a 3-wood might display 74% chance of par. These percentages would be unique to the player based on historical rounds and data captured.

Figures 38, 39, 40, 41:
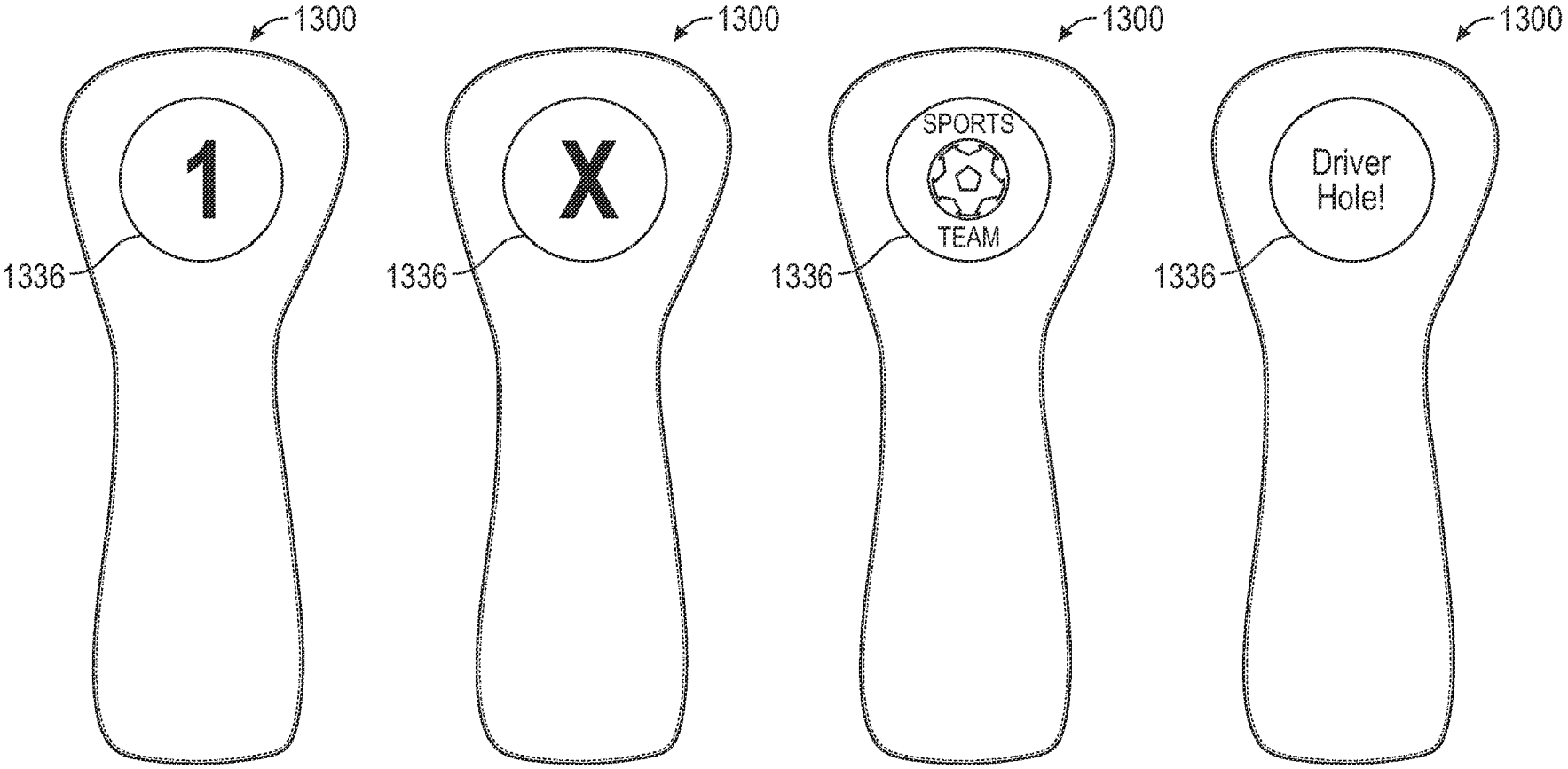
FIG. 38 shows a front view of a head cover with a display, according to another example.
FIG. 39 shows a front view of a head cover with a display, according to another example.
FIG. 40 shows a front view of a head cover with a display, according to another example.
FIG. 41 shows a front view of a head cover with a display, according to another example.

As shown in FIGS. 38-39, the head cover electronic display 1336 may simply show an indicator such as "1" (FIG. 38) or "3" or "X" (FIG. 39) as an indicator, or "big dog" for driver and "spoon" for 3-wood or whatever nickname the golfer prefers. Or, as shown in FIG. 40, the head cover electronic display 1336 could display a logo of a favorite sports team. A computing system coupled to the head cover electronic display 1336 can be configured to transmit instructions to the head cover electronic display 1336 to change the displayed logo based on time. For example, the computing system (which can be similar to computing system 1000) may send instructions to the head cover electronic display 1336 to change the logo by the season (e.g., by displaying professional or college football logos in the fall and baseball logos in the summer). The head cover electronic display 1336 could alternate between situational messages and a club head indicator. The situational messages may be triggered by a location on the course.

Other messages may include weather or forecast, including messages such as "sunset in 30 minutes, pick up the pace," or "rain in 30 minutes, head for cover."

Like the above electronic displays, the head cover electronic displays 1336 may be capable of wireless communication using WiFi, 5G, cellular data, a WiFi mesh, Bluetooth, NFC, RFID, and the like. The golf course may be temporarily wired with one or more WiFi hotspots or a WiFi mesh to support the tournament, or the individual head cover electronic displays 1336 may rely on cellular data to send and receive information. The head cover electronic displays 1336 may further be connected to memory, storage, a CPU, a GPU, GPS, IMU(s), buttons, various input/output ports, charging port, or coil for inductive charging, and other common components (e.g., component similar to those forming computing system 1000) included in most smart devices. This would allow for remote control of the head cover electronic displays 1336 by a sponsor. Alternative embodiments may be preprogrammed with content that is triggered to play once the golf bag 1200 and/or the head cover 1300 enters a prescribed geo-location or geo-fence, or after prescribed time limits. Alternatively, other embodiments of the head cover electronic displays 1336 may be preprogrammed with content, but not change until additional programming instructions are received, or not change based on location, or not change based on prescribed time. For example, a logo or bag color on an electronic display may stay the same throughout the tournament. The programming instructions could be stored in storage or memory.

Furthermore, it should be understood that any other displays disclosed in this application (including the crown display 836, the face display 838, the wraparound display 903, the golf bag electronic display 1236, and/or any other display disclosed throughout this application) can be similarly configured and/or connected and/or have similar capabilities.

Shot tracking can be accomplished by typical shot tracker systems which include manual systems, semi-automated systems, and nearly fully automated systems. Manual systems would simply be noting the yardage of each shot using pacing methods, GPS, or a laser range finder or some combination of those methods. Semi-automated systems may include marking a map where shots are taken by pushing data or information on a phone, by dropping a GPS "bread crumb," or swiping or tagging an active or passive RFID tied to a GPS device to log a location. A near fully automated system (e.g., a system similar to and/or including the ARCCOS® shot tracker system) attempts to detect what club is used by using unique identifiers (e.g. RFID or a high pitched frequency detectable by a microphone but not the human ear). The shot tracker system is tied to a phone or a standalone device and concurrently logs a GPS location for each shot and then can calculate individual distances for each club and can measure the success rate of each club. Success would generally be landing on the fairway, on a green in regulation, or sinking a putt. For example, the ARCCOS® shot tracker system uses sensors like accelerometers and gyroscopes and machine learning to detect impact. The results of the shot tracking can be manually tracked, or can be uploaded to a computer system where more complex calculations can be performed and recommendations can be outputted. These recommendations can later serve as a caddie like feature similar to known systems already in existence, such as the ARCCOS® shot tracker system's caddie feature.

The sensors used in ARCCOS® shot tracker system are small, lightweight devices that attach to the end of each club. They use a combination of accelerometers and gyroscopes to collect data on the clubhead speed, angle of attack, and other shot metrics. The sensors communicate with each other or a mobile device using Bluetooth technology, RFID, or sound waves and transmit data to a mobile app or website where it can be analyzed. The mobile device may have a microphone to pickup various high-frequency sounds output by the sensors, which in general are not perceptible to the human ear because they are at such a high frequency.

To detect which club is being used, the sensors use a combination of machine learning algorithms and data analysis. The system uses data collected from each shot to determine the characteristics of each club, including its weight, length, and other physical characteristics. Over time, the system becomes more accurate in identifying each club, allowing golfers to get a more accurate analysis of their shots.

In addition to detecting which club is being used, the sensors also collect data on the golfer's swing, including the clubhead speed, angle of attack, and other metrics. This data is analyzed by the system to provide insights into the golfer's swing and to help identify areas for improvement. The system provides real-time feedback (e.g., through a user interface, software application, or app on a mobile device) during a round, as well as detailed post-round analysis, helping golfers make informed decisions on the course and identify areas for improvement in their game.

Overall, the ARCCOS® shot tracker system provides golfers with a comprehensive analysis of their game, helping them make informed decisions on the course and improve their swing over time. The sensors are small and lightweight, making them easy to use, and the app provides detailed analysis and feedback to help golfers improve their game.

There is also a Caddie feature that provides recommendations for the golfer based on historical for the golfer and other golfers in the big dataset that use ARCCOS® shot tracker system.

The following publications and patents are herein incorporated by reference in their entireties and relate to shot tracking, club identification, and on course recommendations:

| Publication Number | Publication Date |
|---|---|
| U.S. Pat. No. 11,583,729 | 2023 Feb. 21 |
| US20170021260A1 | 2017 Jan. 26 |
| US20220161121A1 | 2022 May 26 |
| U.S. Pat. No. 11,219,814B2 | 2022 Jan. 11 |
| U.S. Pat. No. 11,148,026B2 | 2021 Oct. 19 |
| US20200298094A1 | 2020 Sep. 24 |
| U.S. Pat. No. 10,682,562B2 | 2020 Jun. 16 |
| U.S. Pat. No. 10,589,161B2 | 2020 Mar. 17 |
| US20200023253A1 | 2020 Jan. 23 |
| U.S. Pat. No. 10,427,017B2 | 2019 Oct. 01 |
| US20180200605A1 | 2018 Jul. 19 |
| U.S. Pat. No. 9,999,821B2 | 2018 Jun. 19 |
| US20180015349A1 | 2018 Jan. 18 |
| U.S. Pat. No. 9,770,639B2 | 2017 Sep. 26 |
| US20170087431A1 | 2017 Mar. 30 |
| US20170021261A1 | 2017 Jan. 26 |
| US20160317895A1 | 2016 Nov. 03 |
| U.S. Pat. No. 9,412,979B2 | 2016 Aug. 09 |
| U.S. Pat. No. 9,339,714B2 | 2016 May 17 |
| U.S. Pat. No. 6,456,938B1 | 2002 Sep. 24 |
| U.S. Pat. No. 7,121,962B2 | 2006 Oct. 17 |
| U.S. Pat. No. 8,535,170B2 | 2013 Sep. 17 |
| U.S. Pat. No. 8,758,170B2 | 2014 Jun. 24 |
| U.S. Pat. No. 7,118,498B2 | 2006 Oct. 10 |
| U.S. Pat. No. 8,523,711B2 | 2013 Sep. 03 |
| U.S. Pat. No. 8,556,752B2 | 2013 Oct. 15 |
| U.S. Pat. No. 9,656,134B2 | 2017 May 23 |
| U.S. Pat. No. 8,172,702B2 | 2012 May 08 |
| U.S. Pat. No. 8,142,304B2 | 2012 Mar. 27 |
| U.S. Pat. No. 8,221,269B2 | 2012 Jul. 17 |
| U.S. Pat. No. 9,656,147B2 | 2017 May 23 |
| U.S. Pat. No. 8,620,463B2 | 2013 Dec. 31 |
| U.S. Pat. No. 8,708,841B2 | 2014 Apr. 29 |
| U.S. Pat. No. 8,364,293B2 | 2013 Jan. 29 |
| U.S. Pat. No. 9,943,744B2 | 2018 Apr. 17 |
| U.S. Pat. No. 8,894,502B2 | 2014 Nov. 25 |
| US20150335978A1 | 2015 Nov. 26 |

In other examples, the displays on the golf bag 1200 and/or the head cover 1300 can display swing tips, swing videos, swing drills, etc. For example, as shown in FIG. 41, the head cover electronic display 1336 can be display images and/or messages suggesting to the user that a particular golf stroke requires the use of a driver (such as a driver covered by the head cover 1300). The golf bag electronic display 1236 and/or the head cover electronic display 1336 can also be in data communication with a launch monitor and can display launch conditions such as back spin, side spin, ball speed, carry and total distance. This would be beneficial for a practice session on a driving range. The golf bag electronic display 1236 and/or the head cover electronic display 1336 can also display hole maps and club recommendations.

Below are some additional examples of information that may be displayed on the golf bag electronic display 1236, the head cover electronic display 1336, and/or any other display (such as the crown display 836, the sole display 847, the face display 838, and/or the wraparound display 903) on the golf course:

1. Hole-by-hole yardages and distances to hazards and greens.
2. Course layout and map.
3. Hole difficulty rating.
4. Real-time leaderboard.
5. Shot tracking and analysis.
6. Personal player stats (e.g. fairways hit, greens in regulation, putts per hole).
7. Weather updates and forecasts.
8. Advertisements and promotions.
9. Recommended club selection based on player's personal data.
10. Post-round analysis, including scorecard, statistics, and tips for improvement.
11. For example, practice lag putting from 20 feet, or practice greenside bunker shots.

It should be understood that any of the example information targeting a user that can be displayed on the head cover electronic display 1336 can additionally or alternatively be displayed on any other display disclosed in this application (such as the crown display 836, the sole display 847, the face display 838, the wraparound display 903, and/or the golf bag electronic display 1236).

Example 14: Messages on Displays on the Bottom of a Golf Bag

As previously discussed in connection with FIGS. 34-35, the golf bag 1200 can comprise the golf club bag display 1236 disposed on the bottom portion (e.g., a bottom surface) of the golf bag 1200. The messaging on the bottom of a golf bag 1200 could include information that is relevant and appealing to the spectator on the course or viewing remotely. The messaging may be visible when the golf bag 1200 is on its side or being carried. Some examples can include:

1. Brand name and logo of the sponsor or manufacturer.
2. Product taglines and slogans.
3. Product features and benefits.
4. Contact information, such as a website or social media handles.
5. Promotions and discounts.
6. Testimonials and customer reviews.
7. Hashtags and social media handles for promotion.
8. Photos and images of the product in use.
9. Awards and certifications.
10. A brief company history or background story.
11. A call to action, such as "Shop Now" or "Follow Us".
12. Endorsements from professional golfers or influencers.
13. Partnerships or collaborations with other brands.
14. Charitable causes or initiatives supported by the company.
15. Environmental sustainability and eco-friendly initiatives.
16. A QR code or NFC tag for easy access to additional information.
17. A map of golf courses where the product can be used.
18. A list of pro shops and retailers where the product can be purchased.
19. Product specifications and technical details.
20. Product reviews and ratings from customers and experts.

Example 15: Communication with a Shot Tracker System

In examples where a club head (such as any of the club heads disclosed in this application), golf bag (such as golf bag 1200), and/or head cover (such as head cover 1300) is in communication with a shot tracker system (such as the ARCCOS® shot tracker system), a computing system connected with the respective club head, golf bag, and/or head cover can send a message or signal to the shot tracker system when a club head (such as club heads 102, 202, 302, . . . 802, 902, etc.) covered by a head cover (such as head cover 1300) is removed from a golf bag (such as golf bag 1200). The computing system can also determine a location (e.g., a location on a golf course) where the club head and the head cover were removed from the golf bag and/or a location where the head cover was removed from the club head. The message or signal can indicate what kind of club head (such as a driver, a 7 iron, etc.) was removed from the club head and/or the golf bag. The shot tracker system can record the location where the club and the head cover were removed from the golf bag and can keep a data log/map of what club was played where on the course. By analyzing the sequence of clubs removed from and added to the golf bag in combination with the location data where those actions took place, the shot tracker system can calculate the distance that a golf ball traveled between shots. By comparing multiple rounds on the same hole and/or course by the same player and/or players with similar characteristics, the shot tracker system can determine whether the club selected for a particular shot was a good choice or not. Based on this determination, the shot tracker system can determine and/or select a situational message to display to the user on any of the displays described herein. Situational messaging on the head covers can include tips on what club to play for a next shot (or that a particular club shouldn't be selected), how to angle a shot, and/or whether the player should attempt to impart a particular spin on the ball (e.g., for a fade shot, a draw shot, etc.).

The club head, golf bag, and/or head cover in communication with the shot tracker system can transmit data to the shot tracker system. The transmitted data can be processed or analyzed to select a situational message to display on a display on the club head (such as displays 836, 838, or 903), a display on the golf bag (such as display 1236), a display on the head cover (such as display 1336), a display on a user's phone, a display at a club house, and/or a display on a golf cart. The shot tracker system, the club head, the golf bag, and/or the head cover can use GPS and/or any of a variety of proximity sensors (e.g., sensors employing an electromagnetic field such as a Hall Effect sensor, electromagnetic radiation, etc., to determine the distance between the sensor and a target) to select an appropriate situational message to display. The shot tracker system (for example, a software application running on the user's phone) can be used to capture data of the user's prior golf rounds, and can perform a statistical analysis to determine, for example, that the best chance of making par on an upcoming hole is by using a particular club (e.g., a 3 wood). Data can be captured using sensors on the club head. The shot tracker system can have access to the user's historical data of prior golf rounds and/or data of similar users. The shot tracker system can determine, based on a combination of sensor data, comparison of historical data, comparison of data of similar users, etc., which situational message to display to the user (e.g., a recommendation of which club to select for an upcoming shot). Data can be transmitted to a selected display for display to the user from the user's phone, a transmitter elsewhere on the grounds such as at a golf course club house, a transmitter on a golf cart, etc.

It should be mentioned that any of the example information targeting a user that can be displayed on the head cover electronic display 1336 can additionally or alternatively be displayed on any other display disclosed in this application (such as the crown display 836, the sole display 847, the face display 838, the wraparound display 903, and/or the golf bag electronic display 1236). Furthermore, it should be understood that any of the club heads and golf bags disclosed in this application can communicate with the shot tracker system in the same manner as the head cover 1300. Furthermore, it should be understood that any of the club heads and golf bags disclosed in this application can communicate with the shot tracker system in the same manner as the head cover 1300.

Additional Considerations

Now with the basic structure of the various club head components described and defined, key relationships between these components will be disclosed. As with all the relationships disclosed herein, these relationships are more than mere optimization, maximization, or minimization of a single characteristic or variable, and are often contrary to conventional design thinking yet have been found to achieve a unique balance of the trade-offs associated with competing criteria such as durability, viewability, weight distribution, CG placement, impact dynamics, and desired moments of inertia. The aforementioned balance requires trade-offs among the competing characteristics recognizing key points of diminishing returns. Therefore, this disclosure contains a unique combination of relationships that produce enhanced alignment features, as well as the location of the display and electronic components, viewability, durability, and impact resistance/durability of electronic components and reduce the negative attributes associated with the weight, placement, and fragility of such components. Further, the relative dimensions, including, but not limited to component masses, overall mass, inertias, length, width, cross-sectional dimensions, thickness, and their relationships to one another and the other design variables disclosed herein, influence the aforementioned criteria. Additionally, many embodiments have identified upper and/or lower limits ranges. For embodiments outside theses ranges or relationships, the performance may suffer and adversely impact the goals of the design.

In one embodiment the club head is a driver having a loft less than 13 degrees, a club length of 43"-47", and a club head mass of no more than 210 grams.

In some examples, the club head can include a light output (not shown), such as a laser pointer, projector, or other components, for outputting a light-based indicator away from the club head. For example, such an indicator can comprise a light beam that projects in the direction that club head is currently facing (e.g., perpendicular from the center of the striking face), or in a direction that is not perpendicular to the center of the striking face to indicate a post-impact club head path for a particular shot shape, such as a draw or a face. Similarly, such an indicator can comprise a light beam that projects in the direction away from the rear of the club head club head, and in one embodiment is perpendicular from the center of the striking face, while in further embodiments is in a direction that is not perpendicular to the center of the striking face to indicate a backswing take-away club head path for a particular shot shape, such as a draw or a face.

More information related to other golf clubs and golf club heads be found in the following, each of which is incorporated by reference herein in its entirety:

U.S. Pat. No. 10,324,577;
U.S. Pat. No. 10,331,005;
U.S. Pat. No. 10,391,369;
U.S. Pat. No. 10,793,750;
U.S. Pat. No. 11,219,803;

U.S. Pat. No. 11,318,358;
U.S. Patent Application Publication No. 2019/0232121;
U.S. patent application Ser. No. 17/878,734;
U.S. patent application Ser. No. 18/082,735;
U.S. patent application Ser. No. 18/082,271;
U.S. patent application Ser. No. 18/102,001; and
U.S. Patent Application No. 63/433,380.

In addition to the various features described herein, any of the golf club heads disclosed herein may also incorporate additional features, which can include any of the following features:

1. movable weight features including those described in more detail in U.S. Pat. Nos. 6,773,360, 7,166,040, 7,452,285, 7,628,707, 7,186,190, 7,591,738, 7,963,861, 7,621,823, 7,448,963, 7,568,985, 7,578,753, 7,717,804, 7,717,805, 7,530,904, 7,540,811, 7,407,447, 7,632,194, 7,846,041, 7,419,441, 7,713,142, 7,744,484, 7,223,180, 7,410,425 and 7,410,426, the entire contents of each of which are incorporated by reference herein in their entirety;
2. slidable weight features including those described in more detail in U.S. Pat. Nos. 7,775,905 and 8,444,505, U.S. patent application Ser. No. 13/898,313 filed on May 20, 2013, U.S. patent application Ser. No. 14/047,880 filed on Oct. 7, 2013, the entire contents of each of which are hereby incorporated by reference herein in their entirety;
3. aerodynamic shape features including those described in more detail in U.S. patent application Ser. No. 17/360,179, U.S. patent application Ser. No. 17/485,977, U.S. patent application Ser. No. 17/682,471, the entire contents of which are incorporated by reference herein in their entirety;
4. removable shaft features including those described in more detail in U.S. Pat. No. 8,303,431, the contents of which are incorporated by reference herein in their entirety;
5. adjustable loft/lie features including those described in more detail in U.S. Pat. Nos. 8,025,587, 8,235,831, 8,337,319, U.S. Patent Publication No. 2011/0312437A1, U.S. Patent Publication No. 2012/0258818A1, U.S. Patent Publication No. 2012/0122601A1, U.S. Patent Publication No. 2012/0071264A1, U.S. patent application Ser. No. 13/686,677, the entire contents of which are incorporated by reference herein in their entirety; and
6. adjustable sole features including those described in more detail in U.S. Pat. No. 8,337,319, U.S. Patent Publication Nos. US2011/0152000A1, US2011/0312437, US2012/0122601A1, and U.S. patent application Ser. No. 13/686,677, the entire contents of each of which are incorporated by reference herein in their entirety.

The technology described herein may also be combined with other features and technologies for golf clubs, such as:

1. variable thickness face features described in more detail in U.S. patent application Ser. No. 12/006,060, U.S. Pat. Nos. 6,997,820, 6,800,038, and 6,824,475, which are incorporated by reference herein in their entirety;
2. composite face plate features described in more detail in U.S. patents application Ser. Nos. 11/998,435, 11/642,310, 11/825,138, 11/823,638, 12/004,386, 12/004,387, 11/960,609, 11/960,610 and U.S. Pat. No. 7,267,620, which are incorporated by reference herein in their entirety.

Additionally, in addition to the various features described herein, any of the golf club heads disclosed herein may also incorporate additional features, which can include any of the features disclosed in U.S. Patent Application Ser. No. 63/292,708, Ser. Nos. 17/378,407, 17/355,642, 17/355,642, 17/825,820, 16/817,311, 17/547,519, 17/360,179, 17/560,054, 17/124,134, 17/531,979, 17/722,748, 17/505,511, 17/560,054, 17/389,167, 17/006,561, 17/137,151, 16/806,254, 17/321,315, 17/696,664, 17/565,580, 17/727,963, 16/288,499, 17/530,331, 17/586,960, 17/884,027, 13/842,011, 16/817,311, 17/355,642, 17/722,748, 17/132,645, 17/696,664, 17/884,027, 17/390,615, 17/586,960, 17/691,649, 17/224,026, 17/560,054, 17/164,033, 17/107,474, 17/526,981, 16/352,537, 17/156,205, 17/132,541, 17/565,580, 17/360,179, 17/355,642, 17/727,963, 17/824,727, 17/722,632, 17/712,041, 17/696,664, 17/695,194, 17/691,649, 17/686,181, 63/305,777, 17/577,943, 17/570,613, 17/569,810, 17/566,833, 17/565,580, 17/566,131, 17/566,263, 17/564,077, 17/560,054, 63/292,708, 17/557,759, 17/558,387, 17/645,033, 17/547,519, 17/541,107, 17/530,331, 17/526,981, 17/526,855, 17/524,056, 17/522,560, 17/515,112, 17/513,716, 17/505,511, 17/504,335, 17/504,327, 17/494,416, 17/493,604, 63/261,457, 17/479,785, 17/476,839, 17/477,258, 17/476,025, 17/467,709, 17/403,516, 17/399,823, 17/390,615, 63/227,889, 17/389,167, 17/387,181, 17/378,407, 17/368,520, 17/360,179, 17/355,642, 17/330,033, 17/235,533, 17/233,201, 17/228,511, 17/224,026, 17/216,185, 17/198,030, 17/191,617, 17/190,864, 17/183,905, 17/183,057, 17/181,923, 17/171,678, 17/171,656, 17/164,033, 17/156,205, 17/564,077, 17/124,134, 17/107,447, 17/727,963, 63/292,708, 63/305,777, and 63/338,818, all of which are herein incorporated by reference in their entirety. Additionally, in addition to the various features described herein, any of the golf club heads disclosed herein may also incorporate additional features, which can include any of the features disclosed in U.S. Pat. Nos. 11,213,726, 8,777,776, 7,278,928, 7,445,561, 9,409,066, 8,303,435, 7,874,937, 8,628,434, 8,608,591, 8,740,719, 8,777,776, 9,694,253, 9,683,301, 9,468,816, 8,777,776, 8,262,509, 7,901,299, 8,119,714, 8,764,586, 8,227,545, 8,066,581, 9,409,066, 10,052,530, 10,195,497, 10,086,240, 9,914,027, 9,174,099, 11,504,581, and 11,219,803, all of which are herein incorporated by reference in their entirety.

Furthermore, where a definition or use of a term in a document which is incorporated by reference herein is inconsistent or contrary to the definition of that term provided herein, the definition of that term provided herein applies and the definition of that term in the document incorporated by reference does not apply.

In view of the many possible embodiments to which the principles of the disclosure may be applied, it should be recognized that the illustrated embodiments are only examples and should not be taken as limiting the scope of the disclosure. Various modifications may be made thereto without departing from the broader spirit and scope of the disclosure as set forth. The specification and drawings are, accordingly, to be regarded in an illustrative sense rather than a restrictive sense. Accordingly, the scope of the disclosure is at least as broad as the full scope of the following exemplary claims and equivalents of the recited features.

What is claimed is:

1. A golf club head, comprising:

a body defining an interior cavity, a sole defining a bottom portion of the golf club head, a crown defining a top portion of the golf club head, a face defining a forward portion of the golf club head, a rearward portion of the golf club head opposite the face, and a hosel, the golf club head having a topline along a face-to-crown transition at the forward portion of the golf club head;

wherein the face includes a center face location that defines a head origin of a coordinate system in which an x-axis is tangential to the face at the center face location and is parallel to a ground plane when the golf club head is in a normal address position, a y-axis extends perpendicular to the x-axis and is also parallel to the ground plane, and a z-axis extends perpendicular to the ground plane, wherein a positive x-axis extends toward a heel portion from the head origin, a positive y-axis extends toward the rearward portion from the head origin, and a positive z-axis extends toward the top portion from the head origin, and wherein the crown comprises an electronic paper display positioned along the face-to-crown transition of the golf club head or wrapped from the face on to the crown, the electronic paper display being sized and shaped to display an image that changes a position of the topline along the positive y-axis from a perspective of a user of the golf club head when the golf club head is in a normal address position.

2. The golf club head of claim 1, wherein the electronic paper display is sized and shaped to display an image that changes the angle and/or shape of the topline from the perspective of the user when the golf club head is in a normal address position.

3. The golf club head of claim 1, wherein the crown further comprises a crown insert having a crown insert surface area, the electronic paper display has an electronic paper display surface area, and a ratio of the electronic paper display surface area to the crown insert surface area is 25% to 100%.

4. The golf club head of claim 1, wherein:

the electronic paper display is a first electronic paper display; and the face further comprises a second electronic paper display.

5. The golf club head of claim 1, wherein:

the body comprises a top opening and a bottom opening, a crown insert coupled to the top opening, and a sole insert coupled to the bottom opening; and an electronic assembly is disposed within the interior cavity and is in electrical communication with and configured to control the electronic paper display, the electronic assembly being located rearward of the sole insert.

6. The golf club head of claim 5, further comprising a battery within the interior cavity and in electrical communication with the electronic assembly, the battery being located rearward of a center of gravity of the golf club head.

7. The golf club head of claim 6, further comprising a receiving coil coupled to the sole insert, the receiving coil being electrically connected to the battery for charging the battery by magnetic induction.

8. The golf club head of claim 5, wherein the body comprises a composite material, and the electronic assembly is coupled to the composite material at a rearward portion of the body.

9. The golf club head of claim 8, wherein the golf club head further comprises a battery within the interior cavity coupled to the composite material at the rearward portion of the body.

10. The golf club head of claim 5, further comprising an antenna located within the interior cavity at a rearward portion of the body, the antenna being in communication with the electronic assembly.

11. The golf club head of claim 1, wherein the face comprises a plurality of layers, the plurality of layers comprising:

a base layer;

a piezoelectric layer coupled to the base layer; and a face electronic paper display coupled to the piezoelectric layer, wherein the piezoelectric layer is configured to generate a signal in response to a golf ball impacting the face, and the face electronic paper display is configured to display an impact location of the golf ball on the face in response to the signal from the piezoelectric layer.

12. The golf club head of claim 1, wherein the face comprises a plurality of layers, the plurality of layers comprising:

a base layer; and a piezoelectric layer coupled to the base layer, wherein the electronic paper display is coupled to the piezoelectric layer, wherein the piezoelectric layer is configured to generate a signal in response to a golf ball impacting the face, and wherein the electronic paper display is configured to display an impact location of the golf ball in response to the signal from the piezoelectric layer.

13. A golf club head comprising:

a body defining an interior cavity, a sole defining a bottom portion of the golf club head, a crown defining a top portion of the golf club head, a face defining a forward portion of the golf club head, a rearward portion of the golf club head opposite the face, and a hosel, wherein the face comprises a plurality of layers, the plurality of layers comprising:

a base layer;

a piezoelectric layer coupled to the base layer; and an electronic paper display coupled to the piezoelectric layer, wherein the piezoelectric layer is configured to generate a signal in response to a golf ball impacting the face, and the electronic paper display is configured to display an impact location of the golf ball on the face in response to the signal from the piezoelectric layer.

14. The golf club head of claim 13, wherein the base layer comprises a composite material.

15. The golf club head of claim 13, wherein the plurality of layers further comprises a protective layer covering the electronic paper display, the protective layer comprising scorelines on an outer surface of the protective layer.

16. The golf club head of claim 13, wherein the face comprises a face surface area, the electronic paper display comprises an electronic paper display surface area, and a ratio of the electronic paper display surface area to the face surface area is 25% to 100%.

17. The golf club head of claim 13, wherein the impact location is a first impact location, and wherein the electronic paper display is configured to indicate a distance between the first impact location and a second impact location.

18. A golf club head comprising:

a body defining an interior cavity, a sole defining a bottom portion of the golf club head, a crown defining a top portion of the golf club head, a face defining a forward portion of the golf club head, a rearward portion of the golf club head opposite the face, and a hosel, the golf club head having a topline along a face-to-crown transition at the forward portion of the golf club head, wherein the face includes a center face location that defines a head origin of a coordinate system in which an x-axis is tangential to the face at the center face location and is parallel to a ground plane when the golf club head is in a normal address position, a y-axis extends perpendicular to the x-axis and is also parallel to the ground plane, and a z-axis extends perpendicular to the ground plane, wherein a positive x-axis extends toward a heel portion from the head origin, a positive y-axis extends toward the rearward portion from the head origin, and a positive z-axis extends toward the top portion from the head origin;

the crown comprising a first electronic paper display, the first electronic paper display comprising a front edge portion extending along a front portion of the crown; and the face comprising a second electronic paper display, the second electronic paper display comprising a top edge portion extending along an upper edge of the face, and wherein the first electronic paper display and the second electronic paper display are configured to display images that change a position of the topline along the positive y-axis from a perspective of a user of the golf club head when the golf club head is in a normal address position.

19. The golf club head of claim 18, wherein the face further comprises a face insert having a face insert surface area, the second electronic paper display has a second electronic paper display surface area, and a ratio of the second electronic paper display surface area to the face insert surface area is 25% to 100%.

20. The golf club head of claim 18, wherein the second electronic paper display is a segmented display comprising a first pre-configured segment corresponding to a first border configuration for outlining the face and a second pre-configured segment corresponding to a second border configuration for outlining the face.

21. The golf club head of claim 18, wherein the face comprises a piezoelectric layer coupled to an inner surface of the second electronic paper display.

22. The golf club head of claim 21, wherein the second electronic paper display is configured to display a heat map of contact pressures measured by the piezoelectric layer.

* * * * *